US007040944B2

(12) United States Patent
Kado et al.

(10) Patent No.: US 7,040,944 B2
(45) Date of Patent: May 9, 2006

(54) PLASMA DISPLAY PANEL WITH SUPERIOR LIGHT-EMITTING CHARACTERISTICS, AND METHOD AND APPARATUS FOR PRODUCING THE PLASMA DISPLAY PANEL

(75) Inventors: Hiroyuki Kado, Osaka (JP); Mitsuhiro Ohtani, Sakai (JP); Masaki Aoki, Mino (JP); Kanako Miyashita, Moriguchi (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 14 days.

(21) Appl. No.: 10/943,696

(22) Filed: Sep. 17, 2004

(65) Prior Publication Data

US 2005/0054258 A1 Mar. 10, 2005

Related U.S. Application Data

(62) Division of application No. 09/719,134, filed as application No. PCT/JP99/03189 on Jun. 15, 1999.

(30) Foreign Application Priority Data

| | | |
|---|---|---|
| Jun. 15, 1998 | (JP) | 10-166620 |
| Jun. 30, 1998 | (JP) | 10-183758 |
| Jul. 31, 1998 | (JP) | 10-217260 |
| Aug. 6, 1998 | (JP) | 10-222987 |
| Feb. 17, 1999 | (JP) | 11-039280 |
| May 18, 1999 | (JP) | 11-137763 |
| May 18, 1999 | (JP) | 11-137764 |

(51) Int. Cl.
*H01J 9/00* (2006.01)

(52) U.S. Cl. ..... 445/23; 445/25

(58) Field of Classification Search ..... 445/23–25; 313/582–587

See application file for complete search history.

(56) References Cited

U.S. PATENT DOCUMENTS

| | | | |
|---|---|---|---|
| 3,837,724 | A | 9/1974 | Haberland et al. |
| 3,944,868 | A | 3/1976 | Kupsky |
| 4,018,490 | A | 4/1977 | Berkenblit et al. |
| 5,846,110 | A | 12/1998 | Kanagu et al. |
| 6,411,032 | B1 | 6/2002 | Shiiki et al. |

FOREIGN PATENT DOCUMENTS

| | | |
|---|---|---|
| EP | 554172 A1 | 4/1993 |
| EP | 554172 B1 | 4/1998 |

(Continued)

*Primary Examiner*—Joseph Williams

(57) ABSTRACT

A PDP with superior light-emitting characteristics and color reproduction is achieved by setting the chromaticity coordinate y (the CIE color specification) of light to 0.08 or less, more preferably to 0.07 or less, or 0.06 or less, enabling the color temperature of light to be set to 7,000K or more, and further to 8,000K or more, 9,000K or more, or 10,000K or more. The PDP is manufactured by a method in which the processes for heating the fluorescent substances such as the fluorescent substance baking, sealing material temporary baking, bonding, and exhausting processes are performed in the dry gas atmosphere, or in an atmosphere in which a dry gas is circulated at a pressure lower than the atmospheric pressure. This PDP is also manufactured by: a method in which after the front and back panels are bonded together, the exhausting process for exhausting gas from the inner space between panels is started while the panels are not cooled to room temperature; or a method in which after the front and back panels are temporarily baked, the process for bonding the panels is started while the panels are not cooled to room temperature. This reduces the time and energy required for heating, resulting in reduction of manufacturing cost.

25 Claims, 29 Drawing Sheets

FOREIGN PATENT DOCUMENTS

| | | |
|---|---|---|
| JP | 52-10067 | 1/1977 |
| JP | 60-193229 | 10/1985 |
| JP | 218834 | 1/1990 |
| JP | 5-234512 | 9/1993 |
| JP | 5342991 | 12/1994 |
| JP | 07-062339 | 3/1995 |
| JP | 07-169403 | 7/1995 |
| JP | 08115673 | 5/1996 |
| JP | 09-017343 | 1/1997 |
| JP | 09137158 | 5/1997 |
| JP | 09251839 A | 9/1997 |
| JP | 10-027552 | 1/1998 |
| JP | 10-121041 | 5/1998 |
| JP | 11-045662 | 2/1999 |
| JP | 11-297212 | 10/1999 |

(c)

PLASMA DISPLAY PANEL WITH SUPERIOR LIGHT-EMITTING CHARACTERISTICS, AND METHOD AND APPARATUS FOR PRODUCING THE PLASMA DISPLAY PANEL

RELATED APPLICATION

This application is a divisional application of U.S. Ser. No. 09/719,134 filed on Dec. 7, 2000 which is a 371 of PCT Application No. PCT/JP99/03189, filed Jun. 15, 1999.

FIELD OF THE INVENTION

This invention relates to a plasma display panel used as a display for a color television receiver or the like, and also relates to a method of producing the plasma display panel.

BACKGROUND OF THE INVENTION

Recently, Plasma Display Panel (PDP) has received attention as a large-scale, thin, lightweight display for use in computers and televisions, and the demand for high-definition PDPs has also increased.

Document EP0554172A1 discloses a conventional, typical technique related to a construction and production method of PDP.

FIG. 29 is a sectional view showing a general AC-type PDP.

In the drawing, a front glass substrate 101 is covered by a stack of display electrodes 102, a dielectric glass layer 103, and a dielectric protecting layer 104 in the order, where the dielectric protecting layer 104 is made of magnesium oxide (MgO) (see, for example, Japanese Laid-Open Patent Application No.5-342991.

Address electrodes 106 and partition walls 107 are formed on a back glass substrate 105. Fluorescent substance layers 110 to 112 of respective colors (red, green, and blue) are formed in space between the partition walls 107.

The front glass substrate 101 is laid on the partition walls 107 on the back glass substrate 105 to form space. A discharge gas is charged into the space to form discharge spaces 109.

In the above PDP with such a construction, vacuum ultraviolet rays (their wavelength is mainly at 147 nm) are emitted as electric discharges occur in the discharge spaces 109. The fluorescent substance layers 110 to 112 of each color are excited by the emitted vacuum ultraviolet rays, resulting in color display.

The above PDP is manufactured in accordance with the following procedures.

The display electrodes 102 are produced by applying silver paste to the surface of the front glass substrate 101, and baking the applied silver paste. The dielectric glass layer 103 is formed by applying a dielectric glass paste to the surface of the layers, and baking the applied dielectric glass paste. The protecting layer 104 is then formed on the dielectric glass layer 103.

The address electrodes 22 are produced by applying silver paste to the surface of the back glass substrate 105, and baking the applied silver paste. The partition walls 107 are formed by applying the glass paste to the surface of the layers in stripes with a certain pitch, and baking the applied glass paste. The fluorescent substance layers 110 to 112 are formed by applying fluorescent substance pastes of each color to the space between the partition walls, and baking the applied pastes at around 500° C. to remove resin and other elements from the pastes. Japanese Laid-Open Patent Application No. 2-08834 discloses a technique for forming a fluorescent substance film by applying a fluorescent substance slurry then drying the applied slurry by high-temperature dry air.

After the fluorescent substances are baked, a sealing glass frit is applied to an outer region of the back glass substrate 105, then the applied sealing glass frit is baked at around 350° C. to remove resin and other elements from the applied sealing glass frit. (Frit Temporary Baking Process) The front glass substrate 101 and the back glass substrate 105 are then put together so that the display electrodes 102 are perpendicular to the address electrodes 106, the electrodes 102 facing the electrodes 106. The substrates are then bonded by heating them to a temperature (around 450° C.) higher than the softening point of the sealing glass. (Bonding Process)

The bonded panel is heated to around 350° C. while gases are exhausted from inner space between the substrates (space formed between the front and back substrates, where the fluorescent substances are in contact with the space) (Exhausting Process). After the exhausting process is completed, the discharge gas is supplied to the inner space to a certain pressure (typically, in a range of 300 Torr to 500 Torr).

A problem of the PDP manufactured as above is how to improve the luminance and other light-emitting characteristics.

To solve the problem, the fluorescent substances themselves have been improved. However, it is desired that the light-emitting characteristics of PDPs are further improved.

A number of PDPs are increasingly manufactured using the above-described manufacturing method. However, the production cost of PDPs is considerably higher than that of CRTs. As a result, another problem of the PDP is to reduce the production cost.

One of many possible solutions to reduce the cost is to reduce efforts taken (time required for work) and the energy consumed in several processes that require heating processes.

DISCLOSURE OF THE INVENTION

It is therefore an object of the present invention to provide a PDP which has high light-emitting efficiency and superior color reproduction. It is another object of the present invention to provide a PDP production method in which the temporary baking, bonding, and exhausting processes are performed in shorter work time, with lower energy consumption so that the production cost is reduced.

The above first object is achieved by improving the chromaticity of light emitted from flue fluorescent substance layers. This is achieved by setting the chromaticity coordinate y (the CIE color specification) of light to 0.07 or less or the peak wavelength of a spectrum of light to 453 mm or less when vacuum ultraviolet rays are radiated onto the blue cells to excite the blue fluorescent substances.

Such an improvement in the chromaticity of light emitted from blue fluorescent substance layers as described above increases the color temperature of light (white balance) when the light is emitted from all the cells, and improves the color reproduction.

The above PDP having a superior chromaticity of light emitted from blue fluorescent substance layers is produced by performing the bonding process while steam vapor is forced to exhaust from the inner space by, for example, circulating a dry gas in the inner space.

The above PDP is also produced by performing a preparative heating step before the bonding process, where in the preparative heating step, a front panel and a back panel are heated in an atmosphere of dry gas while a space is opened between the sides of the panels facing each other. Alternatively, the above PDP is produced by performing a heating step before the bonding process, where in the bonding process, where in the heating step, a panel is heated while an MgO layer formed on the panel is in contact with a dry gas.

The above improvement is achieved by the production method of the present invention since it prevents blue fluorescent substances from being degraded by heat by reducing the amount of water preserved in the inner space. In contrast, in a conventional PDP production method, the flue fluorescent substances are degraded by heat of water emitted in the inner space in the bonding process, resulting in degradation of the light-emitting intensity and the chromaticity of emitted light.

The above PDP whose blue fluorescent substance layers emit light with a superior chromaticity is also produced by performing the bonding process, after a while, heating the bonded panels to a certain temperature while circulating a dry gas in the inner space, and starting an exhausting step.

With the above construction, even if the chromaticity of light emitted from the blue fluorescent substance layers is degraded by heat of the water in the bonding process, the chromaticity is recovered since the water is removed from the inner space as the dry gas is circulated in the inner space while the bonded panels are heated to the certain temperature.

Here, the "dry gas" indicates a gas containing steam vapor with lower partial pressure than the typical partial pressure. It is preferable to use an air processed to be dried (dry air).

It is desirable that the partial pressure of the steam vapor in the dry gas atmosphere is set to 15 Torr or less, more preferably to 10 Torr or less, 5 Torr or less, 1 Torr or less, 0.1 Torr or less. It is desirable that the dew-point temperature of the dry gas is set to 20° C. or lower, more preferably to 10° C. or lower, 0° C. or lower, −20° C. or lower, −40° C. or lower.

The above PDP with improved chromaticity of light emitted from blue fluorescent substance layers is manufactured by a PDP production method in which the processes for heating the fluorescent substances (e.g., the fluorescent substance baking process, sealing material temporary baking process, bonding process, and exhausting process) are performed in the dry gas atmosphere, or in an atmosphere in which a dry gas is circulated at a pressure lower than the atmospheric pressure.

The inventors of the present invention found in the manufacturing procedure in accordance with conventional PDP production methods that the blue fluorescent substances are degraded by heat when the fluorescent substances are heated in the processes and that the degradation leads to reduction in the light-emitting intensity and the chromaticity of emitted light. The inventors have provided the above PDP production method of the present invention and made it possible to prevent blue fluorescent substances from being degraded by heat.

Here, the "dry gas" indicates a gas containing steam vapor with lower partial pressure than the typical partial pressure. It is preferable to use an air processed to be dried (dry air).

It is desirable that the partial pressure of the steam vapor in the dry gas atmosphere is set to 15 Torr or less, more preferably to 10 Torr or less, 5 Torr or less, 1 Torr or less, 0.1 Torr or less. It is desirable that the dew-point temperature of the dry gas is set to 20° C. or lower, more preferably to 10° C. or lower, 0° C. or lower, −20° C. or lower, −40° C. or lower.

The above PDP with improved chromaticity of light emitted from blue fluorescent substance layers is also manufactured by a PDP production method in which: the front and back panels are temporarily baked while a space is opened between their facing sides; the front and back panels are bonded while a dry gas is circulated in an inner space between the panels; or the front and back panels are bonded together after preparatively heated while a space is opened between their facing sides.

Both of the first and second objects of the present invention are achieved by: a method in which after the front panel and the back panel are bonded together by a sealing material in between by maintaining a bonding temperature, the exhausting process is started while the panels are not cooled from the bonding temperature to room temperature, and gases are exhausted from the inner space between the panels; or a method in which after the front panel and the back panel with a sealing material in between are temporarily baked by maintaining a temporary bonding temperature, then the bonding process is started while the panels are not cooled from the temporary bonding temperature to room temperature.

In the actual manufacturing procedure, each of such heating processes is performed using a heating furnace. Conventionally, the sealing material temporary baking process, the bonding process, and the exhausting process are separately performed, and the panels are cooled to room temperature at each interval between processes. With such a construction, it requires a long time and consumes much energy for the panels to be heated in each process. In contrast, in the present invention, these processes are performed without lowering the temperature to room temperature. This reduces the time and energy required for heating.

DESCRIPTION OF THE PREFERRED EMBODIMENTS

<Embodiment 1>

Figure 1:
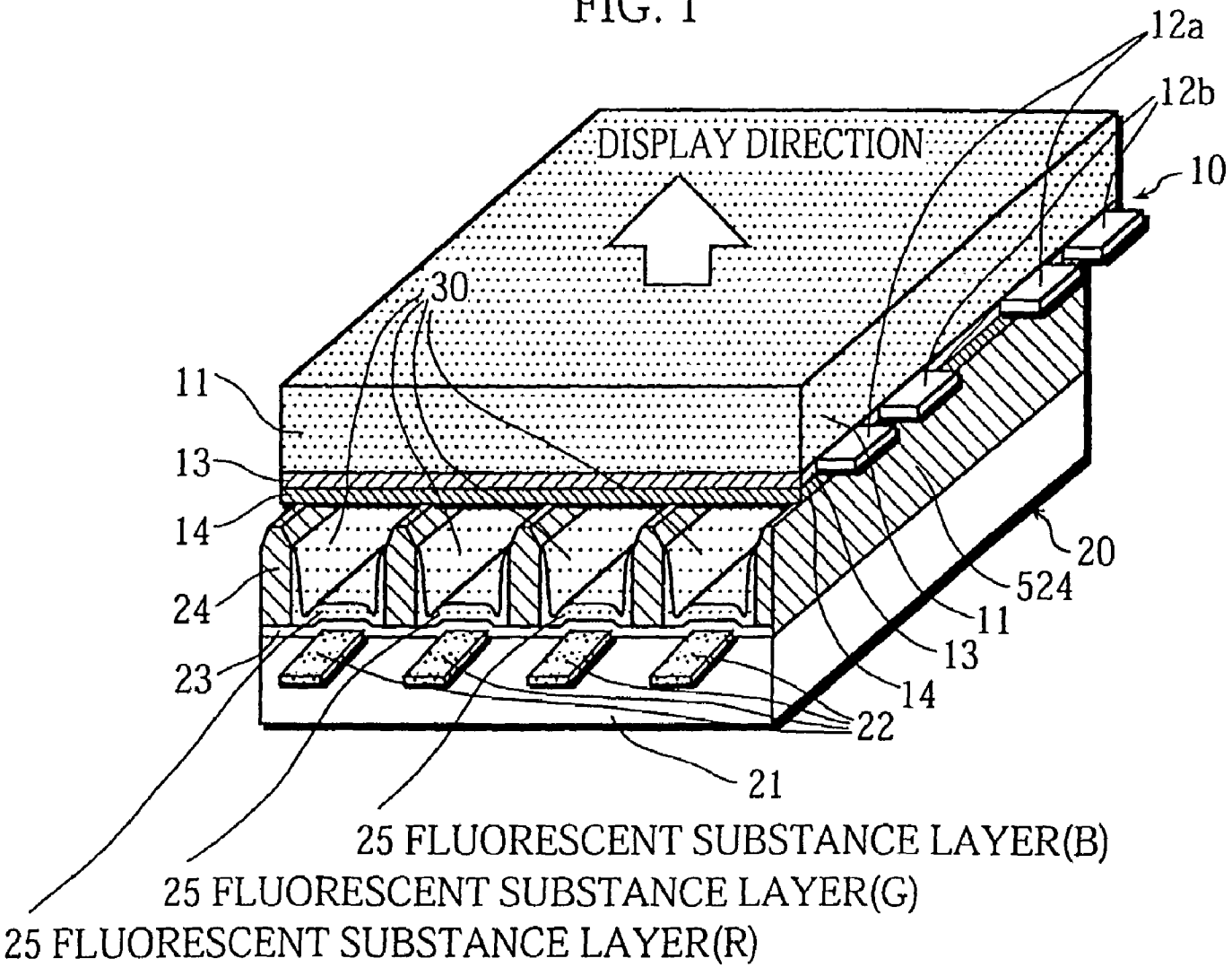
FIG. 1 is a sectional view of the main part of the AC-type discharge PDP of Embodiment 1.

FIG. 1 is a sectional view of the main part of the AC-type discharge PDP in the present embodiment. The figure shows a display area located at the center of the PDP.

The PDP includes: a front panel 10 which is made up of a front glass substrate 11 with display electrodes 12 (divided into scanning electrodes 12*a* and sustaining electrodes 12*b*), a dielectric layer 13, and a protecting layer 14 formed thereon; and a back panel 20 which is made up of a back glass substrate 21 with address electrodes 22 and a dielectric layer 23 formed thereon. The front panel 10 and the back panel 20 are arranged so that the display electrodes 12 and the address electrodes 22 face each other. The space between the front panel 10 and the back panel 20 is divided into a plurality of discharge spaces 30 by partition walls 24 formed in stripes. Each discharge space is filled with a discharge gas.

Fluorescent substance layers 25 are formed on the back panel 20 so that each discharge space 30 has a fluorescent substance layer of one color out of red, green, and blue and that the fluorescent substance layers are repeatedly arranged in the order of the colors.

In the panel, the display electrodes 12 and address electrodes 22 are respectively formed in stripes, the display electrodes 12 being perpendicular to the partition walls 24, and the address electrodes 22 being parallel to the partition walls 24. A cell having one color out of red, green, and blue is formed at each intersection of a display electrode 12 and an address electrode 22.

The address electrodes 22 are made of metal (e.g., silver or Cr—Cu—Cr). To keep the resistance of the display electrodes low and to secure a large discharge area in the cells, it is desirable that each display electrode 12 consists of a plurality of bus electrodes (made of silver or Cr—Cu—Cr) with a small width stacked on a transparent electrode with a large width made of a conductive metal oxide such as ITO, $SnO_2$, and ZnO. However, the display electrodes 12 may be made of silver like the address electrodes 22.

The dielectric layer 13, being a layer composed of a dielectric material, covers the entire surface of one side of the front glass substrate 11 including the display electrodes 12. The dielectric layer is typically made of a lead low-melting-point glass, though it may be made of a bismuth low-melting-point glass or a stack of a lead low-melting-point glass and a bismuth low-melting-point glass.

The protecting layer 14, being made of magnesium oxide, is a thin layer covering the entire surface of the dielectric layer 13.

The dielectric layer 23 is similar to the dielectric layer 13, but is further mixed with $TiO_2$ grains so that the layer also functions as a visible-light reflecting layer.

The partition walls 24, being made of glass, are formed to project over the surface of the dielectric layer 23 of the back panel 20.

The following are the fluorescent substances used in the present embodiment:

blue fluorescent substance $BaMgAl_{10}O_{17}$: Eu green fluorescent substance $Zn_2SiO_4$: Mn red fluorescent substance $Y_2O_3$: Eu.

The composition of these fluorescent substances is basically the same as that of conventional materials used in PDP. However, compared with the conventional ones, the fluorescent substances of the present embodiment emit more excellently colored light. This is because the fluorescent substances are degraded by the heat added in the manufacturing process. Here, the emission of the excellently colored light means that the chromaticity coordinate y of the light emitted from blue cells is small (i.e., the peak wavelength of the emitted blue light is short), and that the color reproduction range near the blue color is wide.

In typical, conventional PDPs, the chromaticity coordinate y (CIE color specification) of the light emitted from blue cells when only blue cells emit light is 0.085 or more (i.e., the peak wavelength of the spectrum of the emitted light is 456 nm or more), and the color temperature in the white balance without color correction (a color temperature when light is emitted from all of the blue, red, and green cells to produce a white display) is about 6,000K.

As a technique for improving the color temperature in the white balance, a technique is known in which the width of only the blue cells (pitch of the partition walls) is set to a large value, and the area of the blue cells is set to a value larger than that of the red or green cells. However, to set the color temperature to 7,000K or higher in accordance with this technique, the area of the blue cells should be 1.3 times that of the red or green cells, or more.

In contrast, In the PDP of the present embodiment, the chromaticity coordinate y of the light emitted from blue cells when only blue cells emit light is 0.08 or less, and the peak wavelength of the spectrum of the emitted light is 455 nm or less. Under these conditions, it is possible to increase the color temperature to 7,000K or more in the white balance without color correction. Also, depending on the conditions at the manufacturing process, it is possible to decrease the chromaticity coordinate y even further, or increase the color temperature to 10,000K or more in the white balance without color correction.

As stated above, as the chromaticity coordinate y of blue cells becomes small, the peak wavelength of the emitted blue light becomes short. This will be explained later in Embodiments 3 and 5.

Later embodiments will also explain: why the color reproduction area becomes large as the chromaticity coordinate y of blue cells becomes small; and how the chromaticity coordinate y of the light emitted from blue cells is related to the color temperature in the white balance without color correction.

In the present embodiment, on the assumption that the present PDP is used for a 40-inch high definition TV, the thickness of the dielectric layer 13 is set to around 20 μm, and the thickness of the protecting layer 14 to around 0.5 μm. Also, the height of the partition walls 24 is set to 0.1 mm to 0.15 mm, the pitch of the partition walls to 0.15 mm to 0.3 mm, and the thickness of the fluorescent substance layers 25 to 5 μm to 50 μm. The discharge gas is Ne—Xe gas in which Xe constitutes 50% in volume. The charging pressure is set to 500 Torr to 800 Torr.

Figure 2:
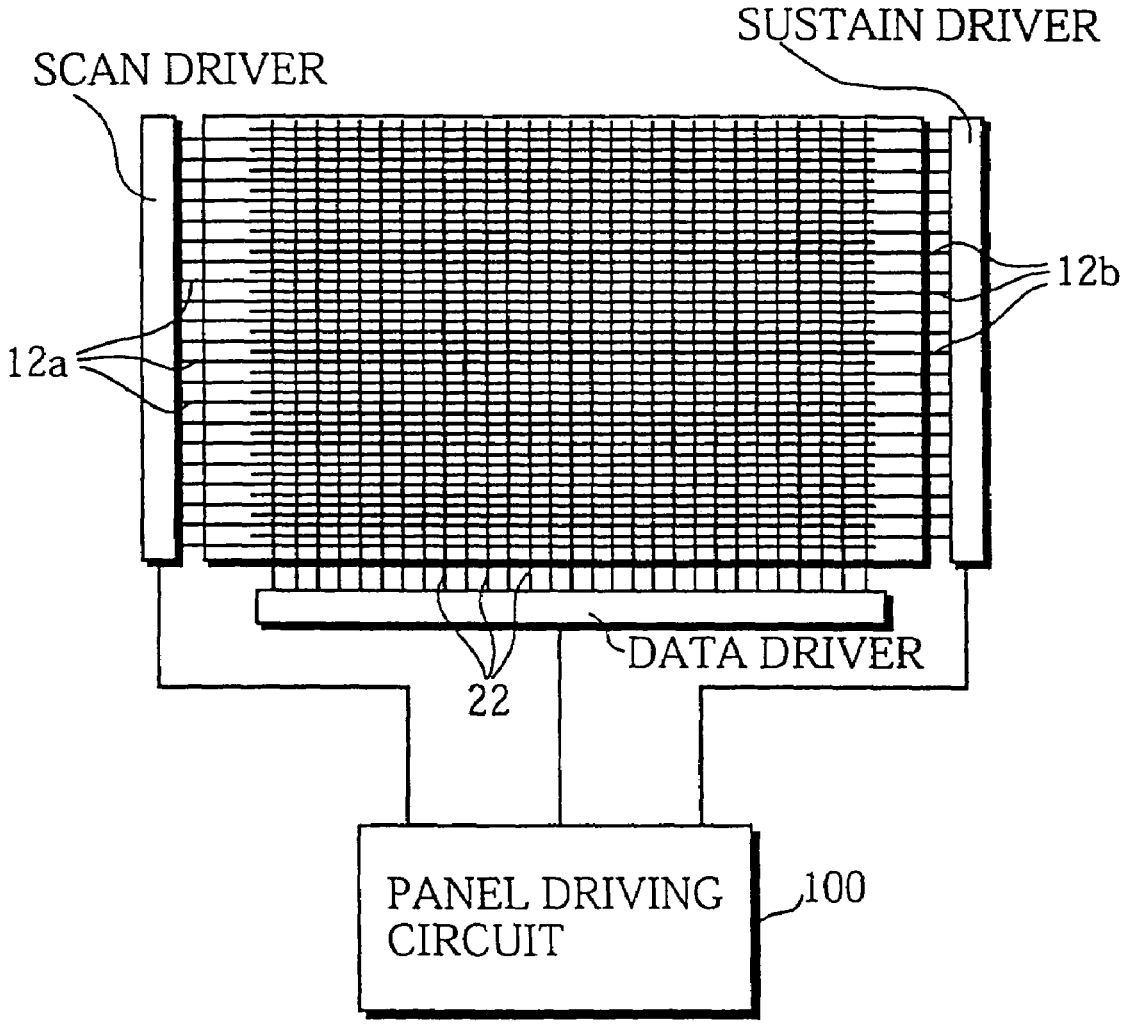
FIG. 2 shows a PDP display apparatus composed of the PDP shown in FIG. 1 and an activating circuit connected to the PDP.

The PDP is activated by the following procedure. As shown in FIG. 2, a panel activating-circuit 100 is connected to the PDP. An address discharge is produced by applying a certain voltage to an area between the display electrodes 12*a* and the address electrodes 22 of the cells to illuminate. A sustaining discharge is then produced by applying a pulse voltage to an area between the display electrodes 12*a* and 12*b*. The cells emit ultraviolet rays as the discharge proceeds. The emitted ultraviolet rays are converted to visible light by the fluorescent substance layers 31. Images are displayed on the PDP as the cells illuminate through the above-described procedure.

Procedure of Producing PDP

The following are description of the procedure by which the PDP with the above construction is produced.

Producing the Front Panel

The front panel 10 is produced by forming the display electrodes 12 on the front glass substrate 11, covering it with the dielectric layer 13, then forming the protecting layer 14 on the surface of dielectric layer 13.

The display electrodes 12 are produced by applying silver pastes to the surface of the front glass substrate 11 with the screen printing method, then baking the applied silver pastes. The dielectric layer 13 is formed by applying a lead glass material (e.g., a mixed material of 70% by weight of lead oxide (PbO), 15% by weight of boron oxide ($B_2O_3$), and 15% by weight of silicon oxide ($SiO_2$)), then baking the applied material. The protecting layer 14 consisting of magnesium oxide (MgO) is formed on the dielectric layer 13 with the vacuum vapor deposition method or the like.

Producing the Back Panel

The back panel 20 is produced by forming the address electrodes 22 on the back glass substrate 21, covering it with the dielectric layer 23 (visible-light reflecting layer), then forming the partition walls 30 on the surface of the dielectric layer 23.

The address electrodes 22 are produced by applying silver pastes to the surface of the back glass substrate 21 with the screen printing method, then baking the applied silver pastes. The dielectric layer 23 is formed by applying pastes including $TiO_2$ grains and dielectric glass grains to the surface of the address electrodes 22, then baking the applied pastes. The partition walls 30 are formed by repeatedly applying pastes including glass grains with a certain pitch with the screen printing method, then baking the applied pastes.

After the back panel 20 is made, the fluorescent substance pastes of red, green, and blue are made and applied to the space between the partition walls with the screen printing method. The fluorescent substance layers 25 are formed by baking the applied pastes in air as will be described later.

The fluorescent substance pastes of each color are produced by the following procedure.

The blue fluorescent substance ($BaMgAl_{10}O_{17}$: Eu) is obtained through the following steps. First, the materials, barium carbonate ($BaCO_3$), magnesium carbonate ($MgCO_3$), and aluminum oxide ($\alpha$-$Al_2O_3$), are formulated into a mixture so that the ratio Ba:Mg:Al is 1:1:10 in the atoms. Next, a certain amount of europium oxide ($Eu_2O_3$) is added to the above mixture. Then, a proper amount of flax ($AlF_2$, $BaCl_2$) is mixed with this mixture in a ball mill. The obtained mixture is baked in a reducing atmosphere ($H_2$, $N_2$) at 1400° C. to 1650° C. for a certain time period (e.g., 0.5 hours).

The red fluorescent substance ($Y_2O_3$: Eu) is obtained through the following steps. First, a certain amount of europium oxide ($Eu_2O_3$) is added to yttrium hydroxide $Y_2(OH)_3$. Then, a proper amount of flax is mixed with this mixture in a ball mill. The obtained mixture is baked in air at 1200° C. to 1450° C. for a certain time period (e.g., one hour).

The green fluorescent substance ($Zn_2SiO_4$: Mn) is obtained through the following steps. First, the materials, zinc oxide (ZnO) and silicon oxide ($SiO_2$), are formulated into a mixture so that the ratio Zn:Si is 2:1 in the atoms. Next, a certain amount of manganese oxide ($Mn_{2O3}$) is added to the above mixture. Then, a proper amount of flax is mixed with this mixture in a ball mill. The obtained mixture is baked in air at 1200° C. to 1350° C. for a certain time period (e.g., 0.5 hours).

The fluorescent substances of each color produced as above are then crushed and sifted so that the grains for each color having a certain particle size distribution are obtained. The fluorescent substance pastes for each color are obtained by mixing the grains with a binder and a solvent.

The fluorescent substance layers 25 can be formed with methods other than the screen printing. For example, the fluorescent substance layers may be formed by allowing a moving nozzle to eject a fluorescent substance ink, or by making a sheet of photosensitive resin including a fluorescent substance, attaching the sheet to the surface of the back glass substrate 21 on a side including partition walls 24, performing a photolithography patterning then developing the attached sheet to remove unnecessary parts of the attached sheet.

Bonding Front Panel and Back Panel, Vacuum Exhausting, and Charging Discharge Gas Sealing glass layers are formed by applying a sealing glass frit to one or both of the front panel 10 and the back panel 20 which have been produced as above. The sealing glass layers are temporarily baked to remove resin and other elements from the glass frit, which will be detailed later. The front panel 10 and the back panel 20 are then put together with the display electrodes 12 and the address electrodes 22 facing each other and being perpendicular to each other. The front panel 10 and the back panel 20 are then heated so that they are bonded together with the softened sealing glass layers. This will be detailed later.

The bonded panels are baked (for three hours at 350° C.) while air is exhausted from the space between the bonded panels to produce a vacuum. The PDP is then completed after the discharge gas with the above composition is charged into the space between the bonded panels at a certain pressure.

Details of Baking Fluorescent Substance, Temporarily Baking Sealing Glass Frit, and Bonding Front Panel and Back Panel The processes of baking the fluorescent substances, temporarily baking the sealing glass frit, and bonding the front panel and back panel will be described in detail.

Figure 3:
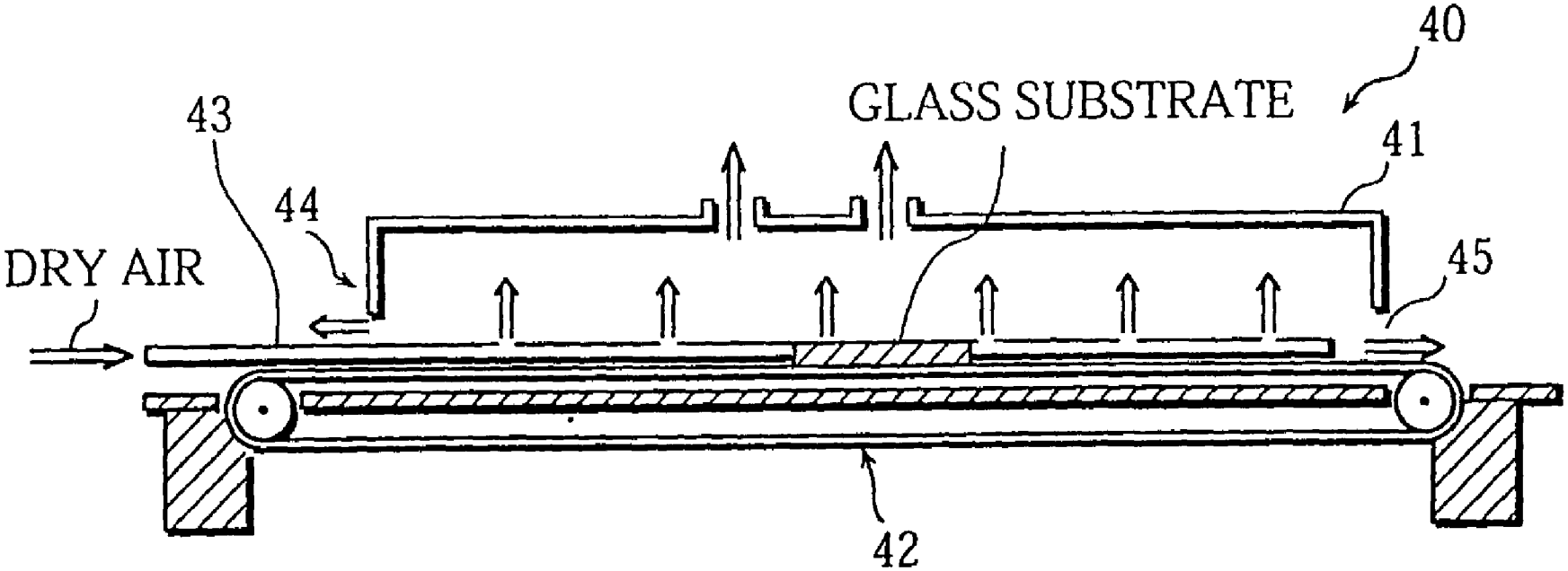
FIG. 3 shows a belt-conveyor-type heating apparatus used in Embodiment 1.

FIG. 3 shows a belt-conveyor-type heating apparatus which is used to bake the fluorescent substances and temporarily bake the frit.

The heating apparatus 40 includes a heating furnace 41 for heating the substrates, a carrier belt 42 for carrying the substrates inside the heating furnace 41, and a gas guiding pipe 43 for guiding an atmospheric gas into the heating furnace 41. The heating furnace 41 inside is provided with a plurality of heaters (not shown in the drawings) along the heating belt.

The substrates are heated with an arbitrary temperature profile by adjusting the temperatures near the plurality of heaters placed along the belt between an entrance 44 and an exit 45. Also, the heating furnace can be filled with the atmospheric gas injected through the gas-guiding pipe 43.

Dry air can be used as the atmospheric gas. The dry air is produced by: allowing air to pass through a gas dryer (not shown in the drawing) which cools the air to a low temperature (minus tens ° C.); and condensing the steam vapor in the cooled air. The amount (partial pressure) of the steam vapor in the cooled air is reduced through this process and a dry air is finally obtained.

To bake the fluorescent substances, the back glass substrate 21 with the fluorescent substance layers 25 formed thereon is baked in the heating apparatus 40 in the dry air (at the peak temperature 520° C. for 10 minutes). As apparent from the above description, the degradation caused by the heat and the steam vapor in the atmosphere during the process of baking the fluorescent substances is reduced by baking the fluorescent substances in a dry gas.

The lower the partial pressure of the steam vapor in the dry air is, the greater the effect on reducing the degradation of the fluorescent substances by heat is. As a result, it is desirable that the partial pressure of the steam vapor is 15 Torr or less. The above effect becomes more remarkable as the partial pressure of the steam vapor is set to a lower value like 10 Torr or less, 5 Torr or less, 1 Torr or less, 0.1 Torr or less.

There is a certain relationship between the partial pressure of the steam vapor and the dew-point temperature. As a result, the above description can be rewritten by replacing the partial pressure of the steam vapor with the dew-point temperature. That is, the lower the dew-point temperature is set to, the greater the effect on reducing the degradation of the fluorescent substances by heat is. It is therefore desirable that the dew-point temperature of the dry gas is set to 20° C. or lower. The above effect becomes more remarkable as the dew-point temperature of the dry gas is set to a lower value like 0° C. or lower, −20° C. or lower, −40° C. or lower.

To temporarily bake the sealing glass frit, the front glass substrate 11 or the back glass substrate 21 with the sealing glass layers formed thereon is baked in the heating apparatus 40 in the dry air (at the peak temperature 350° C. for 30 minutes).

In this temporary baking process, as in the baking process, it is desirable that the partial pressure of the steam vapor is 15 Torr or less. Also, the effect is more remarkable as the partial pressure of the steam vapor is set to a lower value like 10 Torr or less, 5 Torr or less, 1 Torr or less, 0.1 Torr or less. In other words, it is desirable that the dew-point temperature of the dry gas is set to 20° C. or lower, and even more desirable for the temperature to be set to a lower value like 0° C. or lower, −20° C. or lower, −40° C. or lower.

Figure 4:
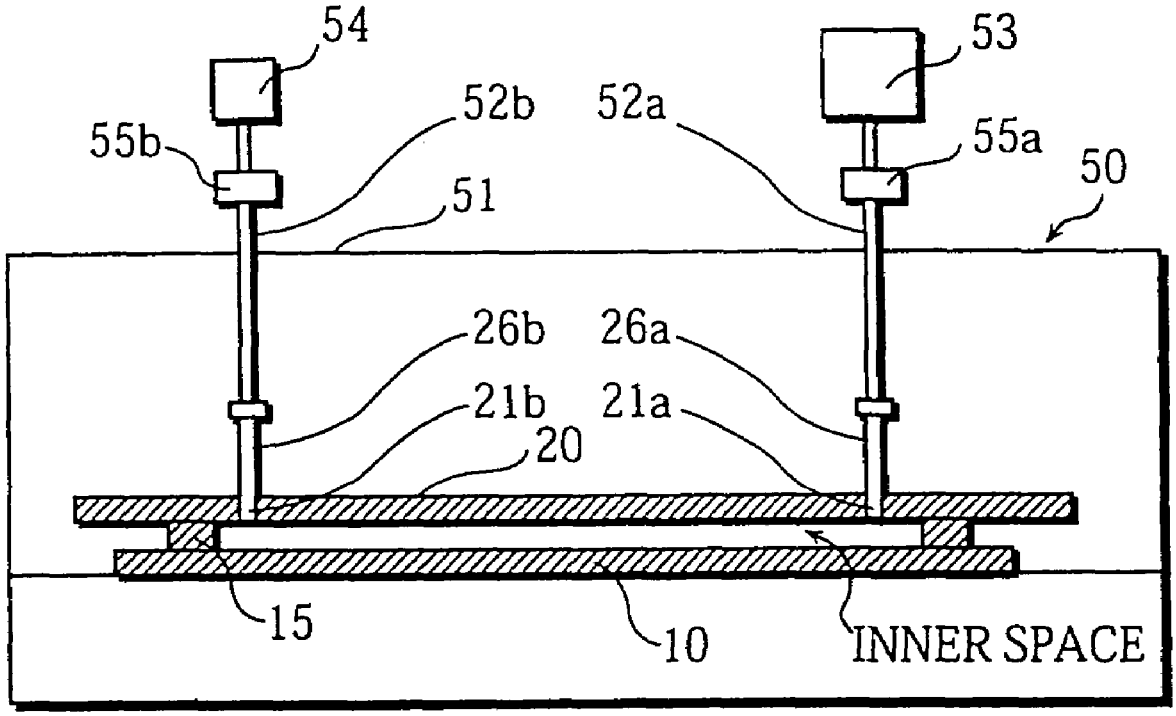
FIG. 4 shows the construction of a heating-for-sealing apparatus used in Embodiment 1.

FIG. 4 shows the construction of a heating-for-sealing apparatus.

A heating-for-sealing apparatus 50 includes a heating furnace 51 for heating the substrates (in the present embodiment, the front panel 10 and the back panel 20), a pipe 52*a* for guiding an atmospheric gas from outside of the heating furnace 51 into the space between the front panel 10 and the back panel 20, and a pipe 52*b* for letting out the atmospheric gas to the outside the heating furnace 51 from the space between the front panel 10 and the back panel 20. The pipe 52*a* is connected to a gas supply source 53 which supplies the dry air as the atmospheric gas. The pipe 52*b* is connected to a vacuum pump 54. Adjusting valves 55*a* and 55*b* are respectively attached to the pipes 52*a* and 52*b* to adjust the flow rate of the gas passing through the pipes.

The front panel and back panel are bonded together as described below using the heating-for-sealing apparatus 50 with the above construction.

The back panel is provided with air vents 21*a* and 21*b* at the outer regions which surround the display region. Glass pipes 26*a* and 26*b* are respectively attached to the air vents 21*a* and 21*b*. Please note that the partition walls and flourescent substances that should be on the back panel 20 are omitted in FIG. 4.

The front panel 10 and the back panel 20 are positioned properly with the sealing glass layers in between, then put into the heating furnace 51. In doing so, it is preferable that the positioned front panel 10 and the back panel 20 are tightened with clamps or the like to prevent shifts.

The air is exhausted from the space between the panels using the vacuum pump 54 to produce a vacuum there. The dry air is then sent to the space through the pipe 52*a* at a certain flow rate without using the vacuum pump 54. The dry air is exhausted from the pipe 52*b*. That means the dry air flows through the space between the panels.

The front panel 10 and the back panel 20 are then heated (at the peak temperature 450° C. for 30 minutes) while the dry air is flown through the space between the panels. In this process, the front panel 10 and the back panel 20 are bonded together with the softened sealing glass layers 15.

After the bonding is complete, one of the glass pipes 26*a* and 26*b* is plugged up, and the vacuum pump is connected to the other glass pipe. The heating-for-sealing apparatus is used in the vacuum exhausting process, the next process. In the discharge gas charging process, a cylinder containing the discharge gas is connected to the other glass pipe, and the discharge gas is charged into the space between the panels operating an exhausting apparatus.

Effects of the Method Shown in the Present Embodiment

The method shown in the present embodiment of boding the front and back panels has unique effects, which will be described below.

In general, gases like steam vapor are held by adsorption on the surface of the front panel and back panel. The adsorbed gases are released when the panels are heated.

In conventional methods, in the bonding process after the temporary baking process, the front panel and the back panel are first put together at room temperature, then they are heated to be bonded together. In the bonding process, the gases held by adsorption on the surface of the front panel and back panel are released. Though a certain amount of the gases are released in the temporary baking process, gases are newly held by adsorption when the panels are laid in the air to room temperature before the bonding process begins, and the gases are released in the bonding process. The released gases are confined in the small space between the panels. It is known by measurement that the partial pressure of the steam vapor in the space at this stage is typically 20 Torr or more.

When this happens, the flourescent substance layers 25 contacting the space are tend to be degraded by the heat and the gases confined in the space (among the gases, especially by the steam vapor released from the protecting layer 14). The degradation of the flourescent substance layers causes the light-emitting intensity of the layers to decrease (especially the blue flourescent substance layer).

On the other hand, according to the method shown in the present embodiment, the degradation is reduced since the dry air is flown through the space when the panels are heated and the steam vapor is exhausted from the space to the outside.

In this bonding process, like the flourescent substance baking process, it is desirable that the partial pressure of the steam vapor is 15 Torr or less. Also, the degradation of the flourescent substance is reduced more as the partial pressure of the steam vapor is set to a lower value like 10 Torr or less, 5 Torr or less, 1 Torr or less, 0.1 Torr or less. In other words, it is desirable that the dew-point temperature of the dry air is set to 20° C. or lower, and even more desirable for the temperature to be set to a lower value like 0° C. or lower, −20° C. or lower, −40° C. or lower.

Study of Partial Pressure of Steam Vapor in Atmospheric Gas

It was confirmed by the experiments that the degradation of the blue flourescent substance due to heating can be prevented by reducing the partial pressure of the steam vapor in the atmospheric gas.

Figure 5:
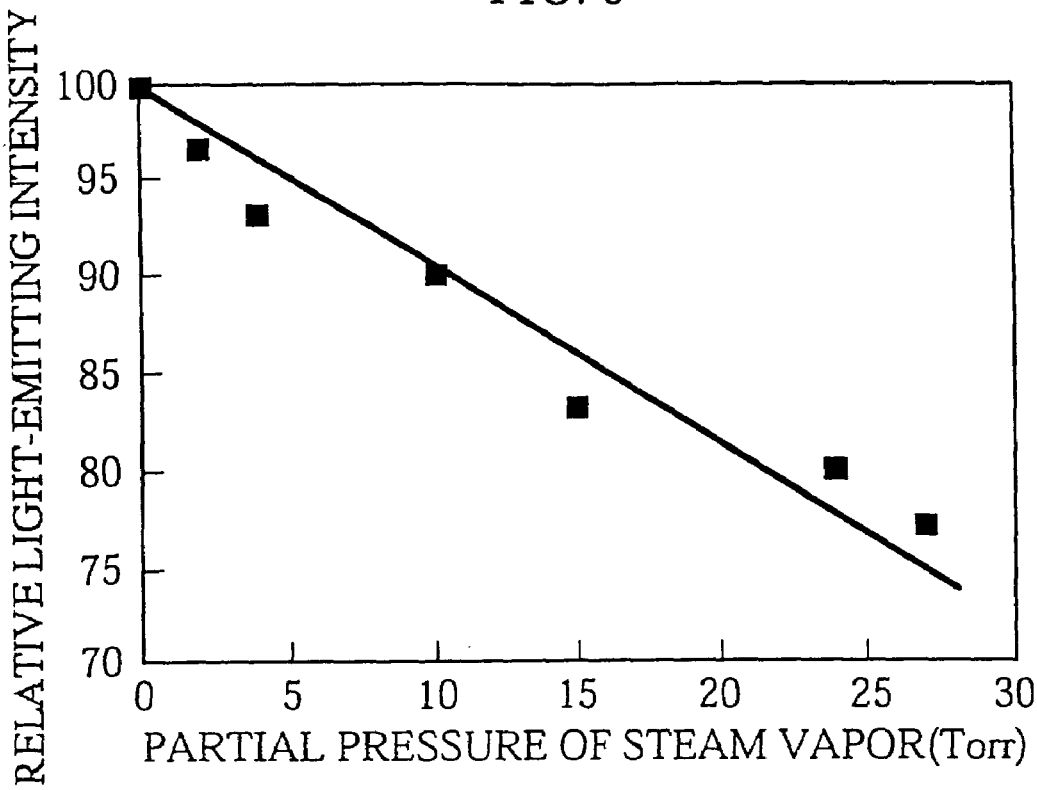
FIG. 5 shows measurement results of the relative light-emitting intensity of light emitted from the blue flourescent substance when it is baked in air with different partial pressures of the steam vapor contained in the air.
Figure 6:
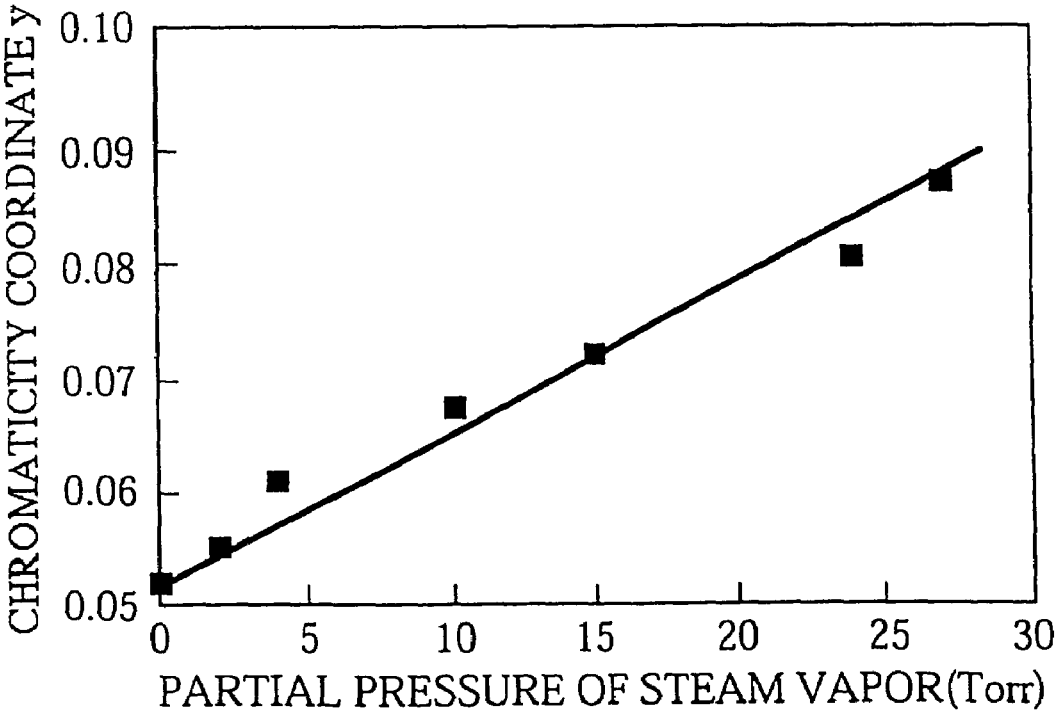
FIG. 6 shows measurement results of the chromaticity coordinate y of light emitted from the blue flourescent substance when it is baked in air with different partial pressures of the steam vapor contained in the air.

FIGS. 5 and 6 respectively show the relative light-emitting intensity and the chromaticity coordinate y of the light emitted from the blue flourescent substance ($BaMgAl_{10}O_{17}$: Eu). These values were measured after the blue flourescent substance was baked in the air by changing the partial pressure of the steam vapor variously. The blue flourescent substance was baked with the peak temperature 450° C. maintained for 20 minutes.

The relative light-emitting intensity values shown in FIG. 5 are relative values when the light-emitting intensity of the blue flourescent substance measured before it is baked is set to 100 as the standard value.

For obtaining the light-emitting intensity, first the emission spectrum of the flourescent substance layer is measured using a spectro-photometer, next the chromaticity coordinate y is calculated from the measured emission spectrum, then the light-emitting intensity is obtained from a formula (light-emitting intensity=luminance/chromaticity coordinate y) with the calculated chromaticity coordinate y and a luminance measured beforehand.

Note that the chromaticity coordinate y of the blue flourescent substance before it was baked was 0.052.

It is found from the results shown in FIGS. 5 and 6 that there is no reduction of light-emitting intensity by heat and that there is no change in the chromaticity when the partial pressure of the steam vapor is around 0 Torr. However, it is noted that as the partial pressure of the steam vapor increases, the relative light-emitting intensity of the blue flourescent substance decreases and the chromaticity coordinate y of the blue flourescent substance increases.

It has conventionally been thought that the light-emitting intensity reduces and the chromaticity coordinate y increases when the blue flourescent substance ($BaMgAl_{10}O_{17}$: Eu) because activating agent $Eu^{2+}$ ion is oxidized through heating and converted into $Eu^{3+}$ ion (S. Oshio, T. Matsuoka, S. Tanaka, and H. Kobayashi, Mechanism of Luminance Decrease in $BaMgAl_{10}O_{17}$: Eu2+ Phosphor by Oxidation, J. Electrochem. Soc., Vol. 145, No. 11, November 1988, pp.3903–3907). However, considering from the fact that the chromaticity coordinate y of the above blue flourescent substance depends on the partial pressure of the steam vapor in the atmosphere, it is thought that the $Eu^{2+}$ ion does not directly react with oxygen in the atmospheric gas (e.g., air), but that the steam vapor in the atmospheric gas accelerates the reaction related to the degradation.

For comparison, reduction of the light-emitting intensity and change in the chromaticity coordinate y of the blue flourescent substance ($BaMgAl_{10}O_{17}$: Eu) were measured for various heating temperatures. The measurement results show tendencies that reduction of the light-emitting intensity increases as the heating temperature becomes higher in the range of 300° C. to 600° C., and that reduction of the light-emitting intensity increases as the partial pressure of the steam vapor becomes higher in any heating temperatures. On the other hand, though the measurement results show the tendency that change in the chromaticity coordinate y increases as the partial pressure of the steam vapor becomes higher, the measurement results do not show the tendency that change in the chromaticity coordinate y depends on the heating temperature.

Also, the amount of steam vapor released when heated was measured for each material constituting the front glass substrate 11, display electrodes 12, dielectric layer 13, protecting layer 14, back glass substrate 21, address electrodes 22, dielectric layer 23 (visible-light reflecting layer), partition walls 24, and flourescent substance layers 25. According to the measurement results, MgO which is the material of the protecting layer 14 among others releases the largest amount of steam vapor. It is assumed from the results that the degradation of the flourescent substance layers 25 by heat during bonding layer is mainly caused by the steam vapor released from the protecting layer 14.

Variations of the Present Embodiment

In the present embodiment, a certain amount of dry air is flown into the inner space between the panels during the bonding process. However, exhausting air from the inner space to produce a vacuum and injection of dry air may be repeated alternately. By this operation, the steam vapor can effectively exhausted from the inner space and the degradation of the flourescent substance layer by heat can be reduced.

Also, all of the flourescent substance layer baking process, temporary baking process, and bonding process may not necessarily be performed in the atmospheric dry gas. It is possible to obtain the same effect by performing only one or two processes among these in the atmospheric dry gas.

In the present embodiment, dry air as the atmospheric gas is flown into the inner space between the panels during the bonding process. However, it is possible to obtain a certain effect by flowing an inert gas such as nitrogen which does not react with the flourescent substance layer and whose partial pressure of the steam vapor is low.

In the present embodiment, dry air is forcibly injected into the inner space between panels 10 and 20 through the glass pipe 26*a* in the bonding process. However, the panels 10 and 20 may be bonded together in the atmosphere of dry air using, for example, the heating apparatus 40 shown in FIG. 3. In this case, a certain effect is also obtained since a small amount of dry gas flows into the inner space through the air vents 21*a* and 21*b*.

Though not described in the present embodiment, the water held by adsorption on the surface of the protecting layer 14 decreases in amount when the front panel 10 with the protecting layer 14 formed on its surface is baked in the atmospheric dry gas. With this performance only, the degradation of the blue flourescent substance layer is restricted to a certain extent. It is expected that the effect further increases by combining this method of baking the front panel 10 with the manufacturing process of the present embodiment.

The PDP manufactured in accordance with the method of the present embodiment has an effect of decreasing abnormal discharge during PDP activation since the fluorescent substance layers contains a small amount of water.

EXAMPLE 1

<Table 1>

TABLE 1

PANEL CONSTRUCTION AND LIGHT-EMITTING CHARACTERISTICS

| | PARTIAL PRESSURE OF STEAM VAPOR IN ATMOSPHERIC GAS(Torr) | | | | COLOR | PEAK | PEAK NUMBER OF MOLECULES IN $H_2O$ GAS | AXIS LENGTH |
|---|---|---|---|---|---|---|---|---|
| PANEL No. | BAKING FLUORESCENT SUBSTANCE | TEMPORARILY BAKING SEALING GLASS FRIT | BONDING PANELS | PANEL LUMINANCE (cd/m$^2$) | TEMPERATURE WHEN LIGHT IS EMITTED FROM ALL CELLS ON PANEL (k) | INTENSITY RATIO OF SPECTRUM OF BLUE AND GREEN LIGHT (BLUE/GREEN) | DESORBED FROM BLUE FLUORESCENT SUBSTANCE AT 200° C. OR MORE WITH TDS ANALYSIS | RATIO OF BLUE FLUORESCENT SUBSTANCE CRYSTAL (c-AXIS/a-AXIS) |
| 1 | 12.0 | 12.0 | 12.0 | 495 | 7100 | 0.80 | $1.0 \times 10^{16}$ | 4.02180 |
| 2 | 8.0 | 8.0 | 8.0 | 520 | 7500 | 0.88 | $7.9 \times 10^{15}$ | 4.02177 |
| 3 | 3.0 | 3.0 | 3.0 | 540 | 8400 | 1.02 | $5.3 \times 10^{15}$ | 4.02172 |
| 4 | 0.0 | 0.0 | 0.0 | 550 | 9000 | 1.10 | $2.2 \times 10^{15}$ | 4.02164 |
| 5 | 20.0 | 20.0 | 20.0 | 470 | 6300 | 0.76 | $2.6 \times 10^{16}$ | 4.02208 |

In Table 1, the panels 1 to 4 are PDPs manufactured based on the present embodiment. The panels 1 to 4 have been manufactured in different partial pressures of the steam vapor in the dry air flown during the flourescent substance layer baking process, frit temporary baking process, and bonding process, the partial pressures of the steam vapor being in the range of 0 Torr to 12 Torr.

The panel 5 is a PDP manufactured for comparison. The panel 5 was manufactured in non-dry air (partial pressure of the steam vapor is 20 Torr) through the flourescent substance layer baking process, frit temporary baking process, and bonding process.

In each of the PDPs 1 to 5, the thickness of the flourescent substance layer is 30 μm, and the discharge gas, Ne(95%)-Xe(5%), was charged with the charging pressure 500 Torr.

Light Emitting Characteristics Test and the Results

For each of the panels (PDPs) 1 to 5, the panel luminance and the color temperature in the white balance without color correction (a panel luminance and a color temperature when light is emitted from all of the blue, red, and green cells to produce a white display), and the ratio of the peak intensity of the spectrum of light emitted from the blue cells to that of the green cells were measured as the light emitting characteristics.

The results of this test are shown in Table 1.

Each of the manufactured PDPs was disassembled and vacuum ultraviolet rays (central wavelength is 146 nm) were radiated onto the blue fluorescent substance layers of the back panel using a krypton excimer lamp. The color temperature when light was emitted from all of the blue, red, and green cells, and the ratio of the peak intensity of the spectrum of light emitted from the blue cells to that of the green cells were then measured. The results were the same as the above ones since no color filter or the like was used in the manufactured front panel.

The blue fluorescent substances were then taken out from the panel. The number of molecules contained in one gram of $H_2O$ gas desorbed from the blue fluorescent substances was measured using the TDS (Thermal Desorption) analysis method. Also, the ratio of c-axis length to a-axis length of the blue fluorescent substance crystal was measured by the X-ray analysis.

The above measurement was carried out as follows using an infrared-heating type TDS analysis apparatus made by ULVAC JAPAN Ltd.

Figure 7A:
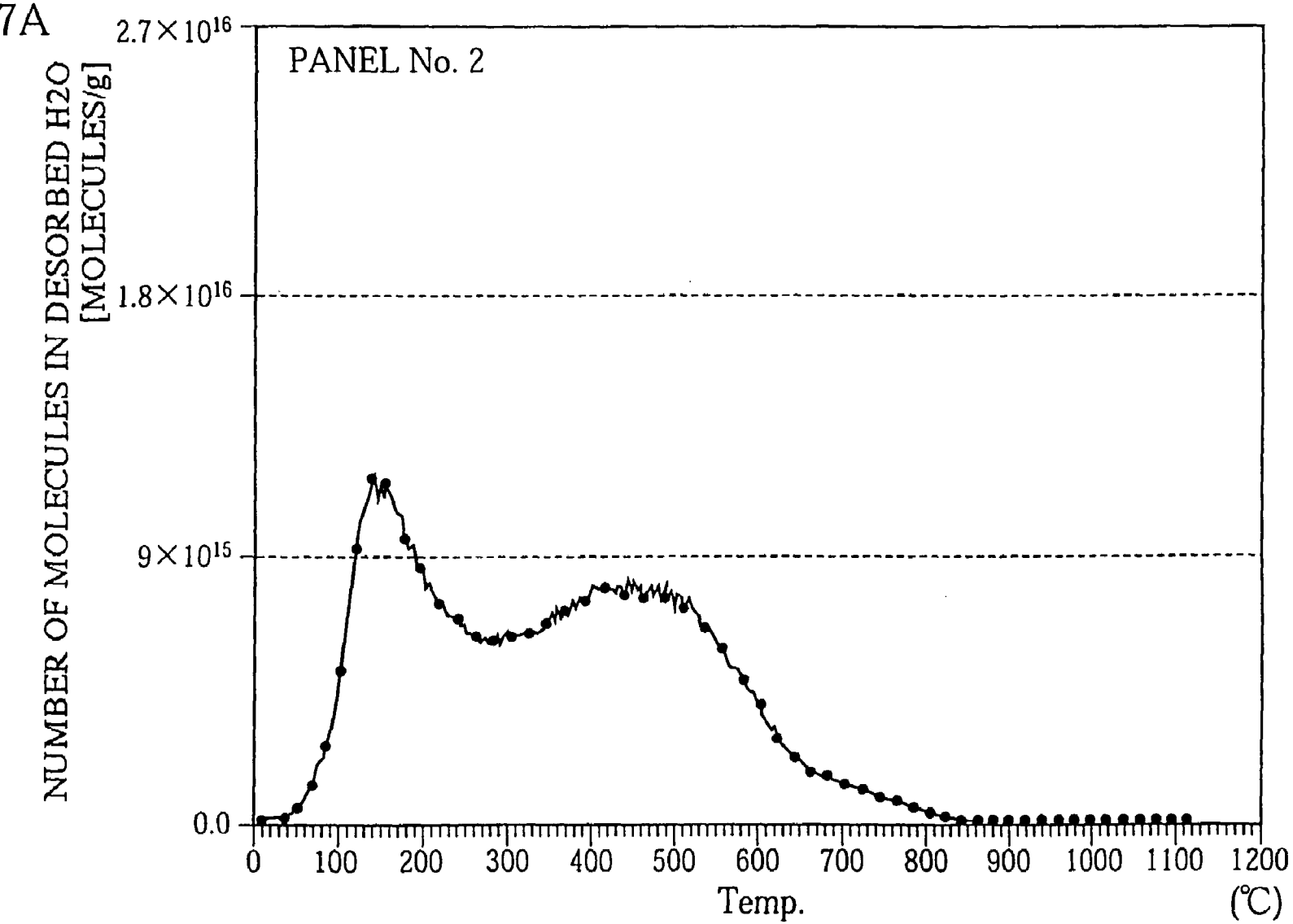
FIGS. 7A to 7C show measurement results of the number of molecules in $H_2O$ gas desorbed from the blue fluorescent substance.
Figure 7B:
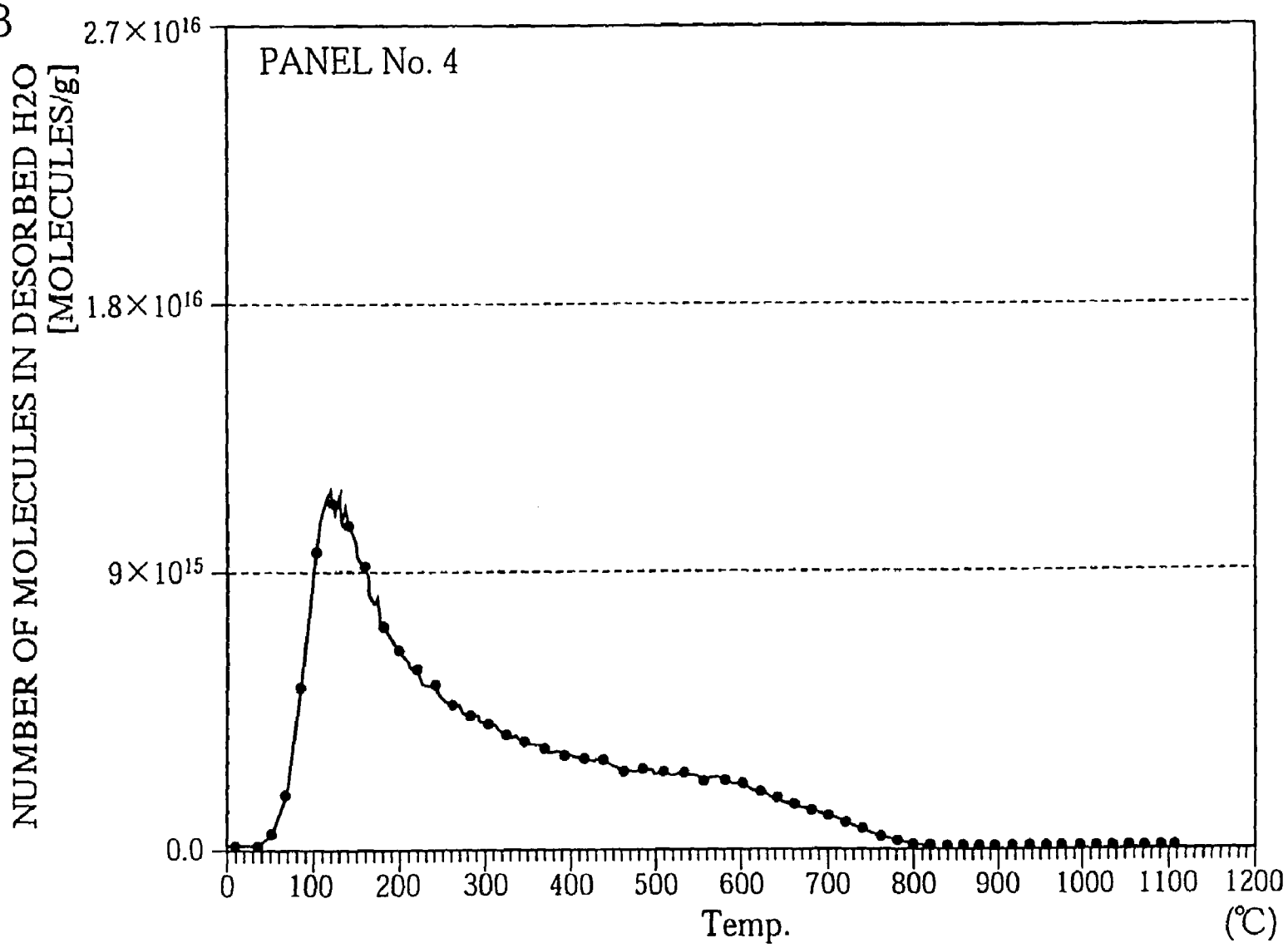
Figure 7C:
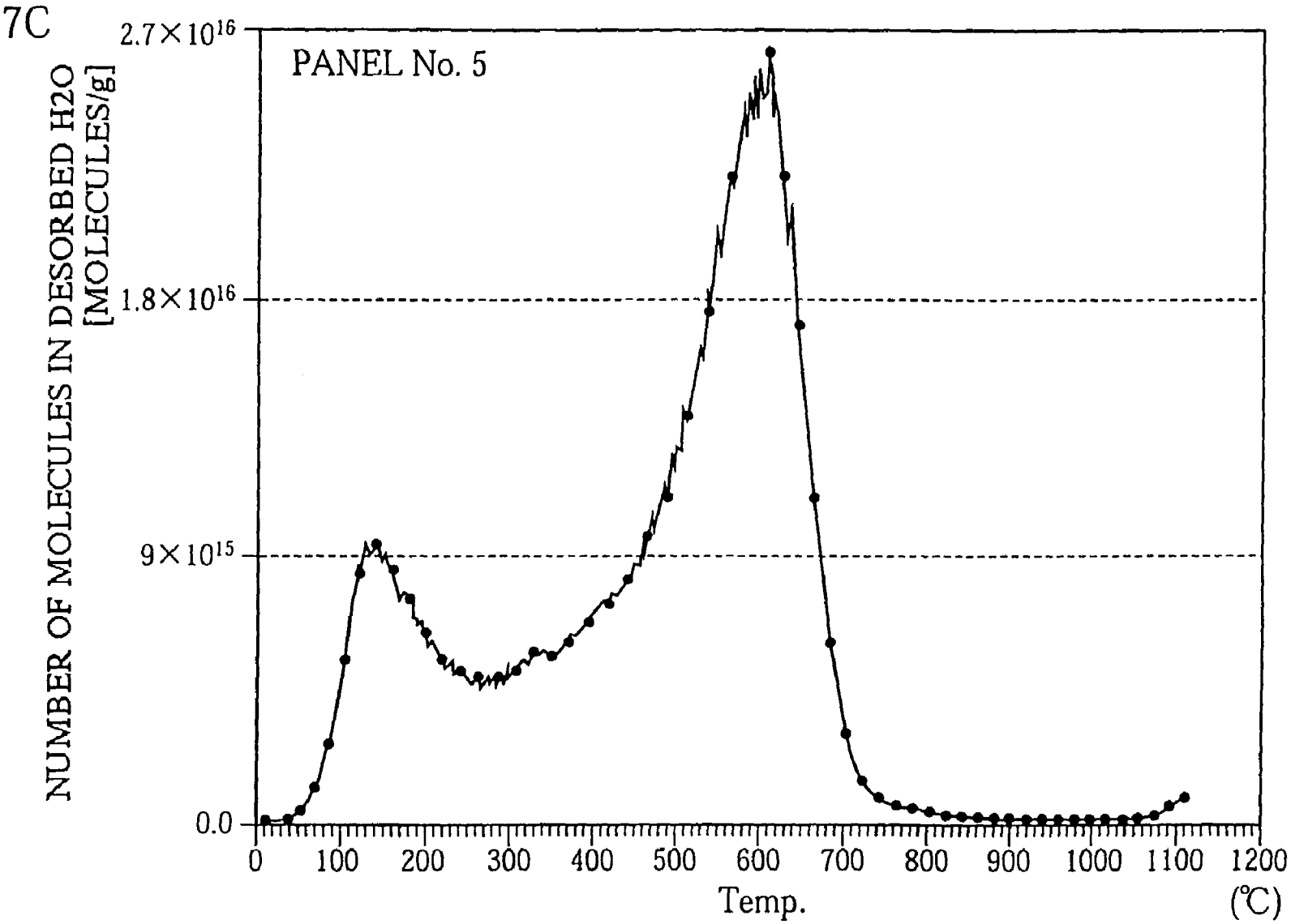

Each test sample of fluorescent substance contained in a tantalum plate was housed in a preparative-exhausting chamber and gas was exhausted from the chamber to the order of $10^{-4}$ Pa. The test sample was then housed in a measuring chamber, and gas was exhausted from the chamber to the order of $10^{-7}$ Pa. The number of $H_2O$ molecules (mass number 18) desorbed from the fluorescent substance was measured in a scan mode at measurement intervals of 15 seconds while the test sample was heated using an infrared heater from room temperature to 1,100° C. at heating rate 10° C./min. FIGS. 7A, 7B, and 7C show the test results for the blue fluorescent substances taken out from the panels 2, 4, and 5, respectively.

As observed from the drawing, the number of $H_2O$ molecules desorbed from the blue fluorescent substance has peaks at around 100° C. to 200° C. and at around 400° C. to 600° C. It is considered that the peak at around 100° C. to 200° C. is due to desorption of the physical adsorption gas, and the peak at around 400° C. to 600° C. is due to desorption of the chemical adsorption gas.

Table 1 shows the peak value of the number of $H_2O$ molecules desorbed at 200° C. or higher, namely $H_2O$ molecules desorbed at around 400° C. to 600° C., and the ratio of c-axis length to a-axis length of the blue fluorescent substance crystal.

Study

By studying the results shown in Table 1, it is noted that the panels 1 to 4 of the present embodiment are superior to the panel 5 (comparative example) in the light emitting characteristics. That is, the panels 1 to 4 have higher panel luminance and color temperatures.

In the panels 1 to 4, the light emitting characteristics increase in the order of the panel 1, 2, 3, 4.

It is found from this result that the light emitting characteristics (panel luminance and color temperature) become superior as the partial pressure of the steam vapor is lower in the flourescent substance layer baking process, frit temporary baking process, and bonding process.

The reason for the above phenomenon is considered that when the partial pressure of the steam vapor is reduced, the degradation of the blue flourescent substance layer ($BaMgAl_{10}O_{17}$: Eu) is prevented and the chromaticity coordinate y value becomes small.

In case of the panels of the present embodiment, the peak number of molecules contained in one gram of $H_2O$ gas desorbed from the blue fluorescent substances at 200° C. or higher is $1\times10^{16}$ or less, and the ratio of c-axis length to a-axis length of the blue fluorescent substance crystal is 4.0218 or less. In contrast, the corresponding values of the comparative panel are both greater than the above values.

<Embodiment 2>

The PDP of the present embodiment has the same construction as that of Embodiment 1.

The manufacturing method of the PDP is also the same as Embodiment 1 except: the position of the air vents at the outer regions of the back glass substrate 21; and the format in which the sealing glass frit is applied. During the bonding process, the flourescent substance layer degrades by heat worse than during the flourescent substance layer baking process and the frit temporary baking process since in the bonding process, the gas including the steam vapor being generated from the protecting layer, flourescent substance layer, and sealing glass of the front panel is confined to each small inner space partitioned by the partition walls when heated. Considering this, in the present embodiment, it is arranged that the dry air injected into the inner space can flow steadily through the space between partition walls in the bonding process and that the gas generated in the space between partition walls is effectively exhausted. This increases the effect of preventing the degradation of the flourescent substance layer by heat.

FIGS. 8 to 16 show specific embodiments concerning: the position of the air vents at the outer regions of the back glass substrate 21; and the format in which the sealing glass frit is applied. Note that though the back panel 20 is provided with the partition walls 24 in stripes over the whole image display area in reality, FIGS. 8 to 16 show only several columns of partition walls 24 for each of the sides, omitting the center part.

As shown in these figures, a frame-shaped sealing glass area 60 (an area on which the sealing glass layer 15 is formed) is allotted at the outer region of the back glass substrate 21. The sealing glass area 60 is composed of: a pair of vertical sealing areas 61 extending along the outermost partition wall 24; and a pair of horizontal sealing areas 62 extending perpendicular to the partition walls (in the direction of the width of the partition walls).

When panels are bonded together, dry air flows through gaps 65 between partition walls 24.

The characteristics of the present examples will be described with reference to the drawings.

As shown in FIGS. 8 to 12, air vents 21*a* and 21*b* are formed at diagonal positions inside the sealing glass area 60. When panels are bonded together, dry air guided through the air vent 21*a*, as shown in FIG. 4, passes through the gap 63*a* between the partition wall edge 24*a* and horizontal sealing area 62, is divided into the gaps 65 between the partition walls 24. The dry air then passes through the gaps 65, passes through the gap 63*b* between the partition wall edge 24*b* and horizontal sealing area 62, and is exhausted from the air vent 21*b*.

Figure 8:
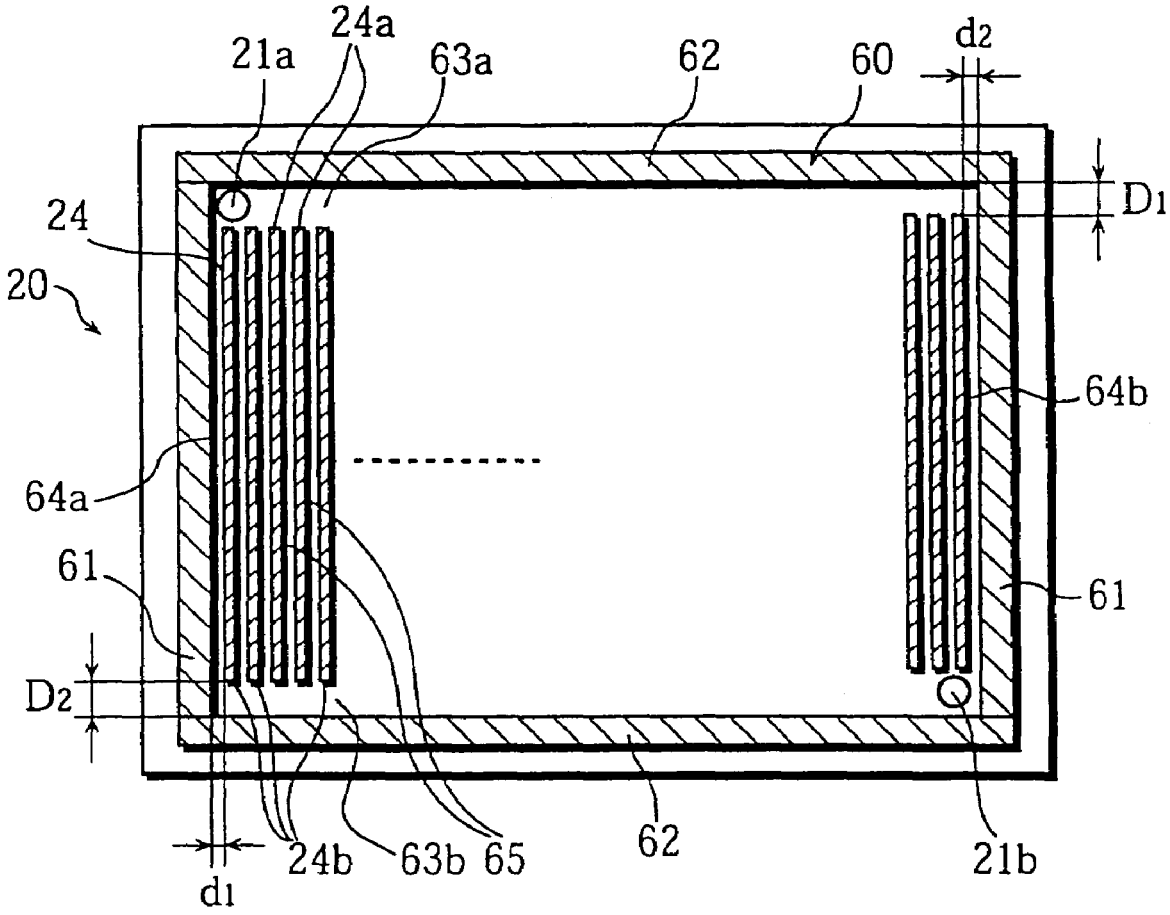
FIGS. 8 to 16 show specific examples of Embodiment 2 concerning: the position of the air vents at the outer regions of the back glass substrate; and the format in which the sealing glass frit is applied.

In the example shown in FIG. 8, each of the gaps 63*a* and 63*b* has greater width than each of the gaps 64*a* and 64*b* between the vertical sealing area 61 and the adjacent partition wall 24 (so that D1, D2>d1, d2 is satisfied, where D1, D2, d1, and d2 respectively represent the minimum widths of the gaps 63*a*, 63*b*, 64*a*, and 64*b*).

With such a construction, for the dry air supplied through air vent 21*a*, the resistance to the gas flow in the gaps 65 between the partition walls 24 becomes smaller than that in the gaps 64*a* and 64*b*. As a result, a greater amount of dry air passes through gaps 63*a* and 63*b* than gaps 64*a* and 64*b*, resulting in steady separation of the dry air into the gaps 65 and steady flow of the dry gas in the gaps 65.

With the above arrangement, the gas generated in each gap 65 is effectively exhausted, which enhances the effect of preventing the degradation of the flourescent substance later in the bonding process.

It can also be said that the greater values the minimum widths D1 and D2 of the gaps 63*a* and 63*b* are set to than the minimum widths d1 and d2 of the gaps 64*a* and 64*b*, such as two times or three times the values, the smaller the resistance to the gas flow in the gaps 65 between the partition walls 24 becomes and the dry air flows through each gap 65 more steadily, further enlarging the effects.

Figure 9:
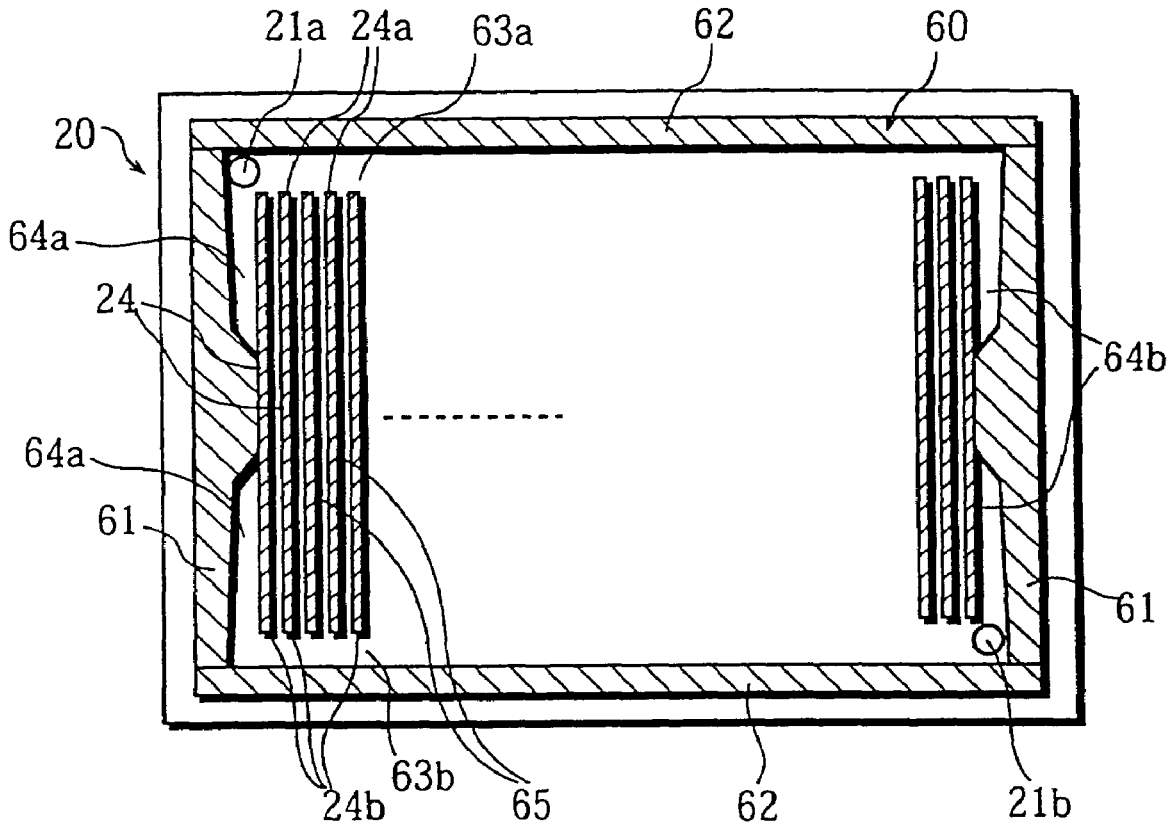

In the example shown in FIG. 9, the center part of the vertical sealing area 61 is connected to the adjacent partition wall 24. Therefore, the minimum widths d1 and d2 of the gaps 64*a* and 64*b* are each 0 around the center. In this case, the dry air flows through each gap 65 even more steadily since the dry air does not flow through the gaps 64*a* and 64*b*.

In the examples shown in FIGS. 10 to 16, a flow preventing wall 70 is formed inside the sealing glass area 60 so that they are in intimate contact. The flow preventing wall 70 is composed of: a pair of vertical walls 71 extending along the vertical sealing areas 61; and a pair of horizontal walls 72 extending along the horizontal sealing areas 62. The air vents 21*a* and 21*b* are adjacent to the flow preventing wall 70 inside. Note that in the example shown in FIG. 12, only horizontal walls 72 are formed.

The flow preventing wall 70 is made of the same material, with the same shape as the partition walls 24. As a result, they can be manufactured in the same process.

The flow preventing wall 70 prevents the sealing glass of the sealing glass area 60 from flowing into the display area located at the center of the panel when the sealing glass area 60 is softened by heat.

Figure 10:
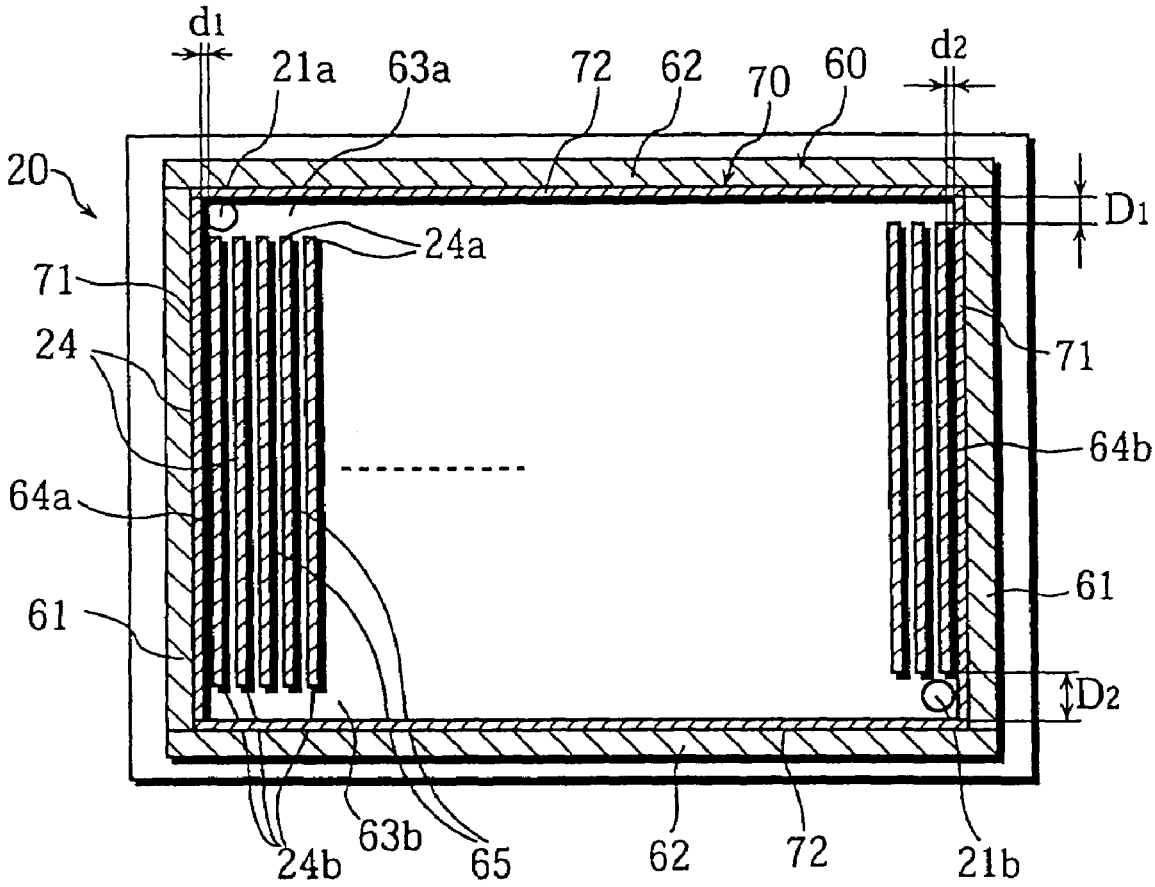

In the example shown in FIG. 10, as in the case shown in FIG. 8, each of the gaps 63*a* and 63*b* has greater width than each of the gaps 64*a* and 64*b* between the vertical sealing area 61 and the adjacent partition wall 24 (so that D1, D2>d1, d2 is satisfied), providing the same effects as the case shown in FIG. 8.

Figure 11:
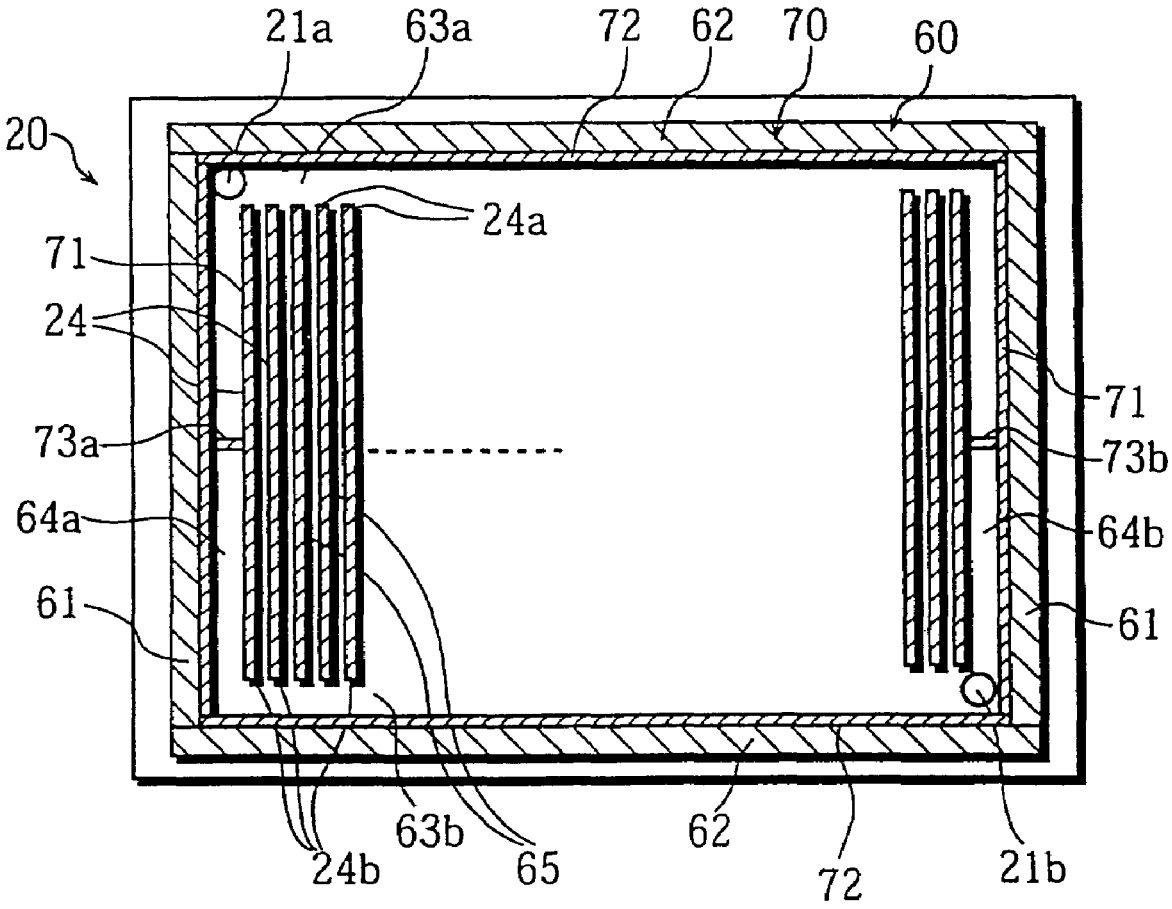

In the example shown in FIG. 11, partitions 73*a* and 73*b* are formed respectively around the center of the gaps 64*a* and 64*b* between the vertical walls 71 and the adjacent partition walls 24. The minimum widths d1 and d2 of the gaps 64*a* and 64*b* are each 0 around the center, like the case shown in FIG. 9. Therefore, this case also provides the same effects as the case shown in FIG. 9.

Figure 12:
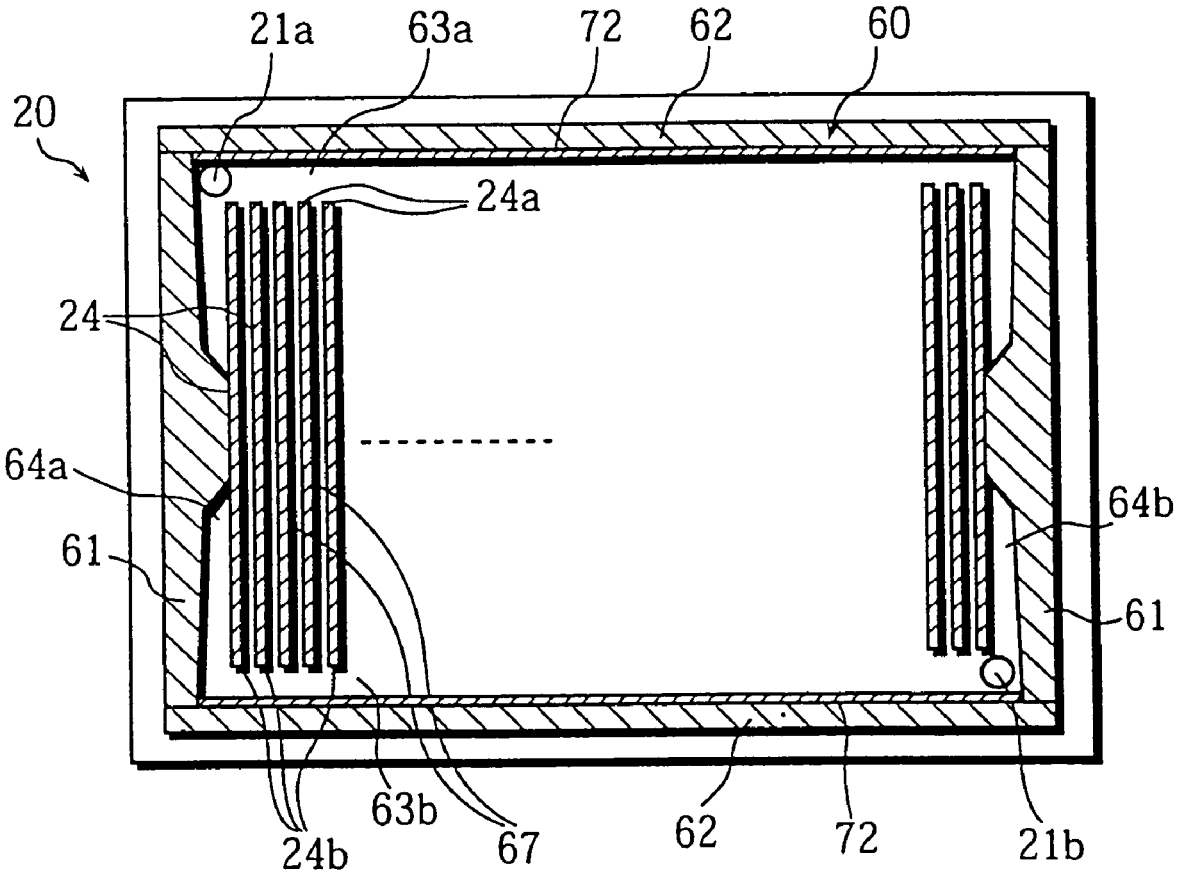

In the example shown in FIG. 12, the center part of the vertical sealing area 61 is connected to the adjacent partition wall 24. The minimum widths d1 and d2 of the gaps 64*a* and 64*b* are each 0 around the center, like the case shown in FIG. 9. Therefore, this case also provides the same effects as the case shown in FIG. 9.

Figure 13:
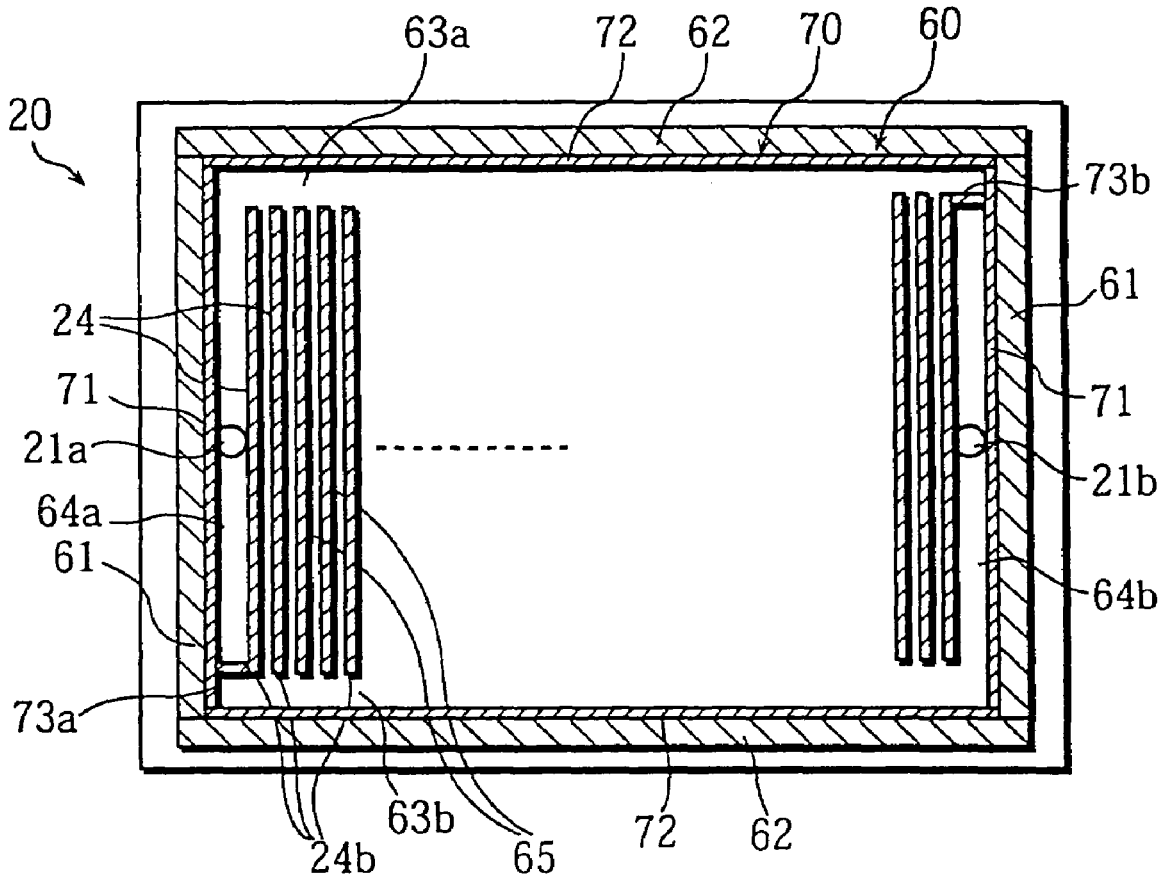

In the example shown in FIG. 13, the air vents 21*a* and 21*b* are formed at the center of the gaps 64*a* and 64*b* between the vertical walls 71 and the adjacent partition walls 24, not at diagonal positions. In addition, partitions 73*a* and 73*b* are formed respectively at the edges of gaps 64*a* and 64*b*. Therefore, this case provides the same effects as the case shown in FIG. 11.

Figure 14:
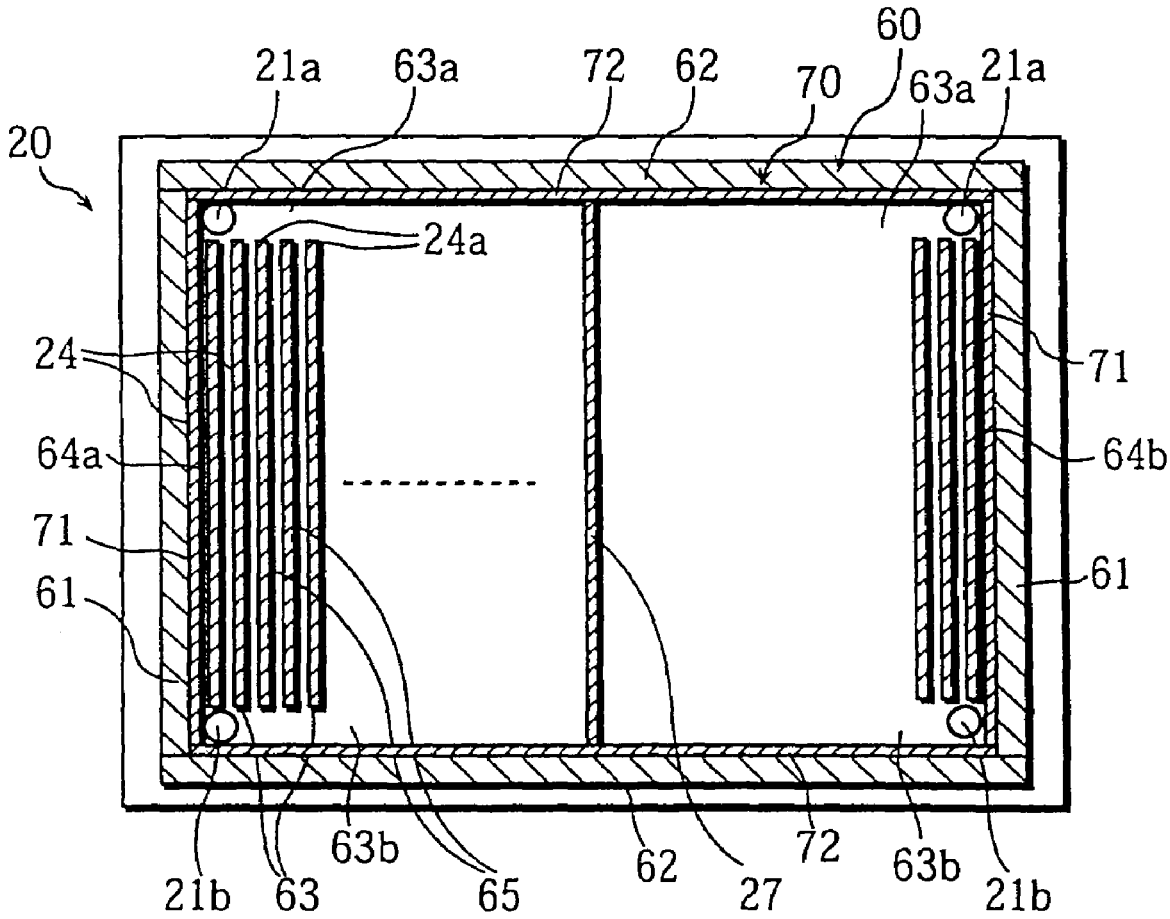

In the example shown in FIG. 14, two air vents 21*a* as inlets of gas and two air vents 21*b* as outlets of gas are formed, and a central partition wall 27 among the partition walls 24 is extended to connect to the horizontal walls 72 at both ends. Otherwise, the panel is almost the same as that shown in FIG. 11. In this case, dry air flows in each of the areas separated by the central partition wall 27. However, since each of the gaps 63*a* and 63*b* has greater width than each of the gaps 64*a* and 64*b*, this case also provides the same effects as the case shown in FIG. 11. Further, in the example shown in FIG. 14, it is possible to adjust the flow rate of the dry air for each of the areas separated by the central partition wall 27.

Variations of the Present Embodiment

In the present embodiment, as in Embodiment 1, it is desirable that the partial pressure of the steam vapor is 15 Torr or less (or the dew-point temperature of the dry air is 20° C. or lower), and the same effect can be obtained by flowing, instead of the dry air, an inert gas such as nitrogen which does not react with the flourescent substance layer and whose partial pressure of the steam vapor is low.

The present embodiment describes the case in which partition walls are formed on the back panel. However, partition walls may be formed on the front panel in the same way, gaining the same effects.

EXAMPLE 2

<Table 2>

The panel 6 is a PDP manufactured based on FIG. 10 of the present embodiment in which the partial pressure of the steam vapor in the dry air flown during the bonding process is set to 2 Torr (the dew-point temperature of the dry air is set to −10).

Figure 15:
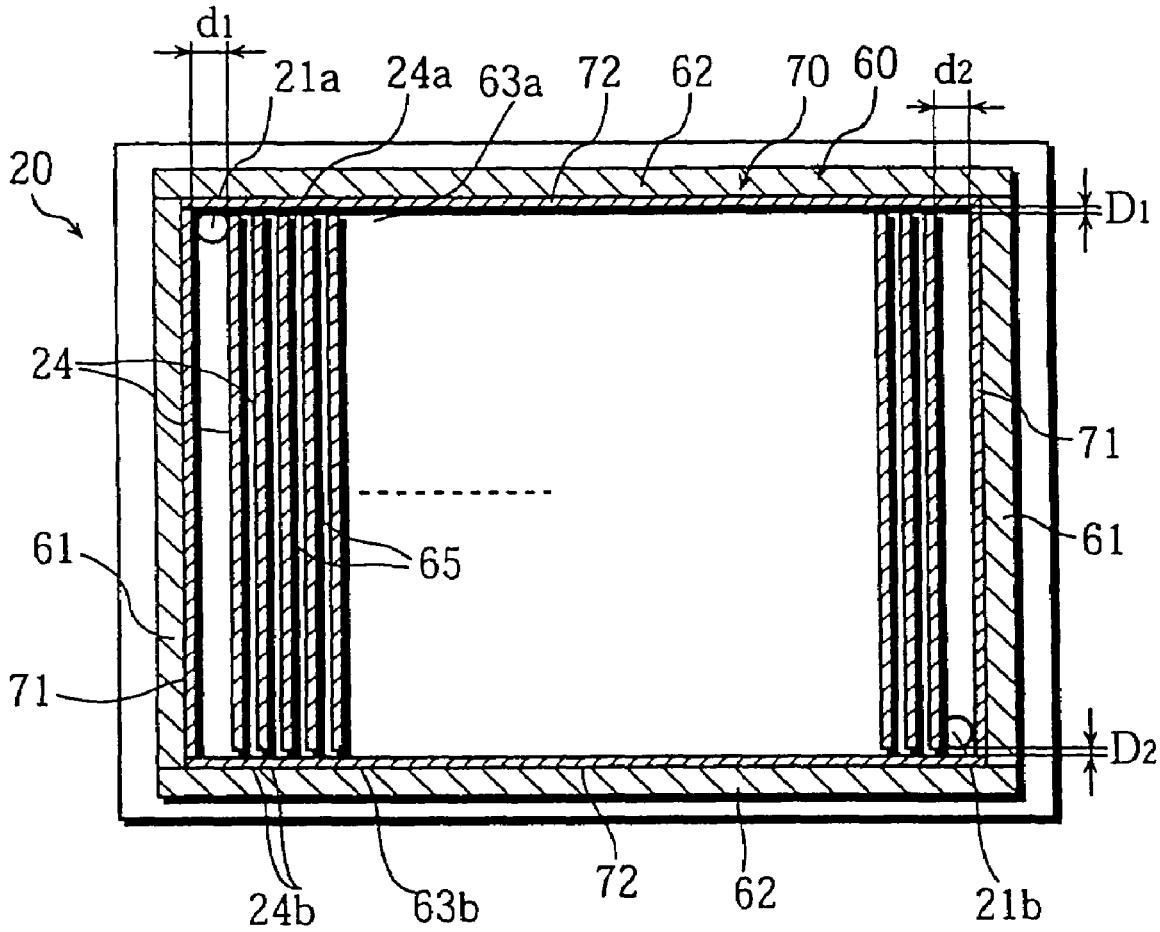

The panel 7 is a PDP manufactured partially based on FIG. 15 of the present embodiment in which each of the gaps 63*a* and 63*b* has less width than each of the gaps 64*a* and 64*b* between the vertical sealing area 61 and the adjacent partition wall 24 (so that D1, D2<d1, d2 is satisfied). Otherwise, the panel is manufactured based on FIG. 10. When the panel 7 is manufactured, panels are bonded together in the same conditions as the panel 6.

Figure 16:
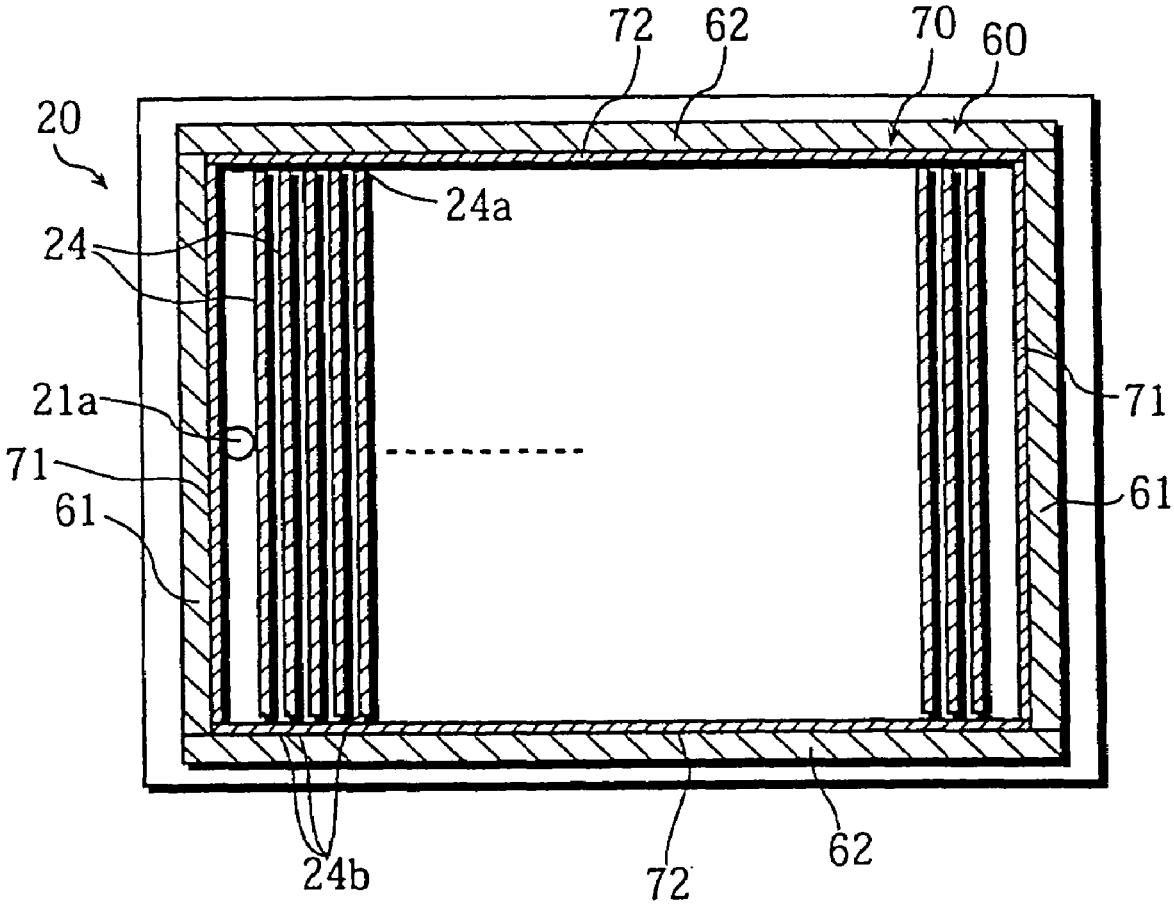

The panel 8 is a PDP manufactured for comparison. The panel 8 has one air vent 21*a* on the back panel 20, as shown in FIG. 16. During the bonding process, the front panel 10 and the back panel 20 were heated to bond together without flowing the dry air after they were put together.

The panels 6 to 8 were manufactured under the same conditions except the bonding process. The panels 6 to 8 have the same panel construction except the air vents and flow preventing walls. In each of the PDPs 6 to 8, the thickness of the flourescent substance layer is 20 μm, and the discharge gas, Ne(95%)-Xe(5%), was charged with the charging pressure 500 Torr.

Test for Light Emitting Characteristics

For each of the PDPs 6 to 8, the panel luminance and the color temperature in the white balance without color correction, and the ratio of the peak intensity of the spectrum of light emitted from the blue cells to that of the green cells were measured as the light emitting characteristics.

The results of this test are shown in Table 2.

Each of the manufactured PDPs was disassembled and vacuum ultraviolet rays were radiated onto the blue fluorescent substance layers of the back panel using a krypton excimer lamp. The color temperature when light was emitted from all of the blue, red, and green cells, and the ratio of the peak intensity of the spectrum of light emitted from the blue cells to that of the green cells were then measured. The results were the same as the above ones.

The blue fluorescent substances were then taken out from the panel. The number of molecules contained in one gram of $H_2O$ gas desorbed from the blue fluorescent substances was measured using the TDS analysis method. Also, the ratio of c-axis length to a-axis length of the blue fluorescent substance crystal was measured by the X-ray analysis. The results are also shown in Table 2.

TABLE 2

PANEL LIGHT-EMITTING CHARACTERISTICS

| PANEL No. | PANEL LUMINANCE (cd/m$^2$) | COLOR TEMPERATURE WHEN LIGHT IS EMITTED FROM ALL CELLS ON PANEL (k) | PEAK INTENSITY RATIO OF SPECTRUM OF BLUE AND GREEN LIGHT (BLUE/GREEN) | PEAK NUMBER OF MOLECULES IN H2O GAS DESORBED FROM BLUE FLUORESCENT SUBSTANCE AT 200° C. OR MORE WITH TDS ANALYSIS | AXIS LENGTH RATIO OF BLUE FLUORESCENT SUBSTANCE CRYSTAL (c-AXIS/a-AXIS) |
|---|---|---|---|---|---|
| 6 | 540 | 8400 | 0.94 | $6.3 \times 10^{15}$ | 4.02175 |
| 7 | 500 | 7200 | 0.83 | $8.8 \times 10^{15}$ | 4.02177 |
| 8 | 470 | 6300 | 0.76 | $2.6 \times 10^{16}$ | 4.02208 |

Study

By studying the results shown in Table 2, it is noted that the panel 6 of the present embodiment shows the best light emitting characteristics among the three panels. The light emitting characteristics of the panel 6 are better than those of the panel 7. This is considered to be achieved for the following reasons: during the bonding process of the panel 6, the dry air steadily flow through the gap between partition walls and the generated gas is effectively exhausted, while during the bonding process of the panel 7, almost all the dry air guided into the inside through the air vent 21*a* is exhausted to the outside through the air vent 21*b* after passing through the gaps 63*a* and 63*b;* and in the case of panel 7, since a small amount of the dry gas flows through the gap 65 between the partition walls, the gas generated in the gap 65 is not effectively exhausted.

The light emitting characteristics of the panel 8 are inferior to the others. This is also considered to be caused because the gas generated in the gap 65 is not effectively exhausted since a small amount of the dry gas flows through the gap 65 between the partition walls.

The PDPs in the present example are manufactured based on FIG. 10. However, it has been confirmed that PDPs manufactured based on FIGS. 10 to 16 show similarly excellent light-emitting characteristics.

<Embodiment 3>

The PDP of the present embodiment has the same construction as that of Embodiment 1.

The manufacturing method of the PDP is also the same as Embodiment 1 except: when the front panel 10 and the back panel 20 are bonded together in the bonding process, the panels are heated while the dry air is flown by adjusting the pressure of the inner space to be lower than atmospheric pressure.

In the present embodiment, first the sealing glass frit is applied onto one or both of the front panel 10 and back panel 20. The applied sealing glass frit is baked temporarily. The panels 10 and 20 are then put together and placed in the heating furnace 51 of the heating-for-sealing apparatus 50. Pipes 52*a* and 52*b* are respectively connected to the glass pipes 26*a* and 26*b*. The pressure of the inner space between panels is reduced by exhausting air from the space through the pipe 52*b* using the vacuum pump 54. At the same time, the dry air is supplied from the gas supply source 53 into the inner space through the pipe 52*a* at a certain flow rate. In doing so, adjusting valves 55*a* and 55*b* are adjusted to keep the pressure of the inner space lower than atmospheric pressure.

As described above, as the panels 10 and 20 are heated for 30 minutes at the sealing temperature (peak temperature is 450° C.) while supplying the dry air into the inner space between panels under a reduced pressure, the sealing glass layer 15 is softened and the panels 10 and 20 are bonded together by the softened sealing glass.

The bonded panels are baked (for three hours at 350° C.) while air is exhausted from the inner space between the panels to produce a vacuum. The discharge gas with the above composition is then charged into the space at a certain pressure to complete the PDP.

Effects of the Present Embodiment

During the bonding process of the present embodiment, the panels are bonded together while dry gas is flown into the inner space between panels, as in Embodiment 1. Therefore, as described above, the degradation of the flourescent substance caused by contacting with the steam vapor is restricted.

It is desirable, as in Embodiment 1, that the partial pressure of the steam vapor in the dry air is 15 Torr or less. The effect of restricting the degradation becomes more remarkable as the partial pressure of the steam vapor is set to a lower value like 10 Torr or less, 5 Torr or less, 1 Torr or less, 0.1 Torr or less. It is desirable that the dew-point temperature of the dry gas is set to 20° C. or lower, more desirably, to a lower value like 0° C. or lower, −20° C. or lower, −40° C. or lower.

Further, in the present embodiment, the steam vapor generated in the inner space is more effectively exhausted to the outside than in Embodiment 1 since the panels are bonded together while the pressure of the inner space is kept to be lower than atmospheric pressure. The bonded panels 10 and 20 are in intimate contact since the inner space between panels does not expand during the bonding process since dry air is supplied into the space while the pressure of the inner space is kept to be lower than atmospheric pressure.

The lower the pressure of the inner space is, the more easily the partial pressure of the steam vapor is adjusted to be low. This is desirable in terms of bonding the panels to be in intimate contact. Therefore, it is desirable to set the pressure of the inner space between panels to 500 Torr or lower, more desirably to 300 Torr or lower.

On the other hand, when the dry gas is supplied to the inner space between panels whose pressure is extremely low, the partial pressure of oxygen in the atmospheric gas becomes low. For this reason, oxide flourescent substances such as $BaMgAl_{10}O_{17}$: Eu, $Zn_2SiO_4$: Mn, and ($Y_2O_3$: Eu which are often used for PDPs cause defects like oxygen defects when heated in the atmosphere of non oxygen. This causes the light-emitting efficiency to be likely to decrease. Accordingly, from this point of view, it is desirable to set the pressure of the inner space to 300 Torr or higher.

Variations of the Present Embodiment

In the present embodiment, dry air is supplied as the atmospheric gas into the inner space between the panels in the bonding process. However, the same effect can be obtained by flowing, instead of the dry air, an inert gas such as nitrogen which does not react with the flourescent substance layer and whose partial pressure of the steam vapor is low. It should be noted here that it is desirable to supply an atmospheric gas including oxygen in terms of restricting the degradation of the luminance.

In the present embodiment, the pressure of the inner space is reduced even when the temperature is too low to soften the sealing glass. In this case, however, gas may be flown into the inner space from the heating furnace 51 through gaps between the front panel 10 and back panel 20. As a result, it is desirable to supply or charge dry air to the heating furnace to 51.

Alternatively, to prevent gas from flowing from the heating furnace 51 to the inner space between panels, the pressure of the inner space may be kept near atmospheric pressure by not exhausting the dry gas from the inner space when the temperature is still low and the sealing glass has not been softened, then the dry gas may be forcibly exhausted from the inner space after the temperature rises to a certain degree or more to reduce the pressure of the inner space to be lower than atmospheric pressure. In this case, it is desirable that the temperature at which the dry gas is forcibly exhausted is set to a degree at which the sealing glass begins to be softened, or higher. In this respect, it is preferable that the temperature at which the dry gas is forcibly exhausted is set to 300° C. or higher, more preferably to 350° C. or higher, and even more preferably to 400° C. or higher.

The present embodiment describes the case in which during the bonding process, the panels 10 and 20 are heated while supplying the dry air into the inner space under a reduced pressure. However, the process of baking the fluorescent substances or temporarily baking the sealing glass frit may be performed in the atmosphere in which dry air is supplied under a reduced pressure. This provides a similar effect.

The application of the panel structure described in Embodiment 2 to the present embodiment produces further effects.

EXAMPLE 3

<Table 3>

Table 3 shows various conditions in which panels are bonded for respective PDPs which includes PDPs based on the present embodiment and PDPs for comparison.

The panels 11 to 21 are PDPs manufactured based on the present embodiment. The panels 11 to 21 have been manufactured in different conditions of: the partial pressure of the steam vapor in the dry gas flown into the inner space between panels during the bonding process; the gas pressure in the inner space between panels; the temperature at which the pressure of the inner space starts to be reduced to be lower than atmospheric pressure; and the type of the dry gas.

The panel 22 is a PDP manufactured based on Embodiment 1 in which the dry gas is supplied to the inner space, but gas is not forcibly exhausted from the space during the bonding process.

The panel 23 is a PDP manufactured for comparison. The panel 23 was manufactured based on a conventional method without supplying the dry air to the inner space between panels.

In each of the PDPs 11 to 23, the thickness of the flourescent substance layer is 30 μm, and the discharge gas, Ne(95%)-Xe(5%), was charged with the charging pressure 500 Torr.

TABLE 3

PANEL BONDING CONDITIONS AND LIGHT-EMITTING CHARACTERISTICS

| PIANEL No. | DRY GAS TYPE | PARTIAL PRESSURE OF STEAM VAPOR IN DRY GAS (Torr) | PRESSURE IN SPACE BETWEEN PANELS (Torr) | TEMPERATURE FOR REDUCING TO BE LOWER THAN ATMOSPHERIC PRESSURE(° C.) | RELATIVE LIGHT-EMITTING INTENSITY OF BLUE LIGHT | CHROMATICITY COORDINATE Y OF BLUE LIGHT |
|---|---|---|---|---|---|---|
| 11 | AIR | 12 | 500 | 370 | 108 | 0.075 |
| 12 | AIR | 8 | 500 | 370 | 115 | 0.068 |
| 13 | AIR | 3 | 500 | 370 | 120 | 0.063 |
| 14 | AIR | 0 | 500 | 370 | 125 | 0.058 |
| 15 | AIR | 0 | 300 | 370 | 120 | 0.058 |
| 16 | AIR | 0 | 100 | 370 | 113 | 0.058 |
| 17 | AIR | 0 | 500 | ROOM TEMPERATURE | 121 | 0.062 |
| 18 | AIR | 0 | 500 | 320 | 123 | 0.060 |
| 19 | AIR | 0 | 500 | 420 | 127 | 0.056 |
| 20 | NITROGEN | 0 | 500 | 370 | 105 | 0.058 |
| 21 | Ne—Xe(%) | 0 | 500 | 370 | 105 | 0.058 |
| 22 | AIR | 0 | ATMOSPHERIC PRESSURE | — | 125 | 0.058 |
| 23 | — | — | ATMOSPHERIC PRESSURE | — | 100 | 0.090 |

| PIANEL No. | PEAK WAVELENGTH OF BLUE LIGHT (nm) | COLOR TEMPERATURE IN WHITE BALANCE(K) | PEAK INTENSITY RATIO OF SPECTRUM OF BLUE AND GREEN LIGHT (BLUE/GREEN) | PEAK NUMBER OF MOLECULES IN H2O GAS DESORBED FROM BLUE FLUORESCENT SUBSTANCE AT 200° C. OR MORE WITH TDS ANALYSIS | AXIS LENGTH RATIO OF BLUE FLUORESCENT SUBSTANCE CRYSTAL (c-AXIS/a-AXIS) |
|---|---|---|---|---|---|
| 11 | 455 | 7100 | 0.82 | $1.0 \times 10^{16}$ | 4.02180 |
| 12 | 454 | 7600 | 0.88 | $7.9 \times 10^{15}$ | 4.02177 |
| 13 | 453 | 7900 | 0.91 | $7.1 \times 10^{15}$ | 4.02176 |
| 14 | 451 | 8700 | 0.96 | $5.9 \times 10^{15}$ | 4.02174 |
| 15 | 451 | 8600 | 0.96 | $5.9 \times 10^{15}$ | 4.02174 |
| 16 | 451 | 8500 | 0.95 | $5.3 \times 10^{15}$ | 4.02172 |
| 17 | 452 | 8000 | 0.92 | $6.4 \times 10^{15}$ | 4.02176 |
| 18 | 452 | 8200 | 0.93 | $6.0 \times 10^{15}$ | 4.02175 |
| 19 | 450 | 9000 | 0.98 | $2.2 \times 10^{15}$ | 4.02164 |
| 20 | 451 | 8400 | 0.94 | $4.8 \times 10^{15}$ | 4.02173 |
| 21 | 451 | 8400 | 0.94 | $4.8 \times 10^{15}$ | 4.02173 |
| 22 | 451 | 8700 | 0.96 | $5.9 \times 10^{15}$ | 4.02174 |
| 23 | 458 | 5800 | 0.67 | $2.6 \times 10^{16}$ | 4.02208 |

Test for Light Emitting Characteristics

For each of the PDPs 11 to 23, the relative light-emitting intensity of the emitted blue light, the chromaticity coordinate y of the emitted blue light, the peak wavelength of the emitted blue light, the color temperature in the white balance without color correction, and the ratio of the peak intensity of the spectrum of light emitted from the blue cells to that of the green cells were measured as the light emitting characteristics.

Of the above characteristics, the relative light-emitting intensity of blue light, the chromaticity coordinate y of blue light, and the color temperature in the white balance without color correction were measured with the same method as Embodiment 1. The peak wavelength of the emitted blue light was measured by illuminating only the blue cells and measuring the emission spectrum of the emitted blue light. The results of this test are shown in Table 3.

Note that the relative light-emitting intensity values for blue light shown in Table 3 are relative values when the measured light-emitting intensity of the panel 23, a comparative example, is set to 100 as the standard value.

Each of the manufactured PDPs was disassembled and vacuum ultraviolet rays were radiated onto the blue fluorescent substance layers of the back panel using a krypton excimer lamp. The chromaticity coordinate y of blue light, the color temperature when light was emitted from all of the blue, red, and green cells, and the ratio of the peak intensity of the spectrum of light emitted from the blue cells to that of the green cells were then measured. The results were the same as the above ones.

The blue fluorescent substances were then taken out from the panel. The number of molecules contained in one gram of $H_2O$ gas desorbed from the blue fluorescent substances was measured using the TDS analysis method. Also, the ratio of c-axis length to a-axis length of the blue fluorescent substance crystal was measured by the X-ray analysis. The results are also shown in Table 3.

Study

By studying the results shown in Table 3, it is noted that the panels 11 to 21 of the present embodiment have light emitting characteristics superior to those of the comparative example (panel 23) (with higher light-emitting intensity of blue light and higher color temperature in the white balance).

The panels 14 and 22 have the same values for the light emitting characteristics. This shows that the same effects (light emitting characteristics) are gained if the partial pressure of the steam vapor in the dry air flowing in the inner space is the same, regardless whether the pressure of the inner space is equivalent to or lower than the atmospheric pressure.

However, among the samples of the panel 22, some samples were observed to have gaps between the partition walls and the front panel. This is considered to be because the inner space expanded a little due to the dry gas supplied during the bonding process.

By comparing the light-emitting characteristics of the panels 11 to 14, it is noted that the light-emitting intensity of blue light increases and the chromaticity coordinate y of the emitted blue light decreases in the order of the panel 11, 12, 13, 14. This shows that the light-emitting intensity of emitted blue light increases and the chromaticity coordinate y of the emitted blue light decreases as the partial pressure of the steam vapor in the dry air decreases. This is considered to be because the degradation of the blue flourescent substance is prevented by reducing the partial pressure of the steam vapor.

By comparing the light-emitting characteristics of the panels 14 to 16, it is noted that the panels have the same values for the chromaticity coordinate y of the emitted blue light. This shows that the chromaticity coordinate y of the emitted blue light is not affected by the pressure of the inner space between panels. It is also noted that the relative light-emitting intensity for blue light decreases in the order of the panel 14, 15, 16. This shows that the light-emitting intensity of emitted blue light decreases as the partial pressure of oxygen in the atmospheric gas decreases and defects like oxygen defects are generated in the flourescent substance.

By comparing the light-emitting characteristics of the panels 14, 20, and 21, it is noted that the panels have the same values for the chromaticity coordinate y of the emitted blue light. This shows that the chromaticity coordinate y of the emitted blue light is not affected by the type of the dry gas flown into the inner space between panels. It is also noted that the relative light-emitting intensity for blue light of the panels 20 and 21 is lower than that of the panel 14. This shows that the light-emitting intensity of emitted blue light decreases since defects like oxygen defects are generated in the flourescent substance when a gas such as nitrogen or Ne(95%)-Xe(5%) that does not contain oxygen is used as the dry gas.

By comparing the light-emitting characteristics of the panels 14 and 17 to 19, it is noted that the light-emitting intensity of blue light increases and the chromaticity coordinate y of the emitted blue light decreases in the order of the panel 17, 18, 14, 19. This shows that the light-emitting intensity of emitted blue light increases and the chromaticity coordinate y of the emitted blue light decreases as the temperature at which gas starts to be exhausted from the inner space to reduce the pressure of the inner space to be lower than atmospheric pressure is set to a higher degree. This is considered to be because setting the exhaust start temperature to a higher degree prevents the atmospheric gas around the panel from flowing into the inner space between panels.

By focusing attention on the relationships between the chromaticity coordinate y of the emitted blue light and the peak wavelength of the emitted blue light for each panel provided in Table 3, it is noted that the peak wavelength is shorter as the chromaticity coordinate y is smaller. This shows that they are proportional to each other.

<Embodiment 4>

The PDP of the present embodiment has the same construction as that of Embodiment 1.

The manufacturing method of the PDP is the same as conventional methods up to the bonding process (i.e., during the bonding process, the front panel 10 and the back panel 20 put together are heated without the supply of dry air into the inner space between the panels). However, in the exhausting process, panels are heated while dry gas is supplied into the inner space between the panels (hereinafter, this process is also referred to as a dry gas process) before gas is exhausted to produce a vacuum (vacuum exhausting process). This restores the light-emitting characteristics of the blue fluorescent substance layer to the level before they are degraded through the bonding process or earlier.

The following are description of the exhausting process of the present embodiment.

In the exhausting process of the present embodiment, the heating-for-sealing apparatus shown in FIG. 4 is used, and FIG. 4 will be referred to in the description.

The glass pipes 26*a* and 26*b* are respectively attached to the air vents 21*a* and 21*b* of the back panel 20 in advance. Pipes 52*a* and 52*b* are respectively connected to the glass pipes 26*a* and 26*b*. Gas is exhausted from the inner space between panels through the pipe 52*b* using the vacuum pump 54 to temporarily evacuate the inner space. Dry air is then supplied to the inner space at a certain flow rate through the pipe 52*a* without using the vacuum pump 54. This allows the dry air to flow through the inner space between the panels 10 and 20. The dry air is exhausted to the outside through the pipe 52*b*.

The panels 10 and 20 are heated to a certain temperature while the dry air is supplied to the inner space.

The supply of the dry air is then stopped. After this, the air is exhausted from the inner space between panels using the vacuum pump 54 while keeping the temperature at a certain degree to exhaust the gas held by adsorption in the inner space.

The PDP is completed after the discharge gas is charged into the cells after the exhausting process.

Effects of the Present Embodiment

The exhausting process of the present embodiment has the effect of preventing the degradation of the fluorescent substance layer from occurring during the process.

The exhausting process also has the effect of restoring the light-emitting characteristics of fluorescent substance layers (especially of the blue fluorescent substance layer) to the level before they are degraded through the earlier processes. The fluorescent substance layers (especially the blue fluorescent substance layer) are susceptible to degradation by heat during the flourescent substance layer baking process, temporary baking process, and bonding process. The exhausting process of the present embodiment recovers the light-emitting characteristics of fluorescent substance layers if they have been degraded during the above processes.

The reason for the above effects is thought to be as follows.

When the panels bonded together during the bonding process are heated, gas (especially steam vapor) is released in the inner space between the panels. For example, when the bonded panels are left in air, water is held by adsorption in the inner space. Therefore, steam vapor is released in the space between panels when the panels in this state are heated. According to the exhausting process of the present embodiment, such steam vapor is effectively exhausted to the outside since dry gas is flown through the inner space while the panels are heated before the vacuum exhausting process is started. Accordingly, compared with conventional exhausting processes in which gas is simply exhausted without supplying dry gas, the fluorescent substance is less degraded by heat during the exhausting process of the present embodiment.

It is also thought that the light-emitting characteristics are recovered since the gas exhausting process using the dry gas causes a reverse reaction to the degradation by heat to occur.

As apparent from the above description, the present embodiment provides a practically great effect that the once-degraded light-emitting characteristics of the blue fluorescent substance can be recovered in the exhausting process, the last heat process.

To enhance the effect of recovering the once-degraded light-emitting characteristics of the blue fluorescent substance, it is desired that the following conditions are satisfied.

The higher the peak temperature (i.e., the higher of: the temperature at which panels are heated while dry gas is supplied; and the temperature at which gas is exhausted to produce a vacuum) in the exhausting process is, the greater the effect of recovering the once-degraded light-emitting characteristics.

To obtain the effect sufficiently, it is preferable to set the peak temperature to 300° C. or higher, more preferably to higher degrees such as 360° C. or higher, 380° C. or higher, and 400° C. or higher. However, the temperature should not be set to such a high degree as softens the sealing glass to flow.

It is also preferable that the temperature at which panels are heated while dry gas is supplied is set to be higher than the temperature at which gas is exhausted to produce a vacuum. This is because when the temperatures are set reversely, the effect is reduced by the gas (especially steam vapor) released from the panels into the inner space during the vacuum exhausting process; and when the temperatures are set as described above, the effect is obtained since the gas is released less from the panels into the inner space during the vacuum exhausting process than the former case.

It is preferred that the partial pressure of the steam vapor in the supplied dry gas is set to as low a value as possible. This is because the effect of recovering the once-degraded light-emitting characteristics of the blue fluorescent substance increases as the partial pressure of the steam vapor in the dry gas becomes low, though compared to conventional vacuum exhausting processes, the effect is- remarkable when the partial pressure of the steam vapor is 15 Torr or lower.

The following experiment also shows that it is possible to recover the once-degraded light-emitting characteristics of the blue fluorescent substance.

Figure 17:
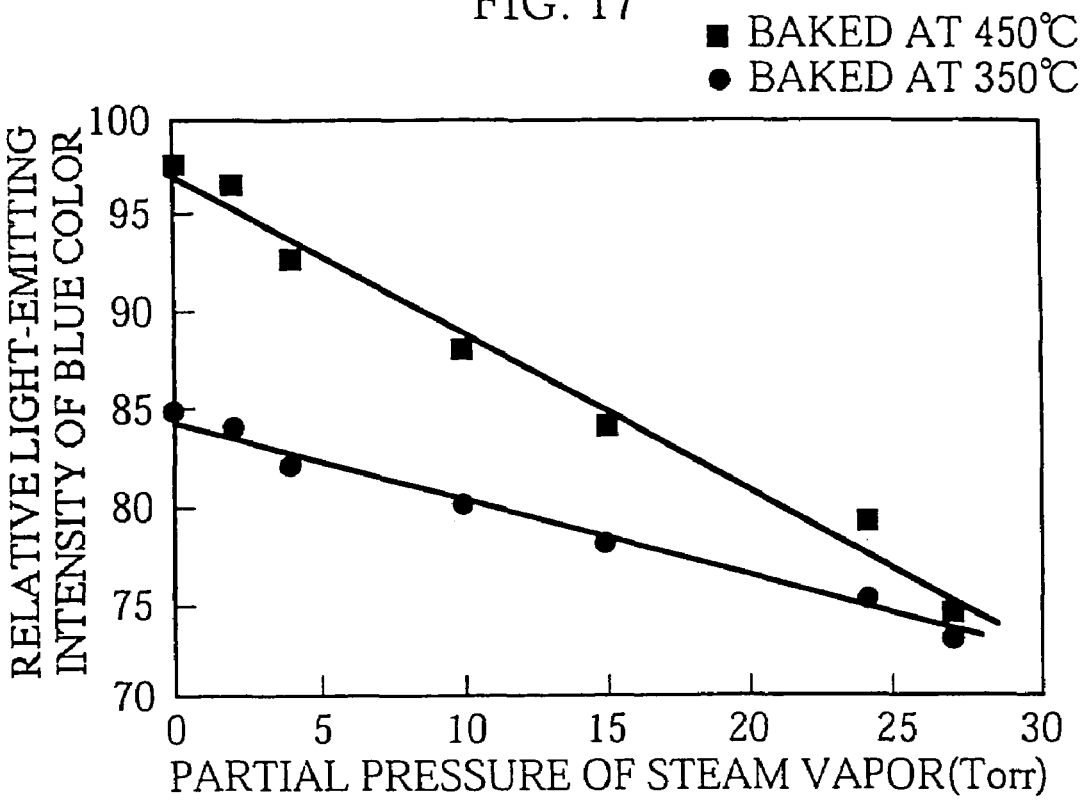
FIGS. 17 and 18 shows the characteristic of how the effect of recovering the once-degraded light-emitting characteristics depends on the partial pressure of steam vapor, where the blue flourescent substance layer is once degraded then baked again in air.
Figure 18:
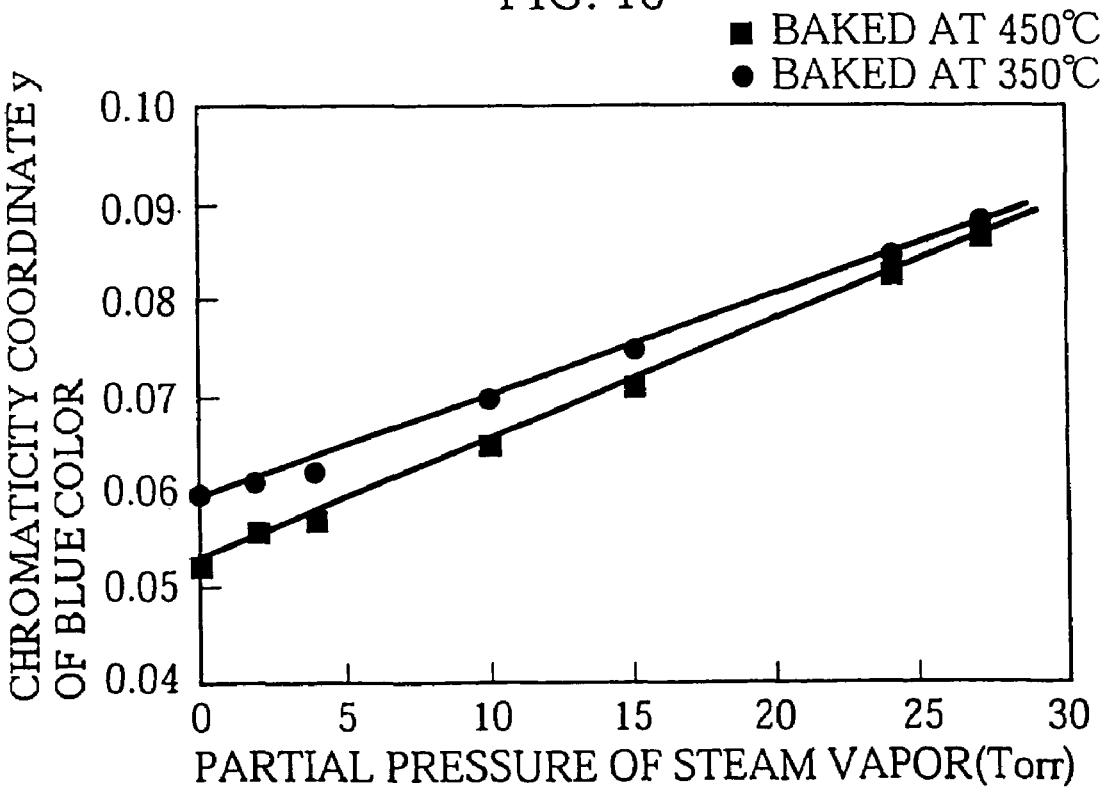

FIGS. 17 and 18 shows the characteristic of how the effect of recovering the once-degraded light-emitting characteristics depends on the partial pressure of steam vapor, where the blue flourescent substance layer ($BaMgAl_{10}O_7$: Eu) is once degraded then baked again in air. The measurement method is shown below.

The blue flourescent substance (chromaticity coordinate y is 0.052) was baked (for 20 minutes at peak temperature 450° C.) in air whose partial pressure of steam vapor was 30 Torr so that the blue flourescent substance was degraded by heat. In the degraded blue flourescent substance, the chromaticity coordinate y was 0.092, and the relative light-emitting intensity (a value when the light-emitting intensity of the blue flourescent substance measured before it is baked is set to 100 as the standard value) was 85.

The degraded blue flourescent substance was baked again at certain peak temperatures (350 ° C. and 450° C., maintained for 30 minutes) in air with different partial pressures of stream vapor. The relative light-emitting intensity and the chromaticity coordinate y of the re-baked blue flourescent substances were then measured.

FIG. 17 shows relationships between the partial pressure of steam vapor in air at the re-baking and the relative light-emitting intensity measured after the re-baking. FIG. 18 shows relationships between the partial pressure of steam vapor in air at the re-baking and the chromaticity coordinate y measured after the re-baking.

It is noted from FIGS. 17 and 18 that regardless of whether the re-baking temperature is 350° C. or 450° C., the relative light-emitting intensity of blue light is high and the chromaticity coordinate y of blue light is small when the partial pressure of steam vapor in air at the re-baking is in the range of 0 Torr to 30 Torr. This shows that even if the flourescent substance is baked in an atmosphere including much steam vapor and the light-emitting characteristics are degraded, the light-emitting characteristics are recovered when the flourescent substance is baked again in an atmosphere whose partial pressure of steam vapor is low. That is, the results show that the degradation of the blue flourescent substance by heat is a reversible reaction.

It is also noted from FIGS. 17 and 18 that the effect of recovering the once-degraded light-emitting characteristics increases as the partial pressure of steam vapor in air at the re-baking decreases or the re-baking temperature increases.

A similar measurement was conducted for various periods during which the peak temperature is maintained, though the measurement is not detailed here. The results show that the effect of recovering the once-degraded light-emitting characteristics increases as the period during which the peak temperature is maintained increases.

Variations of the Present Embodiment

In the present embodiment, dry air is used when panels are heated in the exhausting process. However, inert gas such as nitrogen or argon can be used instead of the dry air and the same effects can be obtained.

In the exhausting process of the present embodiment, panels are heated while dry air is supplied into the space between the panels before the vacuum exhausting starts. However, by setting the temperature during the vacuum exhausting process to a degree higher than the general degree (i.e., to 360° C. or higher), the light-emitting characteristics of the fluorescent substance can be recovered to a certain extent by performing only the vacuum exhausting process. Also in this case, the higher the exhausting temperature is, the greater the effect of recovering the light-emitting characteristics is.

However, the exhausting process of the present embodiment has greater effect of recovering the light-emitting characteristics than the above variation. It is thought this is because in case of the above variation, a sufficient amount of steam vapor is not exhausted to outside the panels in the vacuum exhausting process since the inner space between panels is small.

It is expected that application of the panel construction described in Embodiment 2 to the present embodiment will enhance the effect of exhausting gas when panels are heated while dry gas is supplied.

EXAMPLE 4

<Table 4>

The panels 21 to 29 are PDPs manufactured based on the present embodiment. The panels 21 to 29 have been manufactured at different heating or exhausting temperatures when panels are heated while dry gas is supplied into the inner space. In this process, a certain heating temperature was maintained for 30 minutes while dry gas was supplied into the inner space, then in the next vacuum exhausting process, a certain exhausting temperature was maintained for two hours.

The panels 30 to 32 are PDPs manufactured based on the variation of the present embodiment. The panels 30 to 32 have been manufactured without the dry gas process, performing the vacuum exhausting process at 360° C. or higher.

The panel 33 is a PDP manufactured based on a conventional method. The panel 33 was manufactured without the dry gas process, performing the vacuum exhausting process at 350° C. for two hours.

In each of the PDPs 21 to 33, the thickness of the flourescent substance layer is 30 μm, and the discharge gas, Ne(95%)-Xe(5%), was charged with the charging pressure 500 Torr.

Test for Light Emitting Characteristics

For each of the PDPs 21 to 33, the relative light-emitting intensity of blue light and the chromaticity coordinate y of blue light were measured as the light emitting characteristics.

<Test Results and Study>

The results of this test are shown in Table 4. Note that the relative light-emitting intensity values for blue light shown in Table 4 are relative values when the measured light-emitting intensity of the comparative panel 33 is set to 100 as the standard value.

As noted from Table 4, each of the panels 21 to 28 has higher light-emitting intensity and smaller chromaticity coordinate y than the panel 33. This shows that the light-emitting characteristics of PDPs are improved by adopting the exhausting process of the present embodiment when manufacturing PDPs.

By comparing the light-emitting characteristics of the panels 21 to 24, it is noted that the light-emitting characteristics are improved in the order of panels 21, 22, 23 and

TABLE 4

| | PANEL VACUUM EXHAUST CONDITIONS AND LIGHT-EMITTING CHARACTERISTICS(BLUE LIGHT) | | | | |
|---|---|---|---|---|---|
| PANEL No. | HEATING TEMPERATURE DURING DRY AIR SUPPLY(° C.) (MAINTAINED FOR 30 MINUTES) | HEATING TEMPERATURE DURING VACUUM EXHAUST (° C.) (MAINTAINED FOR TWO HOURS) | PARTIAL PRESSURE OF STEAM VAPOR IN DRY AIR(Torr) | RELATIVE LIGHT-EMITTING INTENSITY OF BLUE LIGHT | CHROMATICITY COORDINATE y OF BLUE LIGHT |
| 21 | 350 | 350 | 2 | 107 | 0.062 |
| 22 | 360 | 350 | 2 | 110 | 00.61 |
| 23 | 390 | 350 | 2 | 118 | 0.056 |
| 24 | 410 | 350 | 2 | 125 | 0.053 |
| 25 | 410 | 410 | 2 | 121 | 0.056 |
| 26 | 350 | 410 | 2 | 105 | 0.065 |
| 27 | 410 | 350 | 12 | 112 | 0.070 |
| 28 | 410 | 350 | 8 | 116 | 0.067 |
| 29 | 410 | 350 | 0 | 128 | 0.052 |
| 30 | — | 360 | — | 103 | 0.085 |
| 31 | — | 390 | — | 107 | 0.081 |
| 32 | — | 410 | — | 110 | 0.076 |
| 33 | — | 350 | — | 100 | 0.090 |

24 (the light-emitting intensity increases and the chromaticity coordinate y decreases). This shows that the higher a degree the heating temperature of the dry gas process is set to, the greater the effect of recovering the light-emitting characteristics of the blue fluorescent substance layer is.

By comparing the light-emitting characteristics of the panels 24 to 26, it is noted that the light-emitting characteristics are improved in the order of panels 26, 25, and 24. This shows that the higher a degree the heating temperature of the dry gas process is set to than the exhausting temperature of the vacuum exhausting process, the greater the effect of recovering the light-emitting characteristics of the blue fluorescent substance layer is.

By comparing the light-emitting characteristics of the panels 24, and 27 to 29, it is noted that the light-emitting characteristics are improved in the order of panels 27, 28, 24, and 29. This shows that the smaller a value the partial pressure of steam vapor of the dry gas process is set to, the greater the effect of recovering the light-emitting characteristics of the blue fluorescent substance layer is.

Each of the panels 30 to 32 has higher light-emitting intensity and smaller chromaticity coordinate y than the panel 33. This shows that the light-emitting characteristics of PDPs are improved by adopting the exhausting process that is the variation of the present embodiment in manufacturing PDPs.

Each of the panels 30 to 32 has lower light-emitting characteristics than the panel 21. This shows that the effect of recovering the light-emitting characteristics of the blue fluorescent substance layer is greater when the dry gas process of the present embodiment is adopted.

<Embodiment 5>

The PDP of the present embodiment has the same construction as that of Embodiment 1.

The manufacturing method of the PDP of the present embodiment is the same as Embodiment 1 up to the temporary baking process. However, in the bonding process, panels are preparatively heated while space is made between the facing sides of the panels, then the heated panels are put together and bonded together.

In the PDP of the present embodiment, the chromaticity coordinate y of the light emitted from blue cells when light is emitted from only blue cells is 0.08 or less, the peak wavelength of the spectrum of the emitted light is 455 nm or less, and the color temperature is 7,000K or more in the white balance without color correction. Further, it is possible to increase the color temperature in the white balance without color correction to about 11,000K depending on the manufacturing conditions by setting the chromaticity coordinate y of blue light to 0.06 or less.

Now, the bonding process of the present embodiment will be described in detail.

Figure 19:
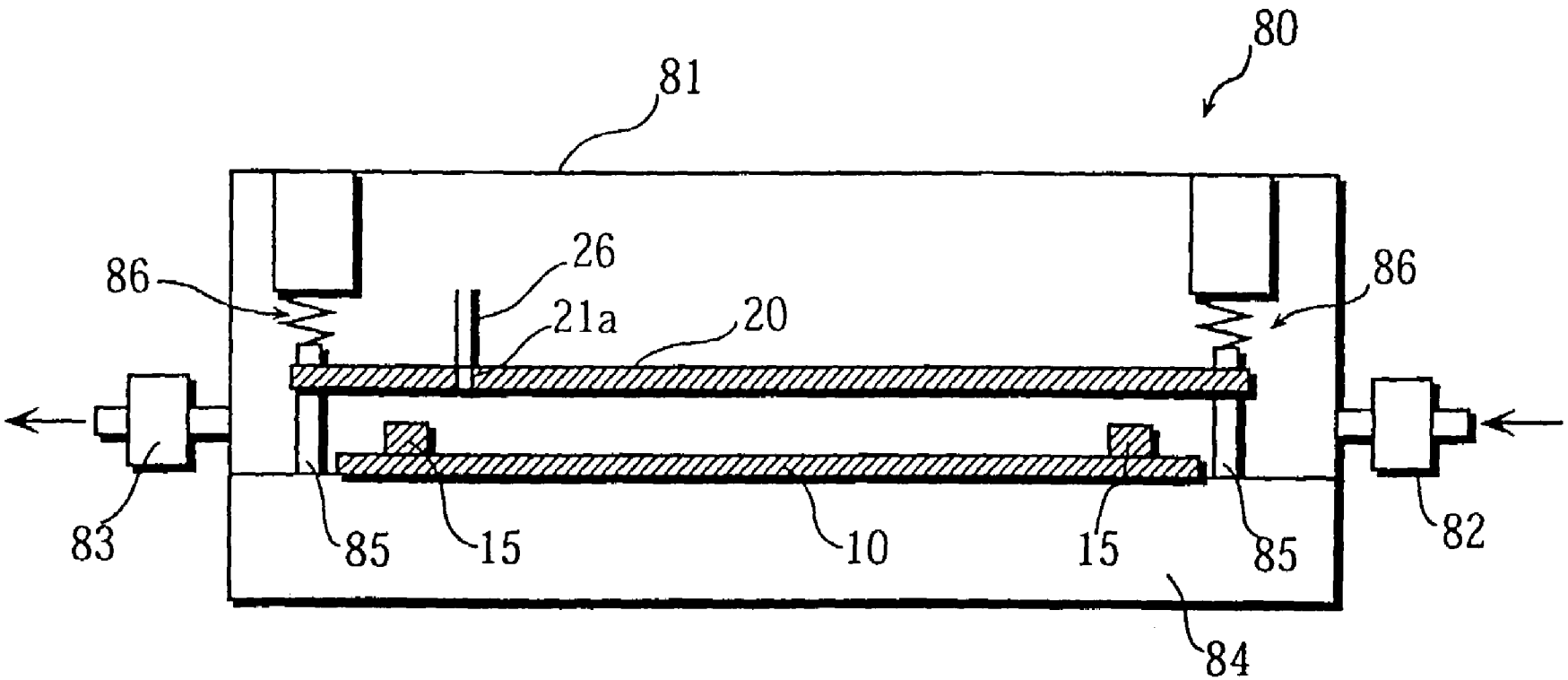
FIG. 19 shows the construction of a bonding apparatus used in the bonding process of Embodiment 5.

FIG. 19 shows the construction of a bonding apparatus used in the bonding process.

The bonding apparatus 80 includes a heating furnace 81 for heating the front panel 10 and the back panel 20, a gas supply valve 82 for adjusting the amount of atmospheric gas supplied into the heating furnace 81, a gas exhaust valve 83 for adjusting the amount of the gas exhausted from the heating furnace 81.

The inside of the heating furnace 81 can be heated to a high temperature by a heater (not illustrated). An atmospheric gas (e.g., dry air) can be supplied into the heating furnace 81 through the gas supply valve 82, the atmospheric gas forming the atmosphere in which the panels are heated. The gas can be exhausted from the heating furnace 81 through the gas exhaust valve 83 using a vacuum pump (not illustrated) to produce a vacuum in the heating furnace 81. The degree of vacuum in the heating furnace 81 can be adjusted with the gas supply valve 82 and the gas exhaust valve 83.

A dryer (not illustrated) is formed in the middle of the heating furnace 81 and an atmospheric gas supply source. The dryer cools the atmospheric gas (to minus several tens degree) to remove the water in the atmospheric gas by condensing water in the gas. The atmospheric gas is sent to the heating furnace 81 via the dryer so that the amount of steam vapor (partial pressure of steam vapor) in the atmospheric gas is reduced.

A base 84 is formed in the heating furnace 81. On the base 84, the front panel 10 and the back panel 20 are laid. Slide pins 85 for moving the back panel 20 to positions parallel to itself are formed on the base 84. Above the base 84, pressing mechanisms 86 for pressing the back panel 20 downwards are formed.

Figure 20:
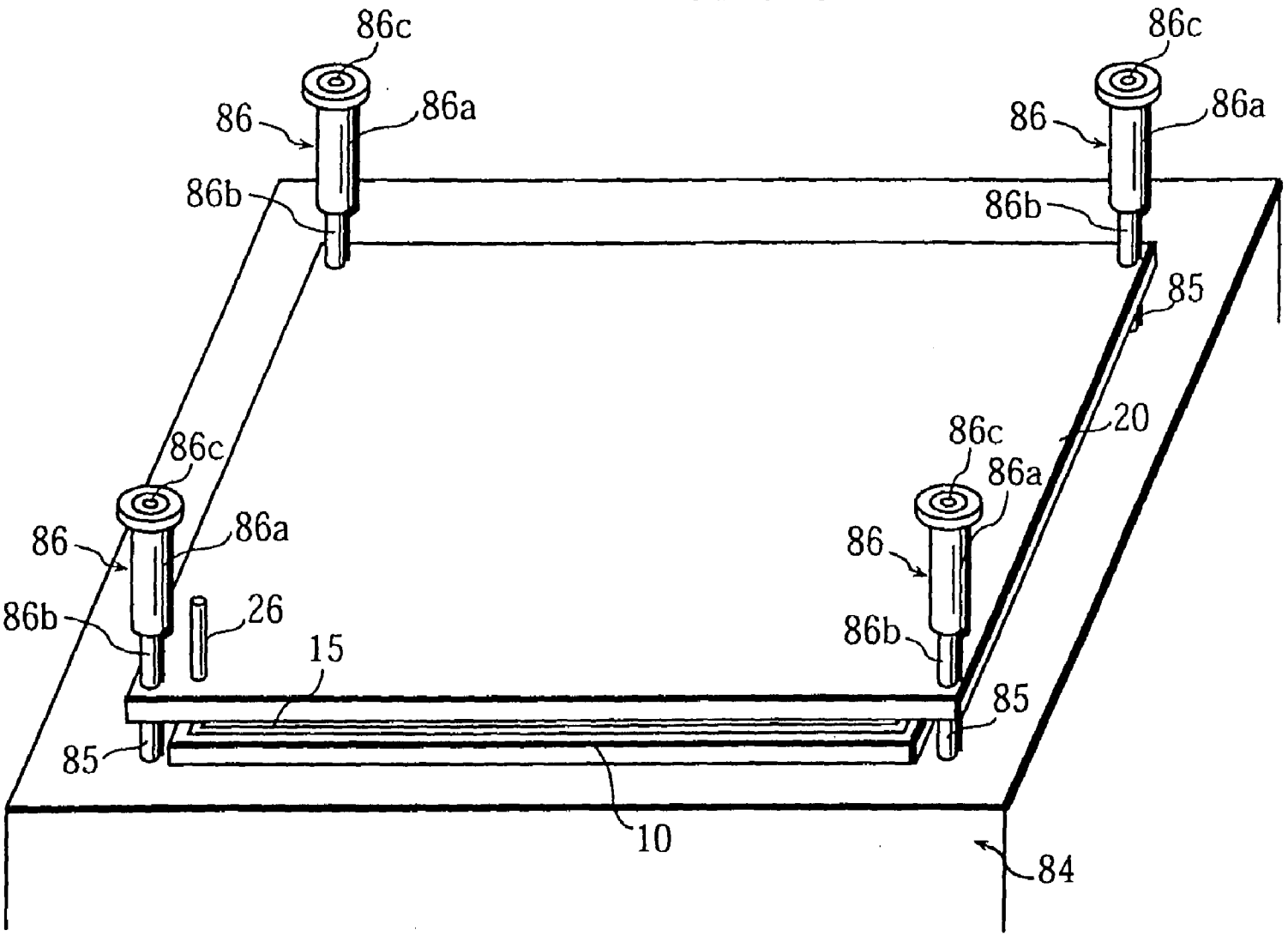
FIG. 20 is a perspective diagram showing the inner construction of the heating furnace of the bonding apparatus shown in FIG. 19.

FIG. 20 is a perspective diagram showing the inner construction of the heating furnace 81.

In FIGS. 19 and 20, the back panel 20 is placed so that the length of the partition walls is represented as a horizontal line.

As shown in FIGS. 19 and 20, the length of the back panel 20 is greater than that of the front panel 10, both edges of the back panel 20 extending off the front panel 10. Note that the extended parts of the back panel 20 are provided with leads which connect the address electrodes 22 to the activating circuit. The slide pins 85 and the pressing mechanisms 86 are positioned at the four corners of the back panel 20, sandwiching the extended parts of the back panel 20 in between.

The four slide pins 85 protrude from the base 84 and can be simultaneously moved upwards and downwards by a pin hoisting and lowering mechanism (not illustrated).

Each of the four pressing mechanisms 86 is composed of a cylindrical-shaped supporter 86*a* fixed on the ceiling of the heating furnace 81, a slide rod 86*b* which can move upwards and downwards inside the supporter 86*a*, and a spring 86*c* which adds pressure on the slide rod 86*b* downwards inside the supporter 86*a*. With the pressure given to the slide rod 86*b*, the back panel 20 is pressed downwards by the slide rod 86*b*.

Figure 21A:
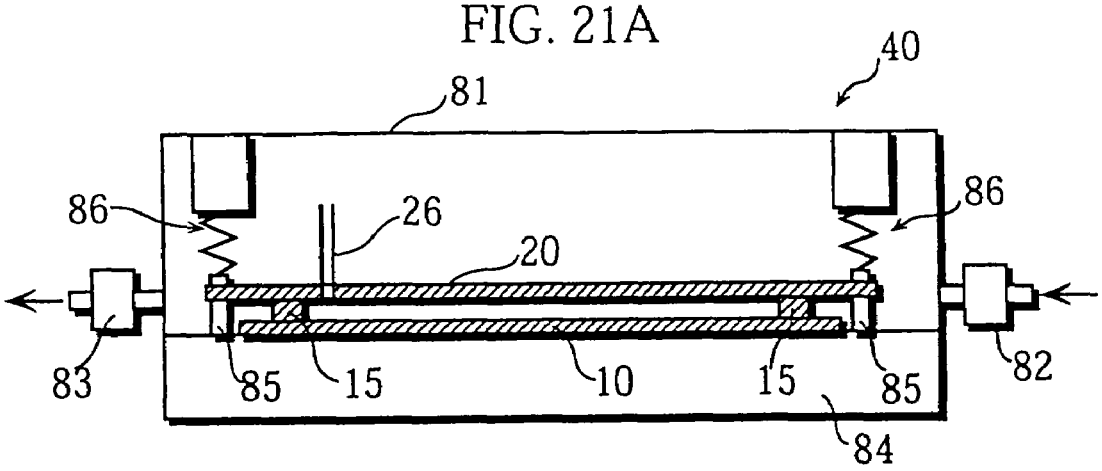
FIGS. 21A to 21C show operations of the bonding apparatus in the preparative heating process and the bonding process.
Figure 21B:
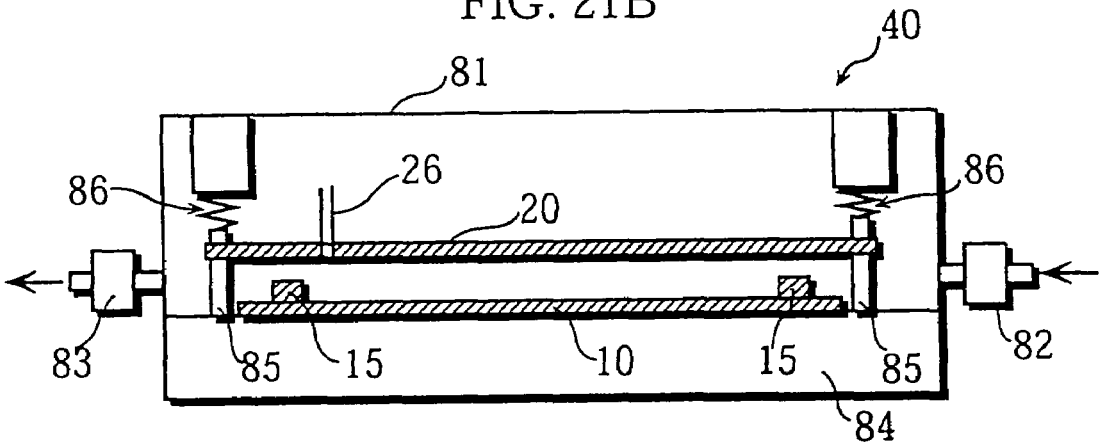
Figure 21C:
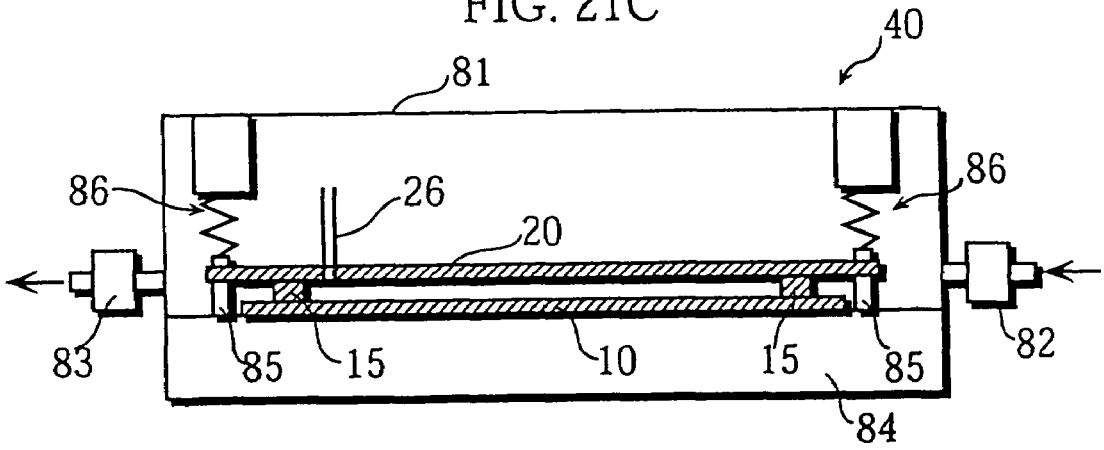

FIGS. 21A to 21C show operations of the bonding apparatus in the preparative heating process and the bonding process.

The temporary baking, preparative heating, and bonding processes will be described with reference to FIGS. 21A to 21C.

Temporary Baking Process

A paste made of a sealing glass (glass frit) is applied to one of: the outer region of the front panel 10 on a side facing the back panel 20; the outer region of the back panel 20 on a side facing the front panel 10; and the outer region of the front panel 10 and the back panel 20 on sides that face each other. The panels with the paste are temporarily baked for 10 to 30 minutes at around 350° C. to form the sealing glass layers 15. Note that in the drawing, the sealing glass layers 15 are formed on the front panel 10.

Preparative Heating Process

First, the front panel 10 and the back panel 20 are put together after positioned properly. The panels are then laid on the base 84 at a fixed position. The pressing mechanisms 86 are then set to press the back panel 20 (FIG. 21A).

The atmospheric gas (dry air) is then circulated in the heating furnace 81 (or, at the same time, gas is exhausted through the gas exhaust valve 83 to produce a vacuum) while the following operations are performed.

The slide pins 85 are hoisted to move the back panel 20 to a position parallel to itself (FIG. 21B). This broadens the space between the front panel 10 and the back panel 20, and the fluorescent substance layers 25 on the back panel 20 are exposed to the large space in the heating furnace 81.

The heating furnace 81 in the above state is heated to let the panels release gas. The preparative heating process ends when a preset temperature (e.g., 400° C.) has been reached.

Bonding Process

The slide pins 85 are lowered to put the front and back panels together again. That is, the back panel 20 is reset to its proper position on the front panel 10 (FIG. 21C).

When the inside of the heating furnace 81 has reached a certain bonding temperature (around 450° C.) higher than the softening point of the sealing glass layers 15, the bonding temperature is maintained for 10 to 20 minutes. During this period, the outer regions of the front panel 10 and the back panel 20 are bonded together by the softened sealing glass. Since the back panel 20 is pressed onto the front panel 10 by the pressing mechanisms 86 during this bonding period, the panels are bonded with high stability.

After the bonding is complete, the pressing mechanisms 86 are released and the bonded panels are removed.

The exhausting process is performed after the bonding process is performed as above.

In the present embodiment, as shown in FIGS. 19 and 20, an air vent 21*a* is formed on the outer region of the back panel 20. The gas exhaust is performed using a vacuum pump (not illustrated) connected to a glass pipe 26 which is attached to the air vent 21*a*. After the exhausting process, the discharge gas is charged into the inner space between the panels through the glass pipe 26. The PDP is then complete after the air vent 21*a* is plugged and the glass pipe 26 is cut away.

Effects of the Manufacturing Method Shown in the Present Embodiment

The manufacturing method of the present embodiment has the following effects which are not obtained from the conventional methods.

As explained in Embodiment 1, with the conventional methods, the flourescent substance layers 25 contacting the inner space between the panels are tend to be degraded by the heat and the gases confined in the space (among the gases, especially by the steam vapor released from the protecting layer 14). The degradation of the flourescent substance layers causes the light-emitting intensity of the layers to decrease (especially the blue flourescent substance layer).

According to the method shown in the present embodiment, though gases like steam vapor held by adsorption on the front and back panels are released during the preparative heating process, the gases are not confined in the inner space since the panels are separated with broad space in between. Further, since the panels are heated to be bonded together immediately after the preparative heating, water and the like are not held by adsorption on the panels after the preparative heating. Therefore, less gas is released from the panels 10 and 20 during the bonding process, preventing the fluorescent substance layer 25 from degrading by heat.

Further, in the present embodiment, the preparative heating process through the bonding process are performed in the atmosphere in which dry air is circulated. Therefore, there is no degradation of the fluorescent substance layer 25 by heat and the steam vapor included in the atmospheric gas.

Another advantage of the present embodiment is that since the preparative heating process and the bonding process are consecutively performed in the same heating furnace 81, the processes can be performed speedily, consuming less energy.

Also, by using the bonding apparatus with the above construction, it is possible to bond the front panel 10 and the back panel 20 at a properly adjusted position.

Studies on Temperature in Preparative Heating and Timing with which Panels are Put Together It is considered to be desirable that the panels are heated to as high a temperature as possible in terms of preventing the fluorescent substance layer 25 from degrading by heat and the gases released from the panels when they are bonded (among the gases, especially by the steam vapor released from the protecting layer 14).

The following experiments were conducted to study the problem in detail.

The amount of steam vapor released from the MgO layer was measured using a TDS analysis apparatus over time while a glass substrate on which the MgO layer is formed as the front panel 10 is gradually heated at a constant heating speed.

Figure 22:
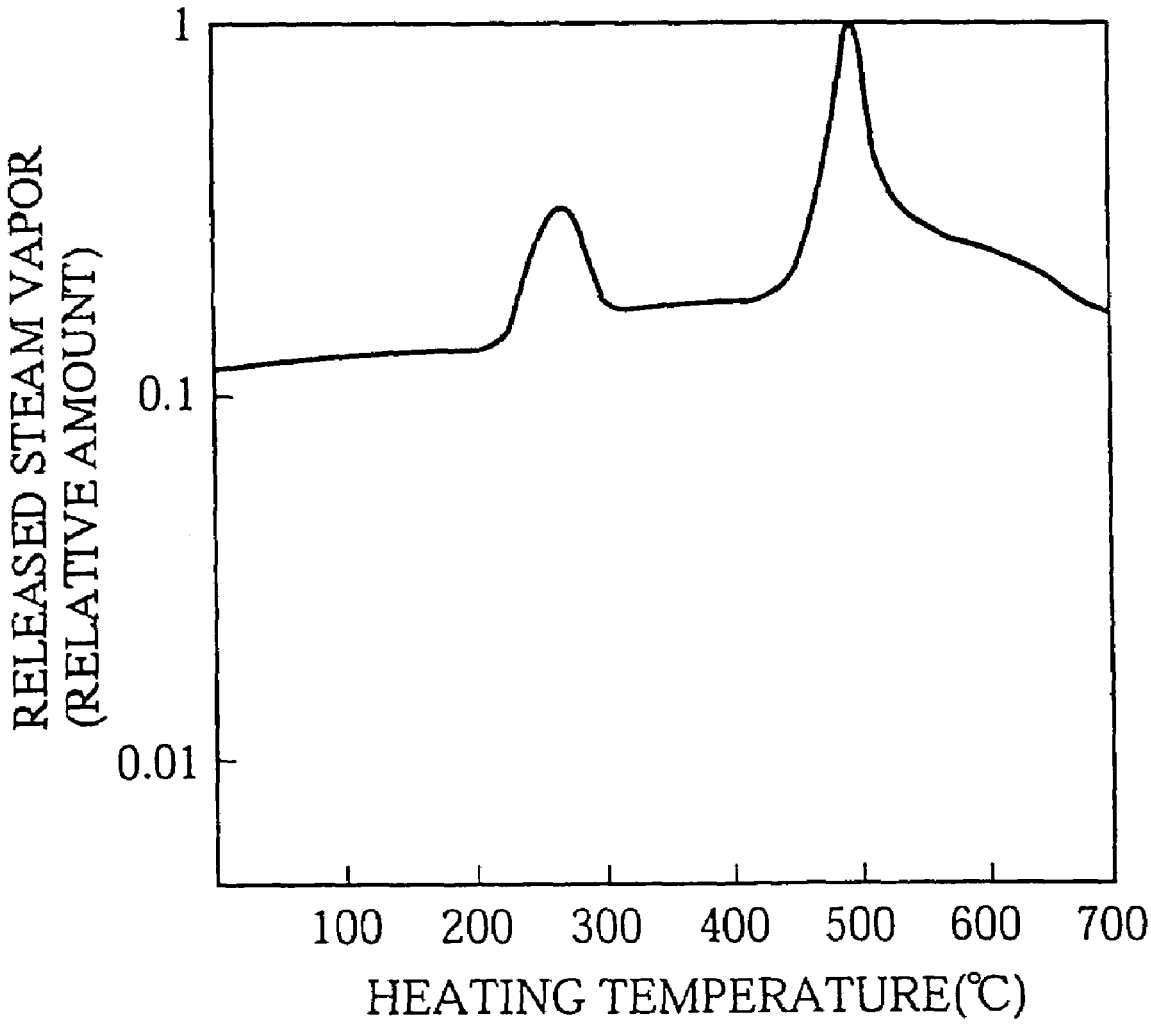
FIG. 22 shows the results of the experiment for Embodiment 5 in which the amount of steam vapor released from the MgO layer is measured over time.

FIG. 22 shows the results of the experiment, or the measured amount of released steam vapor at each heating temperature up to 700° C.

In FIG. 22, the first peak appears at around 200° C. to 300° C., and the second peak at around 450° C. to 500° C.

It is estimated from the results shown in FIG. 22 that a large amount of steam vapor is released at around 200° C. to 300° C. and around 450° C. to 500° C. when the protecting layer 14 is gradually heated.

Accordingly, to prevent the steam vapor released from the protecting layer 14 from being confined in the inner space when the panels are heated during the bonding process, it is considered that the separation of the panels should be maintained while they are heated at least until the temperature rises to around 200° C., preferably to around 300° C. to 400° C.

Also, the release of gas from the panels will be almost completely prevented if the panels are bonded together after they are heated to a temperature higher than around 450° C. while they are separated. In this case, the change of panels over time after they are completed will also be prevented since the panels are bonded together with the fluorescent substance hardly degraded and with almost no chances that the steam vapor held by adsorption on the panels is gradually released during discharging.

However, it is not preferable that this temperature exceeds 520° C. since the fluorescent substance layer and the MgO protective layer are generally formed at the baking temperature of around 520° C. As a result, it is further preferable that the panels are bonded together after they are heated to around 450° C. to 520° C.

On the other hand, the sealing glass will flow out of the position if the panels are heated to a temperature exceeding the softening point of the sealing glass while they are separated. This may inhibit the panels from being bonded with high stability.

From the view point of preventing the degradation of the fluorescent substance layer by the gases released from the panels and in terms of bonding the panels with high stability, the following conclusions (1) to (3) are reached.

(1) It is desirable that the front and back panels are put together and bonded after heated to as high a temperature as possible under the softening point of the used sealing glass while the panels are separated from each other.

Accordingly, when, for example, a conventionally used general sealing glass with softening point of around 400° C. is used, to reduce the bad effect of released gases on the fluorescent substance as much as possible while maintaining the stability of the bonding, the best bonding procedure will be to heat the front and back panels to near 400° C. while separating them, then to put the panels together and heat them to a temperature exceeding the softening point to bond them together.

(2) Here, use of a sealing glass with a higher softening point will increase the heating temperature and enhance the stability of bonding the panels. Accordingly, using such a high-softening point sealing glass to heat the front and back panels to near the softening point, then putting the panels together and heat them to a temperature exceeding the softening point to bond them together will further reduce the bad effect of released gases on the fluorescent substance while maintaining the stability of bonding panels.

(3) On the other hand, it is possible to bond the panels with high stability even if they are heated, while they are separated, to a high temperature exceeding the softening point of the sealing glass if an arrangement is made so that the sealing glass layer formed on the outer region of the front or back panel does not flow out of the position even if it is softened. For example, a partition may be formed between the sealing glass application area and the display area at the outer region of the front or back panel in order to prevent the softened sealing glass from flowing out to the display area.

Accordingly, when the front and back panels are heated to a high temperature exceeding the softening point of the sealing glass after making such an arrangement for preventing the softened sealing glass from flowing out to the display area and then the panels are put together and bonded together, the bad effect of the released gases on the fluorescent substance can be reduced, with the stability in bonding panels being kept.

In the above case, the front and back panels are bonded together directly at a high temperature without being put together first then being heated. As a result, release of gases from the panels after they are put together can almost completely be prevented. This enables the-panels to be bonded together with almost no degradation of the fluorescent substance by heat.

Study on Atmospheric Gas and Pressure

It is desirable that a gas containing oxygen like air is used as the atmospheric gas circulated in the heating furnace 81 during the bonding process. This is because, as described in Embodiment 1, oxide flourescent substances often used for PDPs tend to reduce the light-emitting characteristics when heated in the atmosphere of non oxygen.

A certain degree of effect can be gained when outside air is supplied as the atmospheric gas at normal pressure. However, to enhance the effect of preventing the flourescent substance from degrading, it is desirable to circulate dry gas like dry air in the heating furnace 81, or operate the heating furnace 81 while exhausting gas to produce a vacuum.

The reason it is desirable to circulate dry gas is that there is no worrying that the fluorescent substance is degraded by heat and the steam vapor contained in the atmospheric gas. Also, it is desirable to exhaust gas from the heating furnace 81 to produce a vacuum. This is because gases (steam vapor and the like) released from the panels 10 and 20 as they are heated are effectively exhausted to outside.

When dry gas is circulated as an atmospheric gas, the lower the partial pressure of steam vapor contained in the gas is, the more the blue fluorescent substance layer is prevented from being degraded by heat (see FIGS. 5 and 6 for the experiment results of Embodiment 1). To obtain sufficient effect, it is desirable to set the partial pressure of the steam vapor to 15 Torr or less. This effect becomes more remarkable as the partial pressure of the steam vapor is set to a lower value like 10 Torr or less, 5 Torr or less, 1 Torr or less, 0.1 Torr or less.

Application of Sealing Glass

In the bonding process, the sealing glass is typically applied to only one of the two panels (typically to the back panel only) before the panels are put together.

Meanwhile, in the present embodiment, the back panel 20 is pressed onto the front panel 10 by the pressing mechanisms 86 in the bonding apparatus 80. In this case, it is difficult to give such a strong pressure as is given by clamps.

In such a case, when the sealing glass is applied only to the back panel, there is a possibility that the panels are not completely bonded if the congeniality between the sealing glass and the front panel is not good in relation to adhesion. This defect can be prevent if the sealing glass layer is formed on both the front and back panels. This will increase the manufacturing yield of PDPs.

It should be noted here that the above method of forming the sealing glass layer on both the front and back panels is effective in increasing yields for the general bonding process in manufacturing PDPs.

Variations of Present Embodiment

In the present embodiment, the front panel 10 and the back panel 20 are put together after positioned properly before they are heated. The slide pins 85 are then hoisted to move the back panel 20 upwards and separate the panels. However, the panels 10 and 20 may be separated from each other by other ways.

Figure 23:
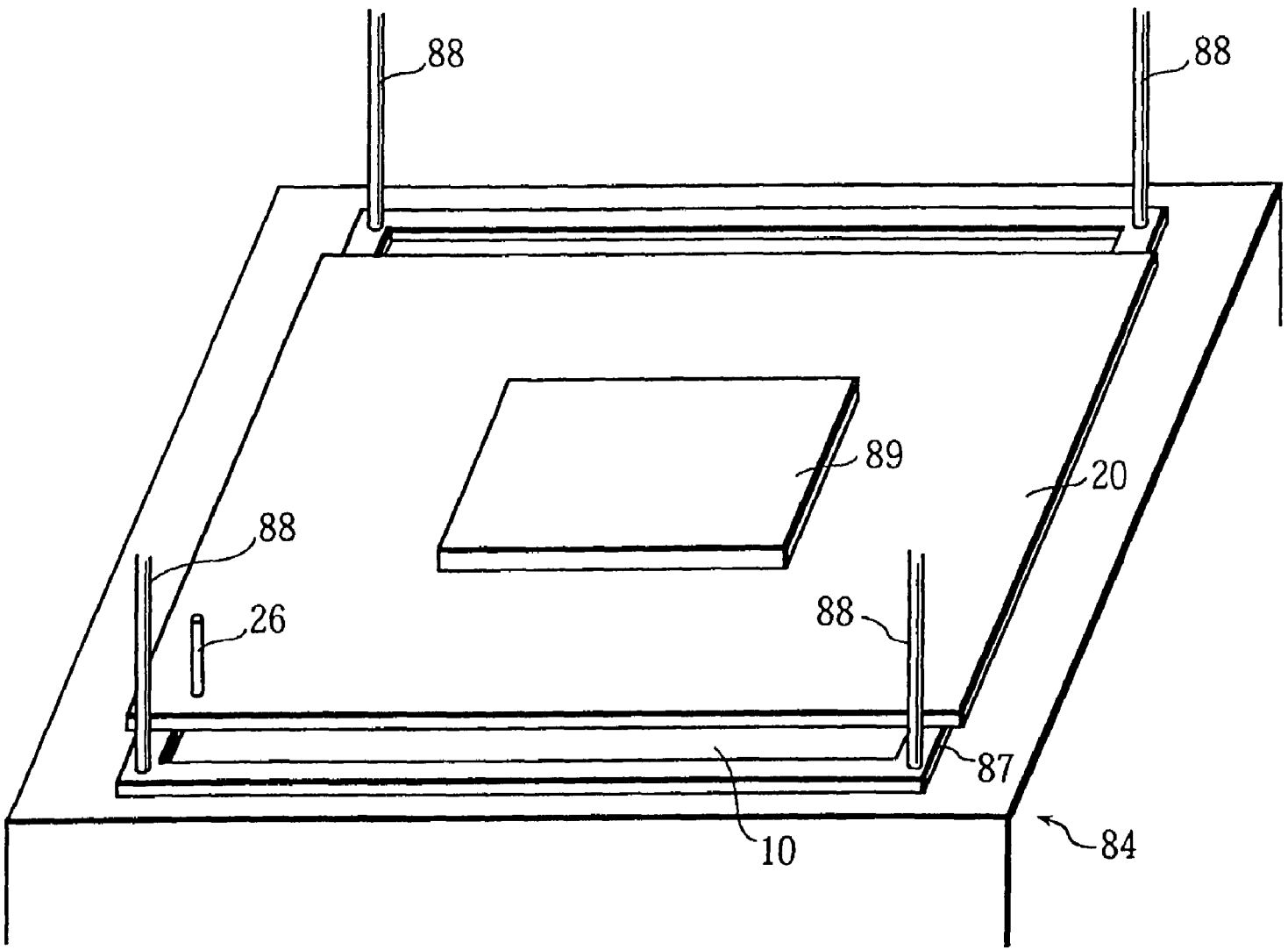
FIG. 23 shows a variation of the bonding apparatus in Embodiment 5.

For example, FIG. 23 shows another way of lifting the back panel 20. In the drawing, the front panel 10 is enclosed with a frame 87, where the front panel 10 fits into the frame 87. The frame 87 can be moved upwards and downwards by rods 88 which are attached to the frame 87 and slide vertically. With such an arrangement, the back panel 20 laid on the frame 87 can also be moved upwards and downwards to positions parallel to itself. That is, the back panel 20 is separated from the front panel 10 when the frame 87 is moved upwards, and the back panel 20 is put together with the front panel 10 when the frame 87 is moved downwards.

There is another difference between the two mechanisms. In the bonding apparatus 80, the back panel 20 is pressed onto the front panel 10 by the pressing mechanisms 86, while in the example shown in FIG. 23, a weight 89 is laid on the back panel 20 instead of the pressing mechanisms 86. In this variation method, when the frame 87 is moved downwards to the bottom, the weight 89 presses the back panel 20 onto the front panel 10 by gravitation.

Figure 24A:
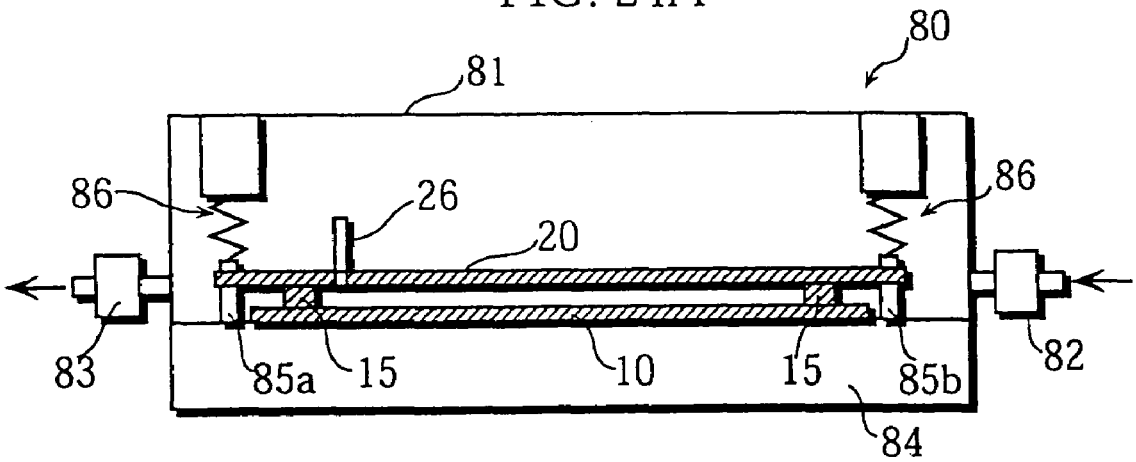
FIG. 24A to 24C show operations performed with another variation of the bonding apparatus in Embodiment 5.
Figure 24B:
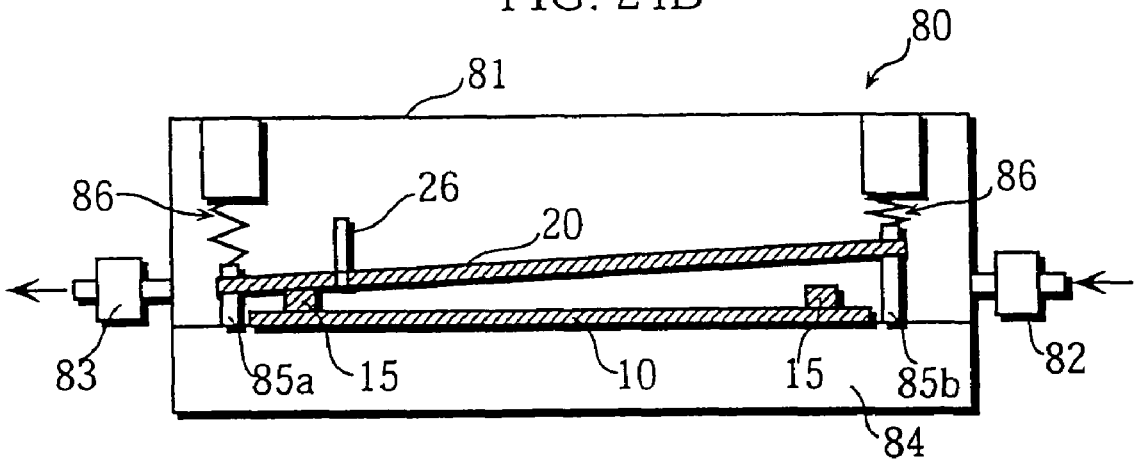
Figure 24C:
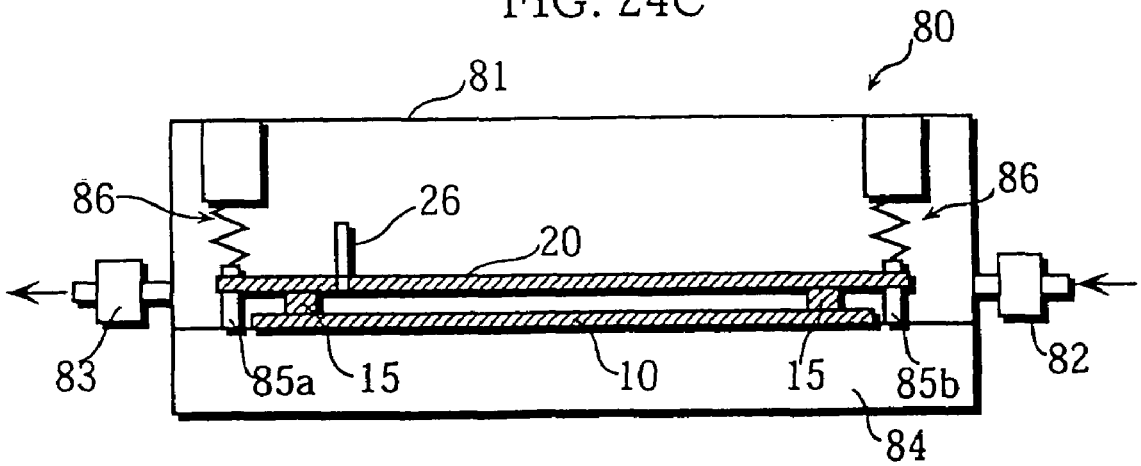

FIGS. 24A to 24C show operations performed during the bonding process in accordance with another variation method.

In the example shown in FIGS. 24A to 24C, the back panel 20 is partially separated from the front panel 10 and restored to the initial position.

On the base 84, as in the case shown in FIG. 20, four pins, or a pair of pins 85*a* and a pair of pins 85*b* are formed on the base 84 corresponding to the four corners of the back panel 20. However, the pins 85*a* corresponding to one side (in FIGS. 24A to 24C, on the left-hand side) of the back panel 20, support the back panel 20 at their edges (e.g., the edge of the pin 85*a* formed in a spherical shape is fitted into a spherical pit formed on the back panel 20), while the pins 85*b* corresponding to the other side (in FIGS. 24A to 24C, on the right-hand side) of the back panel 20 are movable upwards and downwards.

The front panel 10 and the back panel 20 are put together and laid on the base 84 as shown in FIG. 24A. The back panel 20 is rotated about the edge of the pins 85*a* by moving the pins 85*b* upwards as shown in FIG. 24B. This partially separate the back panel 20 from the front panel 10. The back panel 20 is rotated in the reversed direction and restored to the initial position by moving the pins 85*b* downwards as shown in FIG. 24C. That is, the panels 10 and 20 are in the same position as are adjusted properly at first.

The panels 10 and 20 are in contact at the side of pins 85*a* in the stage shown in FIG. 24B. However, gases released from panels are not confined in the inner space since the other side of the panels are open.

EXAMPLE 5

<Table 5>

The panels 41 to 50 are PDPs manufactured based on the present embodiment. The panels 41 to 50 have been manufactured in different conditions during the bonding process. That is, the panels were heated in various types of atmospheric gases under various pressures, and they were put together at various temperatures with various timing.

Each panel had been temporarily baked at 350° C.

For the panels 41 to 46, 48 to 50, dry gases with different partial pressures of steam vapor in the range of 0 Torr to 12 Torr were used as the atmospheric gas. The panel 47 was heated while gas was exhausted to produce a vacuum.

For the panels 43 to 47, the panels were heated from the room temperature to 400° C. (lower than the softening point of sealing glass), then the panels were put together. The panels were further heated to 450° C. (higher than the softening point of sealing glass), the temperature was maintained for 10 minutes then decreased to 350° C., and gas was exhausted while the temperature of 350° C. was maintained.

For the panels 41 and 42, the panels were bonded at lower temperatures of 250° C. and 350° C., respectively.

For the panel 48, the panels were heated to 450° C., then put together at the temperature. For the panel 49, the panels were heated to 500° C. (peak temperature), then put together at the temperature.

TABLE 5

| PANEL No. | TEMPERATURE FOR PUTTING FRONT AND BACK PANELS TOGETHER(° C.) | PEAK TEMPERATURE FOR BONDING PANELS(° C.) | ATMOSPHERE DURING BONDING | PARTIAL PRESSURE OF STEAM VAPOR IN DRY AIR (Torr) | RELATIVE LIGHT-EMITTING INTENSITY OF BLUE LIGHT | CHROMATICITY COORDINATE Y OF BLUE LIGHT | COLOR TEMPERATURE IN WHITE BALANCE (K) |
|---|---|---|---|---|---|---|---|
| 41 | 250 | 450 | DRY AIR | 2 | 107 | 0.078 | 6700 |
| 42 | 350 | 450 | DRY AIR | 2 | 118 | 0.057 | 8600 |
| 43 | 400 | 450 | DRY AIR | 12 | 108 | 0.075 | 7100 |
| 44 | 400 | 450 | DRY AIR | 8 | 112 | 0.065 | 7800 |
| 45 | 400 | 450 | DRY AIR | 2 | 120 | 0.055 | 9000 |
| 46 | 400 | 450 | DRY AIR | 0 | 123 | 0.053 | 9800 |
| 47 | 400 | 450 | VACUUM | — | 120 | 0.053 | 9300 |
| 48 | 450 | 450 | DRY AIR | 2 | 125 | 0.052 | 10600 |
| 49 | 500 | 500 | DRY AIR | 2 | 125 | 0.052 | 10600 |
| 50 | 450 | 480 | DRY AIR | 2 | 126 | 0.052 | 11000 |
| 51 | 450 | 450 | DRY AIR | 2 | 125 | 0.052 | 10600 |
| 52 | — | 450 | DRY AIR | 2 | 100 | 0.090 | 5800 |

| PANEL No. | CHROMATICITY COORDINATE Y OF BLUE LIGHT WHEN BACK PANEL FLUORESCENT SUBSTANCE IS RADIATED BY EXCIMER LAMP | PEAK WAVELENGTH OF BLUE LIGHT (NM) | COLOR TEMPERATURE OF LIGHT WHEN BACK PANEL FLUORESCENT SUBSTANCES OF ALL COLORS ARE RADIATED BY EXCIMER LAMP (K) | PEAK INTENSITY RATIO OF SPECTRUM OF BLUE AND GREEN LIGHT (BLUE/GREEN) | PEAK NUMBER OF MOLECULES IN $H_2O$ GAS DESORBED FROM BLUE FLUORESCENT SUBSTANCE AT 200° C. OR MORE WITH TDS ANALYSIS | AXIS LENGTH RATIO OF BLUE FLUORESCENT SUBSTANCE CRYSTAL (c-AXIS/a-AXIS) |
|---|---|---|---|---|---|---|
| 41 | 0.075 | 455 | 6700 | 0.80 | $1.0 \times 10^{16}$ | 4.02180 |
| 42 | 0.054 | 451 | 8600 | 0.95 | $4.0 \times 10^{15}$ | 4.02172 |
| 43 | 0.073 | 459 | 7100 | 0.82 | $7.3 \times 10^{15}$ | 4.02178 |
| 44 | 0.063 | 452 | 7800 | 0.91 | $5.0 \times 10^{15}$ | 4.02174 |
| 45 | 0.054 | 450 | 9000 | 0.98 | $3.4 \times 10^{15}$ | 4.02168 |
| 46 | 0.052 | 449 | 9800 | 1.09 | $2.2 \times 10^{15}$ | 4.02164 |
| 47 | 0.052 | 449 | 9300 | 1.03 | $1.3 \times 10^{15}$ | 4.02163 |
| 48 | 0.051 | 448 | 10600 | 1.15 | $1.9 \times 10^{15}$ | 4.02160 |
| 49 | 0.051 | 448 | 10600 | 1.15 | $1.9 \times 10^{15}$ | 4.02160 |
| 50 | 0.051 | 448 | 11000 | 1.19 | $1.3 \times 10^{15}$ | 4.02155 |
| 51 | 0.051 | 448 | 10600 | 1.15 | $1.9 \times 10^{15}$ | 4.02160 |
| 52 | 0.088 | 458 | 5800 | 0.67 | $2.6 \times 10^{16}$ | 4.02208 |

For the panel 50, the panels were heated to the peak temperature of 480° C. then decreased to 450° C., and the panels were put together and bonded at 450° C.

The panel 51 is a PDP manufactured based on a variation of Embodiment 5 shown in FIGS. 24A to 24C in which the panels were heated to 450° C. (peak temperature), then put together and bonded at the temperature.

The panel 52 is a comparative PDP manufactured by putting the panels together at room temperature then bonding them by heating them to 450° C. in dry air at atmospheric pressure.

Note that in each of the PDPs 41 to 52, the thickness of the flourescent substance layer is 30 μm, and the discharge gas, Ne(95%)-Xe(5%), was charged with the charging pressure 500 Torr so that each has the same panel construction.

Test for Light Emitting Characteristics

For each of the PDPs 41 to 52, the relative light-emitting intensity of the emitted blue light, the chromaticity coordinate y of the emitted blue light, the peak wavelength of the emitted blue light, the panel luminance and the color temperature in the white balance without color correction, and the ratio of the peak intensity of the spectrum of light emitted from the blue cells to that of the green cells were measured as the light emitting characteristics.

Each of the manufactured PDPs was disassembled and vacuum ultraviolet rays (central wavelength is 146 nm) were radiated onto the blue fluorescent substance layers of the back panel using a krypton excimer lamp. The chromaticity coordinate y of blue light was then measured.

The results are shown in Table 5. Note that the relative light-emitting intensity values for blue light shown in Table 5 are relative values when the measured light-emitting intensity of the panel 52, a comparative example, is set to 100 as the standard value.

Also, each of the manufactured PDPs was disassembled and vacuum ultraviolet rays were radiated onto the blue fluorescent substance layers of the back panel using a krypton excimer lamp. The color temperature when light was emitted from all of the blue, red, and green cells, and the ratio of the peak intensity of the spectrum of light emitted from the blue cells to that of the green cells were then measured. The results were the same as the above ones.

Figure 25:
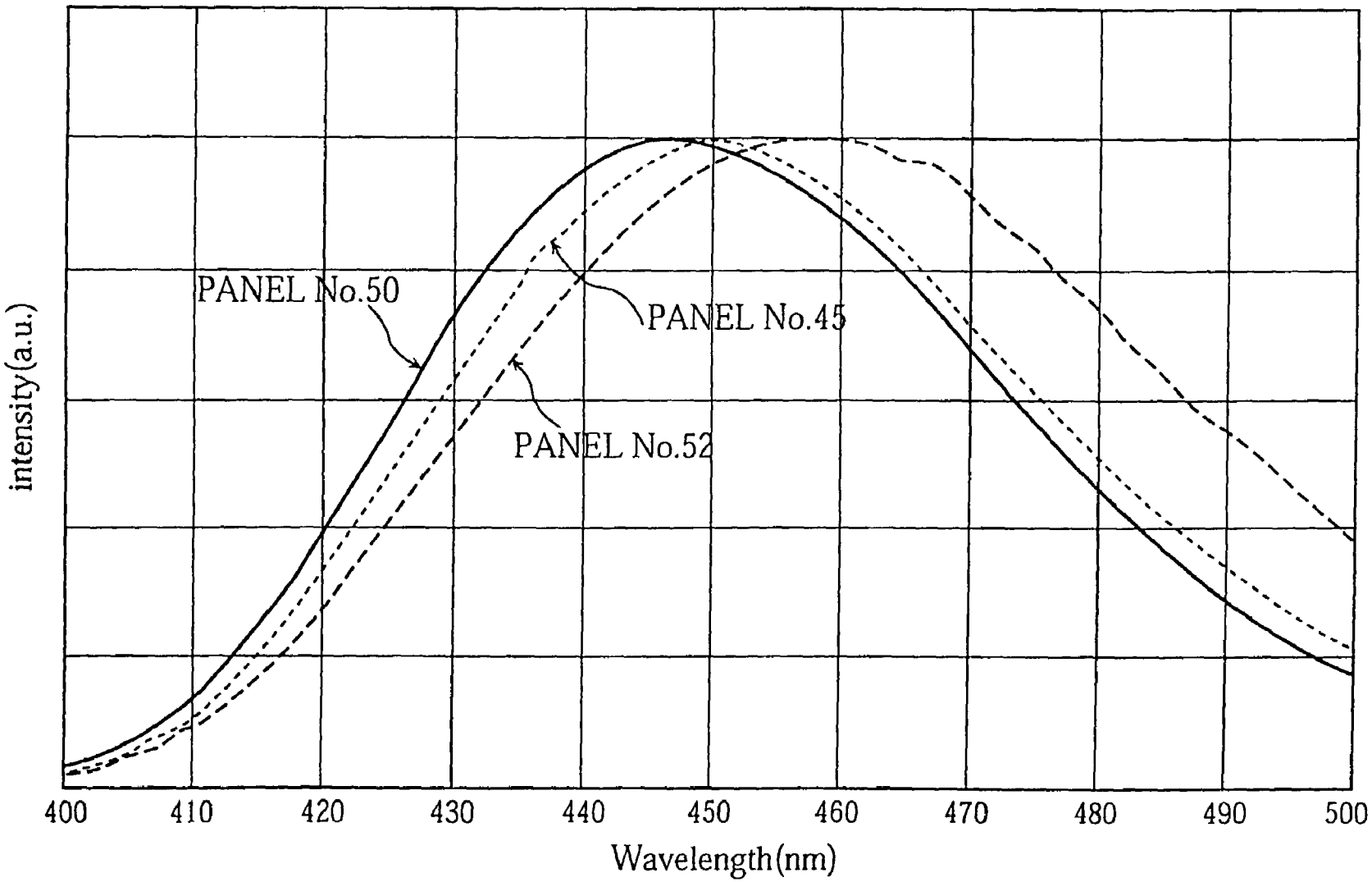
FIG. 25 shows spectra of light emitted from only blue cells of the PDPs of Embodiment 5.

FIG. 25 shows spectra of light emitted from only blue cells of the PDPs of panels 45, 50, and 52.

Though Table 5 does not show, the chromaticity coordinate x and y of light emitted from the red and green cells of 41 to 53 were substantially the same: red (0.636, 0.350), green (0.251, 0.692). In the comparative PDP, the chromaticity coordinate x and y of light emitted from blue cells was (0.170, 0.090), and the peak wavelength was 458 nm in the spectrum of the emitted light.

The blue fluorescent substances were then taken out from the panel. The number of molecules contained in one gram of $H_2O$ gas desorbed from the blue fluorescent substances was measured using the TDS analysis method. Also, the ratio of c-axis length to a-axis length of the blue fluorescent substance crystal was measured by the X-ray analysis. The results are also shown in Table 5.

Study

It is noted that the panels 41 to 51 have light emitting characteristics superior to those of the panel 52 (with higher light-emitting intensity of blue light and smaller chromaticity coordinate y). It is thought that this is because a smaller amount of gas is released in the inner space between panels after the panels are bonded in accordance with the present embodiment than in accordance with conventional methods.

In the PDP of panel 52, the chromaticity coordinate y of the light emitted from blue cells is 0.088 and the color temperature in the white balance without color correction is 5800K. In contrast, in panels 41 to 51, the values are respectively 0.08 or less and 6500K or more. Especially, it is noted that in panels 48 to 51 that have low chromaticity coordinate y of blue light, a high color temperature of around 11,000K has been achieved (in the white balance without color correction).

Figure 26:
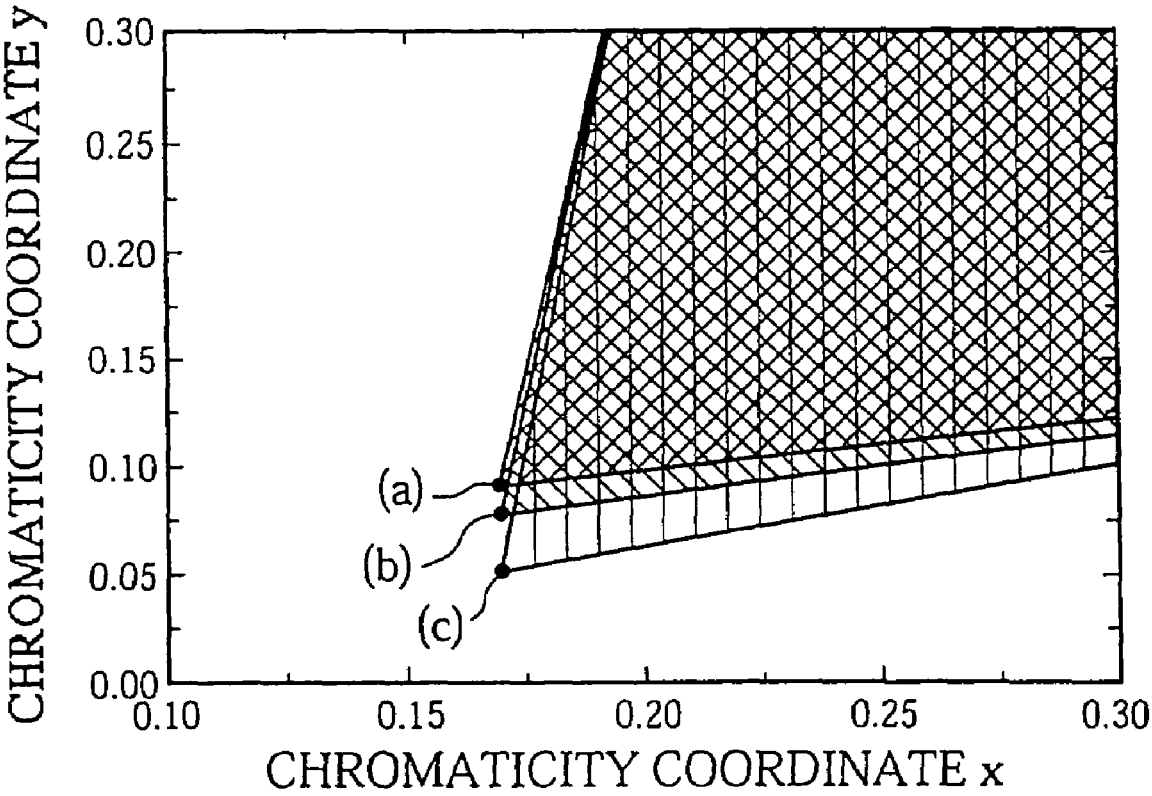
FIG. 26 is a CIE chromaticity diagram on which the color reproduction areas around blue color are shown in relation to the PDPs of Embodiment 5 and the comparative PDP.

FIG. 26 is a CIE chromaticity diagram on which the color reproduction areas around blue color are shown in relation to the PDPs of the present embodiment and the comparative example.

In the drawing, the area (a) indicates the color reproduction area around blue color for a case (corresponding to panel 52) in which the chromaticity coordinate y of blue light is about 0.09 (the peak wavelength of spectrum of emitted light is 458 nm), the area (b) indicates the color reproduction area around blue color for a case (corresponding to panel 41) in which the chromaticity coordinate y of blue light is about 0.08 (the peak wavelength of spectrum of emitted light is 455 nm), and the area (c) indicates the color reproduction area around blue color for a case (corresponding to panel 50) in which the chromaticity coordinate y of blue light is about 0.052 (the peak wavelength of spectrum of emitted light is 448 nm).

It is noted from the drawing that the color reproduction area around blue color expands in the order of area (a), (b), (c). This shows that it is possible to manufacture a PDP in which the smaller the chromaticity coordinate y of blue light is (the shorter the peak wavelength of the spectrum of emitted light is), the broader the color reproduction area around blue color is.

By comparing the light-emitting characteristics of the panels 41, 42, 45, and 48 (in each of which the partial pressure of steam vapor in the dry gas is 2 Torr), it is noted that the light-emitting characteristics are improved in the order of panels 41, 42, 45, and 48 (the light-emitting intensity increases and the chromaticity coordinate y decreases). This shows that the higher a degree the heating temperature in bonding the front panel 10 and back panel 20 is set to, the more the light-emitting characteristics of the PDPs are improved.

This is considered to be because when the panels are preparatively heated to a high temperature while they are separated from each other before they are bonded, a smaller amount of gas is released in the inner space between panels after the panels are bonded since the gas released from the panels is exhausted sufficiently.

By comparing the light-emitting characteristics of the panels 43 to 46 (which have the same temperature profile in the bonding process), it is noted that the light-emitting characteristics are improved in the order of panels 43, 44, 45, and 46 (the chromaticity coordinate y decreases in the order). This shows that the lower the partial pressure of steam vapor in the atmospheric gas is, the more the light-emitting characteristics of the PDPs are improved.

By comparing the light-emitting characteristics of the panels 46 and 47 (which have the same temperature profile in the bonding process), it is noted that the panel 46 is a little superior to the panel 47.

It is considered that this is because a part of oxygen came out of the flourescent substance being an oxide and the oxygen defect was caused in the panel 47 since it was preparatively heated in the atmosphere of non oxygen, while the panel 46 was preparatively heated in the atmospheric gas containing oxygen.

It is noted that the light-emitting characteristics of the panels 48 and 51 are almost the same. This shows that there is hardly a difference in terms of the light-emitting characteristics of PDPS between a case in which the panels are preparatively heated while they are completely separated from each other and a case in which they are partially separated.

It is noted from Table 5 that the values of the chromaticity coordinate y are almost the same regardless whether they are measured by radiating vacuum ultraviolet rays onto the blue fluorescent substance layer or by emitting light from only the blue fluorescent substance layer.

By focusing attention on the relationships between the chromaticity coordinate y of the emitted blue light and the peak wavelength of the emitted blue light for each panel provided in Table 5, it is noted that the peak wavelength is shorter as the chromaticity coordinate y is smaller. This shows that they are proportional to each other.

<Embodiment 6>

The PDP of the present embodiment has the same construction as that of Embodiment 1.

The manufacturing method of the PDP is also the same as Embodiment 5 except that after the sealing glass is applied to at least one of the front panel 10 and the back panel 20, the temporary baking process, the bonding process, and the exhausting process are consecutively performed in the heating furnace 81 of the bonding apparatus 80.

The temporary baking process, the bonding process, and the exhausting process of the present embodiment will be described in detail.

These processes are performed using the bonding apparatus shown in FIGS. 19 and 20. However, in the present embodiment, as shown in FIGS. 27A to 27C, a pipe 90 is inserted from outside the heating furnace 81 and connected to the glass pipe 26 which is attached to the air vent 21*a* of the back panel 20.

Figure 27A:
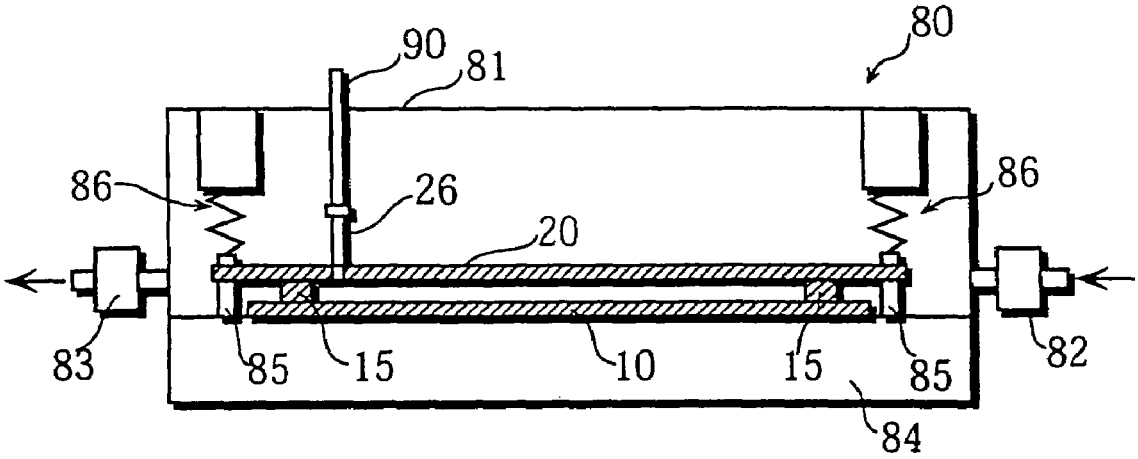
FIGS. 27A, 27B, and 27C show operations performed in the temporary baking process through the exhausting process using the bonding apparatus of Embodiment 6.
Figure 27B:
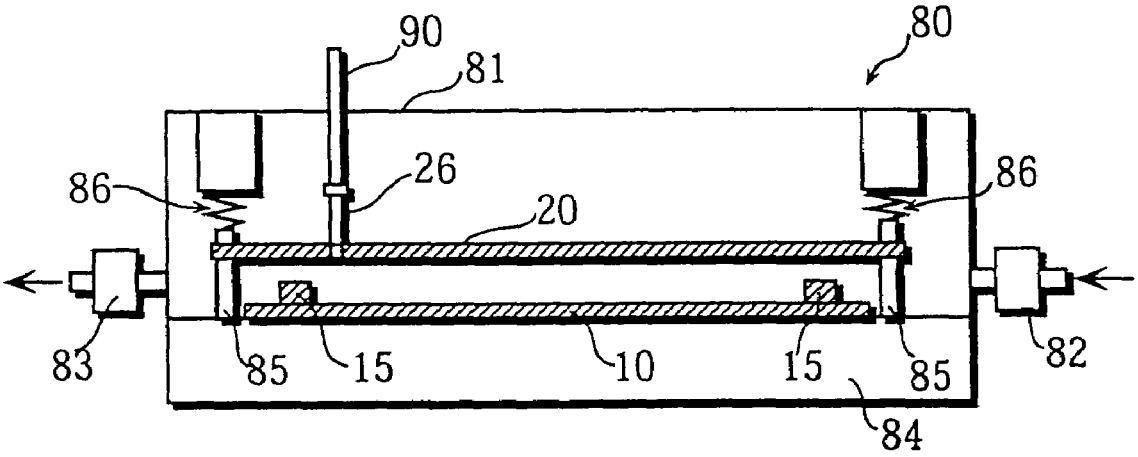
Figure 27C:
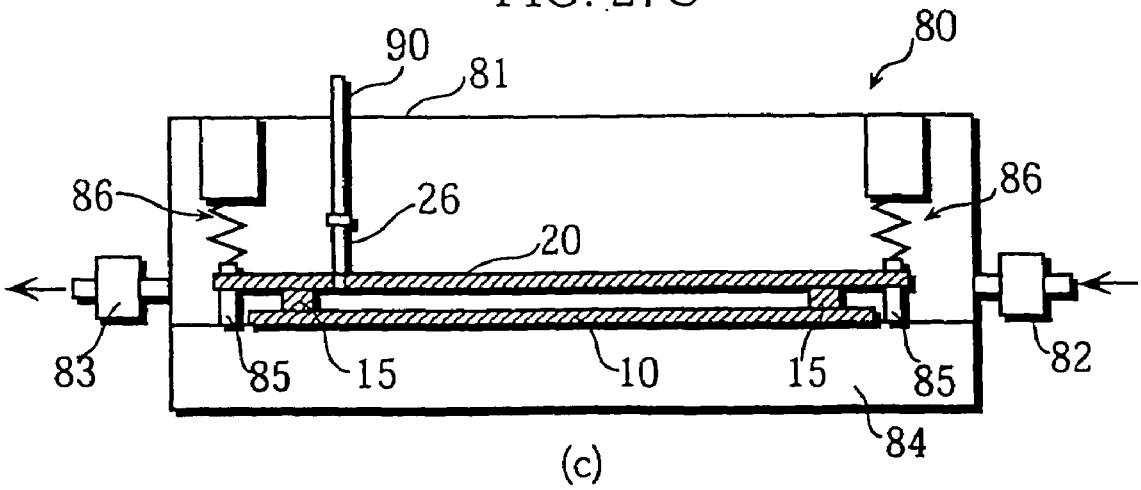

FIGS. 27A, 27B, and 27C show operations performed in the temporary baking process through the exhausting process using the bonding apparatus.

The temporary baking process, the bonding process, and the exhausting process will be described with reference to these figures.

Temporary Baking Process

A sealing glass paste is applied to one of: the outer region of the front panel 10 on a side facing the back panel 20; the outer region of the back panel 20 on a side facing the front panel 10; and the outer region of the front panel 10 and the back panel 20 on sides that face each other. Note that in the drawings, the sealing glass layers 15 are formed on the front panel 10.

The front panel 10 and the back panel 20 are put together after positioned properly. The panels are then laid on the base 84 at a fixed position. The pressing mechanisms 86 are then set to press the back panel 20 (FIG. 27A).

The atmospheric gas (dry air) is then circulated in the heating furnace 81 (or, at the same time, gas is exhausted through the gas exhaust valve 83 to produce a vacuum) while the following operations are performed.

The slide pins 85 are hoisted to move the back panel 20 to a position parallel to itself (FIG. 27B). This broadens the space between the front panel 10 and the back panel 20, and the fluorescent substance layers 25 on the back panel 20 are exposed to the large space in the heating furnace 81.

The heating furnace 81 in the above state is heated to the temporary baking temperature (about 350° C.) then the panels are temporarily heated for 10 to 30 minutes at the temperature.

Preparative Heating Process

The panels 10 and 20 are further heated to let the panels release gas having been held by adsorption on the panels. The preparative heating process ends when a preset temperature (e.g., 400° C.) has been reached.

Bonding Process

The slide pins 85 are lowered to put the front and back panels together again. That is, the back panel 20 is reset to its proper position on the front panel 10 (FIG. 27C).

When the inside of the heating furnace 81 has reached a certain bonding temperature (around 450° C.) higher than the softening point of the sealing glass layers 15, the bonding temperature is maintained for 10 to 20 minutes. During this period, the outer regions of the front panel 10 and the back panel 20 are bonded together by the softened sealing glass. Since the back panel 20 is pressed onto the front panel 10 by the pressing mechanisms 86 during this bonding period, the panels are bonded with high stability.

Exhausting Process

The interior of the heating furnace is cooled to an exhaust temperature lower than the softening point of the sealing glass layers 15. The panels are baked at the temperature (e.g., for one hour at 350° C.). Gas is exhausted from the inner space between the bonded panels to produce a high degree of vacuum (8×10 Torr). The exhausting process is performed using a vacuum pump (not illustrated) connected to the pipe 90.

The panels are then cooled to room temperature while the vacuum of the inner space is maintained. The discharge gas is charged into the inner space through the glass pipe 26. The PDP is complete after the air vent 21*a* is plugged and the glass pipe 26 is cut away.

Effects of the Manufacturing Method Shown in the Present Embodiment

The manufacturing method of the present embodiment has the following effects which are not obtained by the conventional methods.

Conventionally, the temporary baking process, the bonding process, and the exhausting process are separately performed using a heating furnace, and the panels are cooled to room temperature at each interval between processes. With such a construction, it requires a long time and consumes much energy for the panels to be heated in each process. On the contrary, in the present embodiment, these processes are consecutively performed in the same heating furnace without lowering the temperature to room temperature. This reduces the time and energy required for heating.

In the present embodiment, the temporary baking process through the bonding process are performed speedily and with low energy consumption since the temporary baking process and the preparative heating process are performed in the middle of heating the heating furnace 81 to the temperature for the bonding process. Furthermore, in the present embodiment, the bonding process through the exhausting process are performed speedily and with low energy consumption the exhausting process is performed in the middle of cooling the panels to room temperature after the bonding process.

Further, the present embodiment has the same effects as Embodiment 5 compared to conventional bonding methods as will be described.

In general, gases like steam vapor are held by adsorption on the surface of the front panel and back panel. The adsorbed gases are released when the panels are heated.

In conventional methods, in the bonding process after the temporary baking process, the front panel and the back panel are first put together at room temperature, then they are heated to be bonded together. In the bonding process, the gases held by adsorption on the surface of the front panel and back panel are released. Though a certain amount of the gases are released in the temporary baking process, gases are newly held by adsorption when the panels are laid in the air to room temperature before the bonding process begins, and the gases are released in the bonding process. The released gases are confined in the small space between the panels. When this happens, the flourescent substance layers are tend to be degraded by the heat and the gases, especially by steam vapor released from the protecting layer 14. The degradation of the flourescent substance layers decreases the light-emitting intensity of the layers.

On the other hand, according to the manufacturing method shown in the present embodiment, the gas released from the panels are not confined in the inner space since a broad gap is formed between the panels in the bonding process or the preparative heating process. Also, water or the like is not held by adsorption on the panels after the preparative heating process since the panels are consecutively heated in the bonding process following the preparative heating process. Therefore, a small amount of gas is released from the panels during the bonding process. This prevents the fluorescent substance layer 25 from being degraded by heat.

Also, it is possible with the bonding apparatus 80 of the present embodiment to bond the panels at a proper position when the position is properly adjusted at first.

Further, in the present embodiment, the preparative heating process through the bonding process are performed in the atmosphere in which dry gas is circulated. This prevents the fluorescent substance layer 25 from being degraded by heat and the steam vapor contained in the atmospheric gas.

The preferable conditions for the present embodiment in terms of: the temperature in the preparative heating; the timing with which the panels are put together; the type of atmospheric gas; the pressure; and the partial pressure of steam vapor are the same as described in Embodiment 5.

Variations of Present Embodiment

In the present embodiment, the temporary baking process, the preparative heating process, the bonding process, and the exhausting process are consecutively performed in the same apparatus. However, the same effects are obtained to some extent when the preparative heating process is omitted. Also, the same effects are obtained to some extent if only the temporary baking process and the bonding process are consecutively performed in the same apparatus, or if only the bonding process and the exhausting process are consecutively performed in the same apparatus.

In the present embodiment, the interior of the heating furnace is cooled to an exhaust temperature (350° C.) lower than the softening point of the sealing glass after the bonding process and gas is exhausted at the temperature. However, it is possible to exhaust gas at a temperature as high as that in the bonding process. In this case, the gas is exhausted sufficiently in a short time. However, to do this, it is thought that some arrangement should be made so that the sealing glass layer does not flow out of the position even if it is softened (e.g., a partition shown in FIGS. 10 to 16).

In the present embodiment, the temporary baking process and the preparative heating process are performed while the front panel 10 and the back panel 20 are separated from each other. However, it is possible to consecutively perform the temporary baking process, bonding process, and exhausting process adopting the method of Embodiment 3 in which the panels are put together after properly positioned, then the panels are heated to be bonded while the pressure of the inner space is reduced and dry air is supplied to the inner space.

The above method will be detailed. The heating-for-sealing apparatus 50 shown in FIG. 4 is used. First, the sealing glass is applied onto one or both of the front panel 10 and back panel 20 to form the sealing glass layer 15. The panels 10 and 20 are properly positioned then put together without being temporarily baked, and placed in the heating furnace 51.

A pipes 52*a* is connected to the glass pipes 26*a* which is attached to the air vent 21*a* of the back panel 20. Gas is exhausted from the space through the pipe 52*b* using a vacuum pump (not illustrated). At the same time, dry air is supplied into the inner space through a pipe 52*b* connected to the glass pipes 26*b* which is attached to the air vent 21*b* of the back panel 20. By doing so, the pressure of the inner space is reduced while dry air is flown through the inner space.

With the above state of the space between the panel 10 and 20 maintained, the interior of the heating furnace 51 is heated to a temporary baking temperature and the panels are temporarily baked (for 10 to 30 minutes at 350° C.).

Here, the panels are not baked sufficiently in the temporarily baking if they are simply baked after they are put together since it is difficult for oxygen to be supplied to the sealing glass layer. However, the panels are sufficiently baked if they are baked while dry air is flown through the inner space between the panels.

The temperature is raised to a certain bonding temperature higher than the softening point of the sealing glass and the bonding temperature is maintained for a certain period (e.g., the peak temperature of 450° C. is kept for 30 minutes). During this period, the front panel 10 and the back panel 20 are bonded together by the softened sealing glass.

The interior of the heating furnace 51 is cooled to an exhaust temperature lower than the softening point of the sealing glass. Gas is exhausted from the inner space between the bonded panels to produce a high degree of vacuum by maintaining the exhaust temperature. After this exhausting process, the panels are cooled to room temperature. The discharge gas is charged into the inner space through the glass pipe 26. The PDP is complete after the air vent 21*a* is plugged and the glass pipe 26 is cut away.

In this variation example, as in the method of the present embodiment, the temporary baking, bonding, and exhausting processes are consecutively performed in the same bonding apparatus while the temperature does not decrease to room temperature. Therefore, these process are also performed speedily and with low energy consumption.

In this variation example, the same effects are obtained to some extent if only the temporary baking process and the bonding process are consecutively performed in the heating furnace 51, or if only the bonding process and the exhausting process are consecutively performed in the heating furnace 51.

EXAMPLE 6

<Table 6>

TABLE 6

| PANEL No. | TEMPERATURE FOR TEMPORARILY BAKING FRIT(° C.) | TEMPERATURE FOR PUTTING FRONT AND BACK PANELS TOGETHER(° C.) | TEMPERATURE FOR BONDING PANELS(° C.) | TEMPERATURE FOR EXHAUSTING GAS(° C.) | ATMOSPHERE DURING BONDING | PARTIAL PRESSURE OF STEAM VAPOR IN DRY AIR (Torr) |
|---|---|---|---|---|---|---|
| 61 | 350 | 250 | 450 | 350 | DRY AIR | 2 |
| 62 | 350 | 350 | 450 | 350 | DRY AIR | 2 |
| 63 | 350 | 400 | 450 | 350 | DRY AIR | 12 |
| 64 | 350 | 400 | 450 | 350 | DRY AIR | 8 |
| 65 | 350 | 400 | 450 | 350 | DRY AIR | 2 |
| 66 | 350 | 400 | 450 | 350 | DRY AIR | 0 |
| 67 | 350 | 400 | 450 | 350 | VACUUM | — |
| 68 | 350 | 450 | 450 | 350 | DRY AIR | 2 |
| 69 | 350 | 480 | 450 | 350 | DRY AIR | 2 |
| 70 | 350 | — | 450 | 350 | AIR | — |

| PANEL No. | RELATIVE LIGHT-EMITTING INTENSITY OF BLUE LIGHT | CHROMATICITY COORDINATE Y OF BLUE LIGHT | COLOR TEMPERATURE IN WHITE BALANCE (K) | PEAK INTENSITY RATIO OF SPECTRUM OF BLUE AND GREEN LIGHT (BLUE/GREEN) | PEAK NUMBER OF MOLECULES IN H2O GAS DESORBED FROM BLUE FLUORESCENT SUBSTANCE AT 200° C. OR MORE WITH TDS ANALYSIS | AXIS LENGTH RATIO OF BLUE FLUORESCENT SUBSTANCE CRYSTAL (c-AXIS/a-AXIS) |
|---|---|---|---|---|---|---|
| 61 | 107 | 0.078 | 6700 | 0.80 | $1.0 \times 10^{16}$ | 4.02180 |
| 62 | 118 | 0.057 | 8600 | 0.95 | $4.0 \times 10^{15}$ | 4.02172 |
| 63 | 108 | 0.075 | 7100 | 0.82 | $7.3 \times 10^{15}$ | 4.02178 |
| 64 | 112 | 0.065 | 7800 | 0.91 | $5.2 \times 10^{15}$ | 4.02174 |
| 65 | 120 | 0.055 | 9000 | 0.98 | $3.4 \times 10^{15}$ | 4.02168 |
| 66 | 123 | 0.053 | 9800 | 1.09 | $2.3 \times 10^{15}$ | 4.02165 |
| 67 | 120 | 0.053 | 9300 | 1.03 | $1.3 \times 10^{15}$ | 4.02155 |
| 68 | 125 | 0.052 | 10600 | 1.15 | $1.9 \times 10^{15}$ | 4.02160 |
| 69 | 126 | 0.052 | 11000 | 1.19 | $1.3 \times 10^{15}$ | 4.02155 |
| 70 | 100 | 0.090 | 5800 | 0.67 | $2.6 \times 10^{16}$ | 4.02208 |

The panels 61 to 69 are PDPs manufactured based on the present embodiment. The panels 61 to 69 have been manufactured in different conditions during the bonding process. That is, the panels were heated in various types of atmospheric gases under various pressures, and they were put together at various temperatures with various timing.

Figure 28:
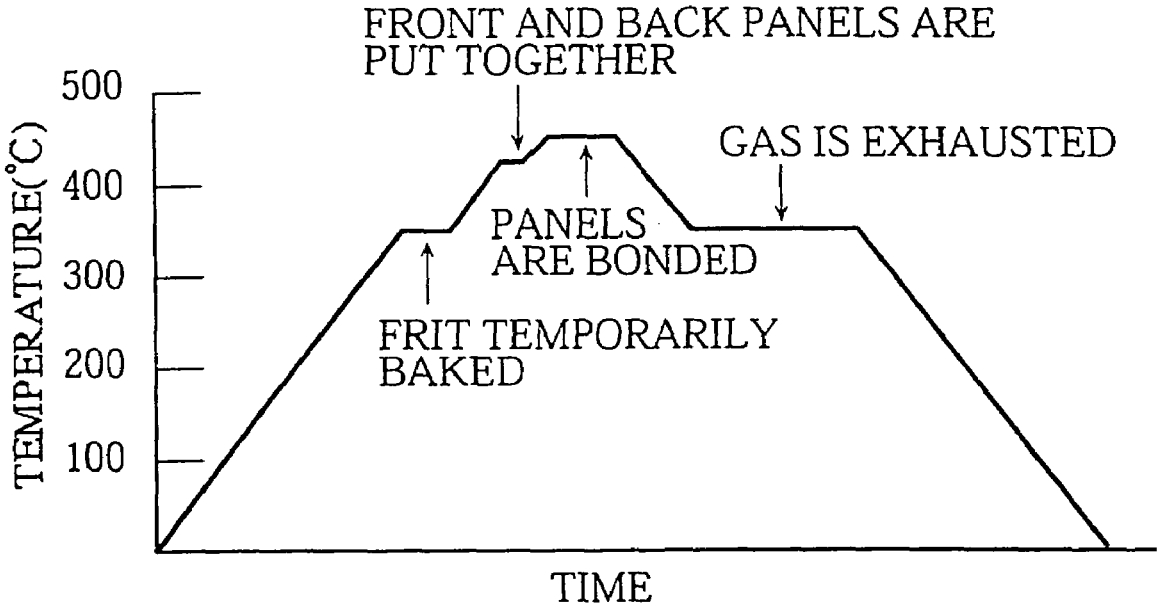
FIG. 28 shows the temperature profile used in the temporary baking process, bonding process, and exhausting process in manufacturing the panels of Embodiment 6.
Figure 29:
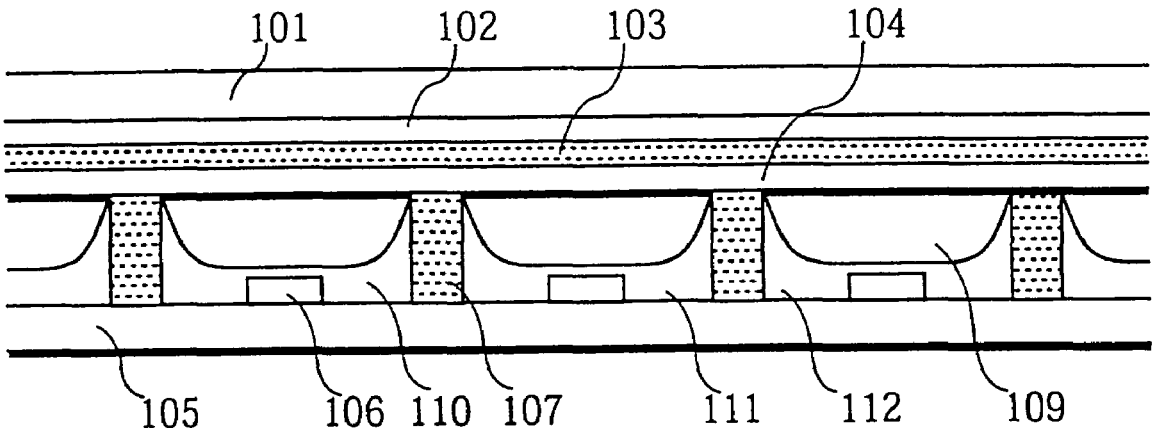
FIG. 29 is a sectional view showing a general AC-type PDP.

FIG. 28 shows the temperature profile used in the temporary baking process, bonding process, and exhausting process in manufacturing the panels 63 to 67.

For the panels 61 to 66, 68, and 69, dry air with different partial pressures of steam vapor in the range of 0 Torr to 12 Torr were used. For panel 70, non-dry air was used. The panel 67 was heated while gas was exhausted to produce a vacuum.

For the panels 63 to 67, the panels were heated from the room temperature to 350° C. The panels were temporarily baked by maintaining the temperature for 10 minutes. The panels were then heated to 400° C. (lower than the softening point of sealing glass), then the panels were put together. The panels were further heated to 450° C. (higher than the softening point of sealing glass), the temperature was maintained for 10 minutes then decreased to 350° C., and gas was exhausted while the temperature of 350° C. was maintained.

For the panels 61 and 62, the panels were bonded at lower temperatures of 250° C. and 350° C., respectively.

For the panel 68, the panels were heated to 450° C., then put together at the temperature. For the panel 69, the panels were heated to the peak temperature of 480° C. then decreased to 450° C., and the panels were put together and bonded at 450° C.

The panel 70 is a comparative PDP manufactured based on a conventional method in which the panels were temporarily baked, put together at room temperature, heated to a bonding temperature of 450° C. in air at the atmospheric pressure, and bonded at 450° C. The panels were then cooled to room temperature once, then heated again in the heating furnace to an exhaust temperature of 350° C. Gas was exhausted from the space by maintaining the temperature at 350° C.

Note that in each of the PDPs 61 to 70, the thickness of the flourescent substance layer is 30 μm, and the discharge gas, Ne(95%)-Xe(5%), was charged with the charging pressure 500 Torr so that each has the same panel construction.

Test for Light Emitting Characteristics

For each of PDPs 61 to 70, the relative light-emitting intensity of the emitted blue light, the chromaticity coordinate y of the emitted blue light, the peak wavelength of the emitted blue light, the color temperature in the white balance without color correction, and the ratio of the peak intensity of the spectrum of light emitted from the blue cells to that of the green cells were measured as the light emitting characteristics.

The results are shown in Table 6. Note that the relative light-emitting intensity values for blue light shown in Table 6 are relative values when the measured light-emitting intensity of the panel 70, a comparative example, is set to 100 as the standard value.

Each of the manufactured PDPs was disassembled and vacuum ultraviolet rays were radiated onto the blue fluorescent substance layers of the back panel using a krypton excimer lamp. The chromaticity coordinate y of the emitted blue light, the color temperature when light was emitted from all of the blue, red, and green cells, and the ratio of the peak intensity of the spectrum of light emitted from the blue cells to that of the green cells were then measured. The results were the same as the above ones.

The blue fluorescent substances were then taken out from the panel. The number of molecules contained in one gram of $H_2O$ gas desorbed from the blue fluorescent substances was measured using the TDS analysis method. Also, the ratio of c-axis length to a-axis length of the blue fluorescent substance crystal was measured by the X-ray analysis. The results are also shown in Table 6.

Study

For each of the PDPs 61 to 70, the light-emitting intensity of the emitted blue light, the chromaticity coordinate y of the emitted blue light, the peak wavelength of the emitted blue light, and the color temperature in the white balance without color correction (a color temperature when light is emitted from the blue, red, and green cells with the same power to produce a white display) were measured as the light emitting characteristics.

<Test Results>

The results of this test are shown in Table 6. Note that the relative light-emitting intensity values for blue light shown in Table 6 are relative values when the measured light-emitting intensity of the panel 70 is set to 100 as the standard value.

It is noted from the Table 6 that the panels 61 to 69 have light emitting characteristics superior to those of the panel 70 (with higher light-emitting intensity of blue light and smaller chromaticity coordinate y). It is thought that this is because a smaller amount of gas is released in the inner space between panels after the panels are bonded in accordance with the present embodiment than in accordance with conventional methods.

In the PDP of panel 70, the chromaticity coordinate y of the light emitted from blue cells is 0.090 and the color temperature in the white balance without color correction is 5800K. In contrast, in panels 61 to 69, the values are respectively 0.08 or less and 6500K or more. Especially, it is noted that in panels 68 and 69 that have low chromaticity coordinate y of blue light, a high color temperature of around 11,000K has been achieved (in the white balance without color correction).

By comparing the light-emitting characteristics of the panels 61, 62, 65, 68, and 69 (in each of which the partial pressure of steam vapor in the dry gas is 2 Torr), it is noted that the light-emitting characteristics are improved in the order of panels 61, 62, 65, 68, 69 (the light-emitting intensity increases and the chromaticity coordinate y decreases). This shows that the higher a degree the heating temperature in bonding the front panel 10 and back panel 20 is set to, the more the light-emitting characteristics of the PDPs are improved.

By comparing the light-emitting characteristics of the panels 63 to 66 (which have the same temperature profile in the bonding process), it is noted that the light-emitting characteristics are improved in the order of panels 63, 64, 65, and 66 (the chromaticity coordinate y decreases in the order). This shows that the lower the partial pressure of steam vapor in the atmospheric gas is, the more the light-emitting characteristics of the PDPs are improved.

By comparing the light-emitting characteristics of the panels 66 and 67 (which have the same temperature profile in the bonding process), it is noted that the panel 66 is a little superior to the panel 67.

It is considered that this is because a part of oxygen came out of the flourescent substance being an oxide and the oxygen defect was caused in the panel 67 since it was preparatively heated in the atmosphere of non oxygen, while the panel 66 was preparatively heated in the atmospheric gas containing oxygen.

Others

In the above Embodiments 1 to 6, the case of manufacturing a surface-discharge type PDP was described. However, the present invention can be applied to the case of manufacturing an opposed-discharge type PDP.

The present invention can be achieved by using the fluorescent substances generally used for PDPs other than the fluorescent substances with the composition shown in the above embodiments.

Typically, the sealing glass is applied after the fluorescent substance layer is formed, as shown in Embodiments 1 to 6. However, the order of these process may be reversed.

Industrial Use Possibility

The PDP of the present invention and the method of producing the PDP are effective for manufacturing displays for computers or TVs, especially for manufacturing large-screen displays.

The invention claimed is:

1. A PDP production method comprising:

a fluorescent substance layer forming step for forming a fluorescent substance layer on at least one of: a side of a front panel facing a back panel; and a side of the back panel facing the front panel;

a sealing material layer forming step for forming a sealing material layer on at least one of: the side of the front panel facing the back panel; and the side of the back panel facing the front panel;

a preparative heating step for, after the fluorescent substance layer forming step and the sealing material layer forming step, heating the front panel and the back panel while a space is opened between the sides of the panels facing each other; and a bonding step for, immediately after the preparative heating step, putting the front panel and the back panel together to form inner space between the panels, and bonding the front panel and the back panel by maintaining a bonding temperature equal to or higher than a softening point of the sealing material.

2. The PDP production method of claim 1, wherein in the preparative heating step, the front panel and the back panel are heated to a temperature lower than the softening point of the sealing material, and in the bonding step, the panels are put together and heated to the bonding temperature to be bonded together.

3. The PDP production method of claim 1, wherein in the preparative heating step, the front panel and the back panel are heated to a temperature higher than the bonding temperature, and the front panel and the back panel are cooled to the bonding temperature then the bonding step is started.

4. The PDP production method of claim 1, wherein the preparative heating step is performed while the front panel and the back panel are under a pressure lower than an atmospheric pressure.

5. The PDP production method of claim 1, wherein the preparative heating step is performed while gases released from the front panel and the back panel when the panels are heated are forcibly exhausted to outside.

6. The PDP production method of claim 1, wherein in the preparative heating step, the front panel and the back panel are heated to 200° C. or higher.

7. The PDP production method of claim 1, wherein in the preparative heating step, the front panel and the back panel are heated to 300° C. or higher.

8. The PDP production method of claim 1, wherein in the preparative heating step, the front panel and the back panel are heated to a temperature in a range of 300° C. to 400° C.

9. The PDP production method of claim 1, wherein in the preparative heating step, the front panel and the back panel are heated to 400° C. or higher.

10. The PDP production method of claim 1, wherein in the preparative heating step, the front panel and the back panel are heated to a temperature in a range of 450° C. to 520° C.

11. The PDP production method of claim 1, wherein in the sealing material layer forming step, the sealing material layer is formed on both of: the side of the front panel facing the back panel; and the side of the back panel facing the front panel, and in the bonding step, the front panel and the back panel are put together by matching the sealing material layers formed on the panels to each other.

12. The PDP production method of claim 1 further comprising:

a separating step for properly positioning the front panel and the back panel, putting the panels together, and separating the front panel and the back panel from each other by moving the panels along a certain path, the separating step being performed before the preparative heating step, wherein in the bonding step, the front panel and the back panel are put together by moving the panels in a direction opposite to a movement along the certain path of the separating step.

13. The PDP production method of claim 12, wherein in the separating step and the bonding step, the front panel and the back panel are moved to positions parallel to themselves.

14. The PDP production method of claim 1, wherein the preparative heating step is performed while the front panel and the back panel are in an atmosphere of dry gas.

15. The PDP production method of claim 14, wherein partial pressure of steam vapor in the dry gas is 15 Torr or less in an atmosphere in which the dry gas is used.

16. The PDP production method of claim 14, wherein the dew-point temperature of the dry gas is 20° C. or lower.

17. The PDP production method of claim 14, wherein the dry gas contains oxygen.

18. The PDP production method of claim 14, wherein the dry gas is dry air.

19. The PDP production method of claim 14, wherein the preparative heating step is performed while the front panel and the back panel are in an atmosphere in which a dry gas is circulated.

20. The PDP production method of claim 19, wherein partial pressure of steam vapor in the dry gas is 15 Torr or less in an atmosphere in which the dry gas is used.

21. The PDP production method of claim 19, wherein the dew-point temperature of the dry gas is 20° C. or lower.

22. The PDP production method of claim 19, wherein the dry gas contains oxygen.

23. The PDP production method of claim 19, wherein the dry gas is dry air.

24. A PDP production apparatus for putting a front panel and a back panel together with a fluorescent substance layer formed on at least one of: a side of the front panel facing the back panel; and a side of the back panel facing the front panel and with a sealing material formed between the front panel and the back panel, and bonding the panels to form inner space between the panels by heating the panels and softening the sealing material, the PDP production apparatus comprising:

a heating mechanism for heating the front panel and the back panel;

a moving mechanism for moving the front panel and the back panel having been put together to separate the panels from each other along a certain path and putting the front panel and the back panel by moving the panels in an opposite direction.

25. The PDP production apparatus of claim 24 further comprising:

a chamber in which the front panel and the back panel are housed; and an exhausting mechanism for exhausting gases from the chamber.

* * * * *